US009282623B2

(12) United States Patent
Roy et al.

(10) Patent No.: US 9,282,623 B2
(45) Date of Patent: Mar. 8, 2016

(54) SYSTEM, METHOD, AND APPARATUS FOR MICROSCALE PLASMA ACTUATION

(75) Inventors: Subrata Roy, Gainesville, FL (US); Chin-Cheng (James) Wang, Gainesville, FL (US)

(73) Assignee: University of Florida Research Foundation, Inc., Gainesville, FL (US)

( * ) Notice: Subject to any disclaimer, the term of this patent is extended or adjusted under 35 U.S.C. 154(b) by 384 days.

(21) Appl. No.: 13/642,796

(22) PCT Filed: Apr. 21, 2011

(86) PCT No.: PCT/US2011/033483

§ 371 (c)(1), (2), (4) Date: Oct. 22, 2012

(87) PCT Pub. No.: WO2011/133807

PCT Pub. Date: Oct. 27, 2011

(65) Prior Publication Data

US 2013/0038199 A1 Feb. 14, 2013

Related U.S. Application Data

(60) Provisional application No. 61/326,332, filed on Apr. 21, 2010.

(51) Int. Cl.
*H05H 1/24* (2006.01)
*F04B 19/00* (2006.01)

(52) U.S. Cl.
CPC ..... *H05H 1/2406* (2013.01); *F04B 19/006* (2013.01); *H05H 1/24* (2013.01); *H05H 2001/2412* (2013.01)

(58) Field of Classification Search
CPC ..... F04B 19/006; H05H 1/24; H05H 1/2406; H05H 2001/2412; B64C 23/005; B64C 2230/12
USPC ..... 417/53, 48; 315/111.01, 111.21, 111.91
See application file for complete search history.

(56) References Cited

U.S. PATENT DOCUMENTS 7,380,756 B1 * 6/2008 Enloe et al. ..... 244/175
8,348,626 B2 * 1/2013 Roy ..... 417/48

(Continued)

FOREIGN PATENT DOCUMENTS

EP 1 995 173 A1 11/2008
WO WO 2009015371 A2 * 1/2009

OTHER PUBLICATIONS

Kazemi, et al., Electrohydrodynamic micropumps with asymmetric electrode geometrics for microscale electronics cooling, Apr. 2009.*

(Continued)

*Primary Examiner* — Devon Kramer
*Assistant Examiner* — Nathan Zollinger
(74) *Attorney, Agent, or Firm* — Saliwanchik, Lloyd & Eisenschenk

(57) ABSTRACT

A device is provided having a flow passage with at least one surface and at least one electrode pair positioned thereon for effecting fluid flow through the flow passage. When at least one electrode of an electrode pair of the at least one electrode pair is powered, a sheath region is generated in the flow passage, wherein the sheath region has a high electric field relative to the remainder of the flow passage. In an embodiment, one electrode of the electrode pair is separated from the other electrode of the electrode pair by a horizontal, vertical, depth, and/or total distance of about 1 microns.

30 Claims, 32 Drawing Sheets

(56) References Cited

U.S. PATENT DOCUMENTS

| | | | | |
|---|---|---|---|---|
| 8,382,029 | B2 * | 2/2013 | Roy | 244/23 C |
| 2005/0121607 | A1 * | 6/2005 | Miller et al. | 250/287 |
| 2007/0089795 | A1 * | 4/2007 | Jacob | 137/827 |
| 2010/0102174 | A1 * | 4/2010 | Roy | 244/23 C |
| 2010/0127624 | A1 * | 5/2010 | Roy | 315/111.21 |

OTHER PUBLICATIONS

Wang, et al., Microscale plasma actuators for improved thrust density, Jul. 10, 2009.*

Fisher (Direct simulation of ionization and ion transport for planar microscale ion generation devices, Feb. 9, 2009).*

Shin (Characterization of a direct-current glow discharge plasma actuator in low-pressure supersonic flow, Jul. 2007).*

Longwitz, R.G., "Study of Gas Ionization in a Glow Discharge and Development of a Microgas Ionizer for Gas Detection and Analysis," Thesis No. 2919, Institute of Microsystems and Microelectronics, Swiss Federal Institute of Technology, Lausanne, Switzerland, 2004, pp. 1-127.

Baars-Hibbe, L., et al., "High Frequency Glow Discharges at Atmospheric Pressure with Micro-Structured Electrode Arrays," *Journal of Physics D: Applied Physics*, Feb. 21, 2005, vol. 38. No. 4, pp. 510-517.

Baker, A.J., et al., *Finite Elements 1-2-3*, McGraw-Hill College, Columbus, Nov. 1990.

Becker, K.H., et al., "Microplasmas and Applications," *Journal of Physics D: Applied Physics*, Feb. 7, 2006, vol. 39. No. 3, pp. R55-R70.

Boeuf, J.P., et al., "Predicted Properties of Microhollow Cathode Discharges in Xenon," *Applied Physics Letters*, Feb. 14, 2005, vol. 86, No. 7, Article No. 071501.

Carey, G.F., et al., *Finite Elements: A Second Course*: Vol. II, Prentice Hall, Englewood Cliffs, 1983.

Choi, J., et al., "Electron and Ion Kinetics in a DC Microplasma at Atmospheric Pressure," *IEEE Transactions on Plasma Science*, Oct. 2007, vol. 35, No. 5, pp. 1274-1278.

Farouk, T., et al., "Simulation of DC Atmospheric Pressure Argon Micro Glow-Discharge," *Plasma Sources Science and Technology*, Nov. 2006, vol. 15, No. 4, pp. 676-688.

Gaitonde, D.V., "Control of Flow Past a Wing Section with Plasma-Based Body Forces," *36th AIAA Plasmadynamics and Lasers Conference*, Jun. 6-9, 2005, Toronto, Canada.

Germer, L.H., "Electrical Breakdown Between Close Electrodes in Air," *Journal of Applied Physics*, Jan. 1959, vol. 30, No. 1, pp. 46-51.

Kossyi, I.A., et al., "Kinetic Scheme of the Non-Equilibrium Discharge in Nitrogen-Oxygen Mixtures," *Plasma Sources Science and Technology*, Aug. 1992, vol. 1, No. 3, pp. 207-220.

Kumar, H., et al., "Multidimensional Hydrodynamic Plasma-Wall Model for Collisional Plasma Discharges With and Without Magnetic-Field Effects," *Physics of Plasmas*, Sep. 2005, vol. 12, No. 9, Article No. 093508.

Kushner, M.J., "Modeling of Microdischarge Devices: Pyramidal Structures," *Journal of Applied Physics*, Feb. 1, 2004, vol. 95, No. 3, pp. 846-859.

Laser, D.J., et al., "A Review of Micropumps," *Journal of Micromechanics and Microengineering*, Jun. 2004, vol. 14, No. 6, pp. R35-R64.

Lee, R.H., et al., "Free Molecule Micro-Resistojet: Nanosatellite Propulsion," 41th AIAA/ASME/SAE/ASEE Joint Propulsion Conference and Exhibit, 2005, AIAA Article No. 2005-4073.

Ono, T., et al., "Micro-Discharge and Electric Breakdown in a Micro-Gap," *Journal of Micromechanics and Microengineering*, Sep. 2000, vol. 10, No. 3, pp. 445-451.

Post, M.L., "Separation Control on High Angle of Attack Airfoil Using Plasma Actuators," *AIAA Journal*, Nov. 2004, vol. 42, No. 11, pp. 2177-2184.

Radmilovic-Radjenovic, M., et al., "Particle-in-Cell Simulation of Gas Breakdow in Microgaps," *Journal of Physics D: Applied Physics*, Mar. 21, 2005, vol. 38. No. 6, pp. 950-954.

Raju, R., et al., "Modeling Single Component Fluid Transport through Micro Channels and Free Molecule Micro-Resistojet," 42nd Aerospace Sciences Meeting and Exhibit, Jan. 5-8, 2004, Reno, Nevada, AIAA Article No. 2004-1342.

Roth, J.R., "Aerodynamic Flow Acceleration Using Paraelectric and Peristaltic Electrohydrodynamic Effects of a One Atmosphere Uniform Glow Discharge Plasma," *Physics of Plasmas*, May 2003, vol. 10, No. 5, pp. 2117-2126.

Roy, S., et al., "Modeling Gas Flow Through Microchannels and Nanopores," *Journal of Applied Physics*, Apr. 15, 2003, vol. 93, No. 8, pp. 4870-4879.

Roy, S., et al., "Radio Frequency Induced Ionized Collisional Flow Model for Application at Atmospheric Pressures," *Journal of Applied Physics*, Sep. 1, 2004, vol. 96, No. 5, pp. 2476-2481.

Torres, J.M., et al., "Electric Field Breakdown at Micrometre Separations," *Nanotechnology*, Mar. 1999, vol. 10, No. 1, pp. 102-107.

Wang, C.C., et al., "Microscale Plasma Actuators for Improved Thrust Density," *Journal of Applied Physics*, Jul. 1, 2009, vol. 106, No. 1, Article No. 013310.

Wang, Q., et al., "Simulation of a Direct Current Microplasma Discharge in Helium at Atmospheric Pressure," *Journal of Applied Physics*, Jul. 15, 2006, vol. 100, No. 2, Article No. 023301.

* cited by examiner

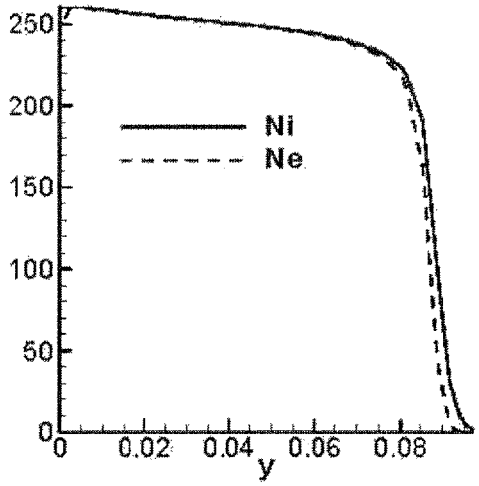
FIG. 11A 200 μm
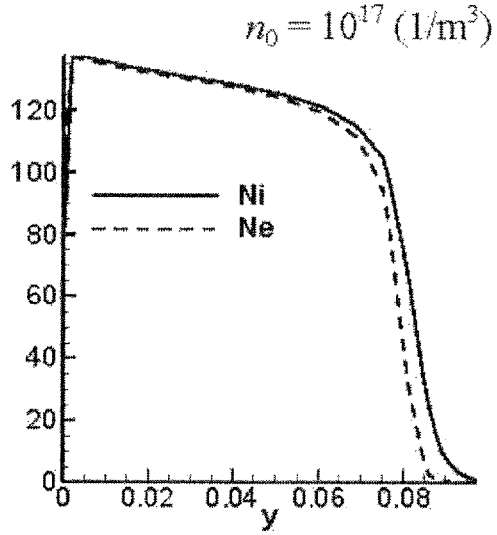
FIG. 11B 100 μm
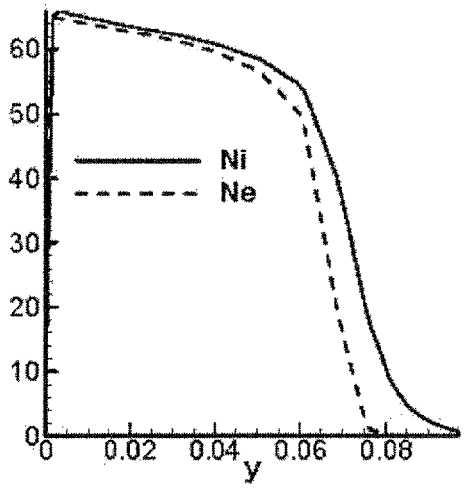
FIG. 11C 50 μm
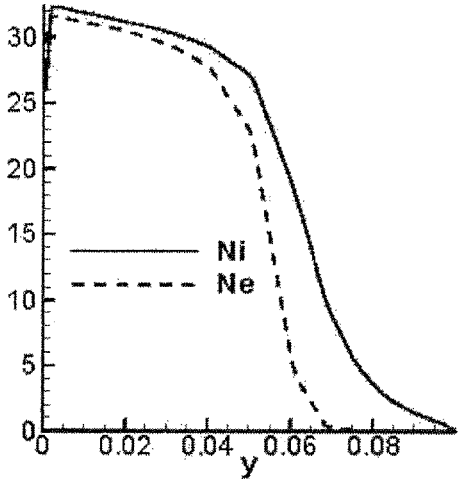
FIG. 11D 30 μm
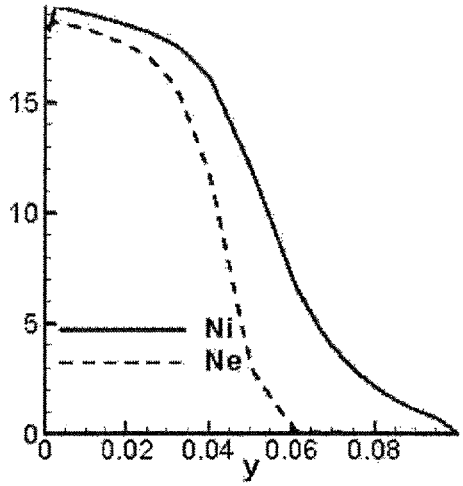
FIG. 11E 20 μm
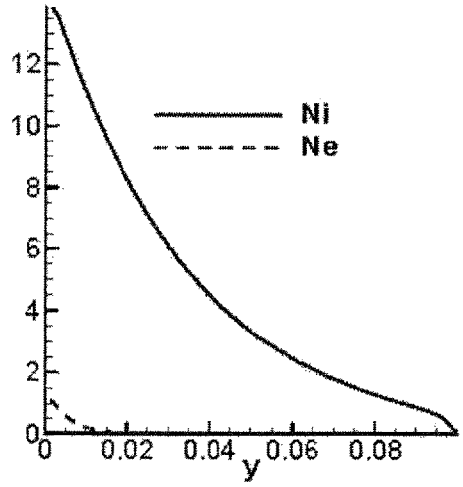
FIG. 11F 10 μm

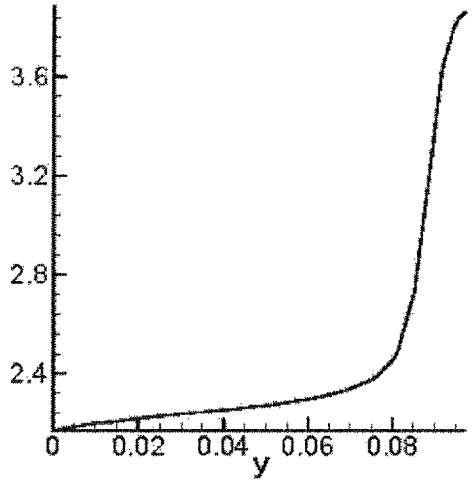
FIG. 12A 200 μm
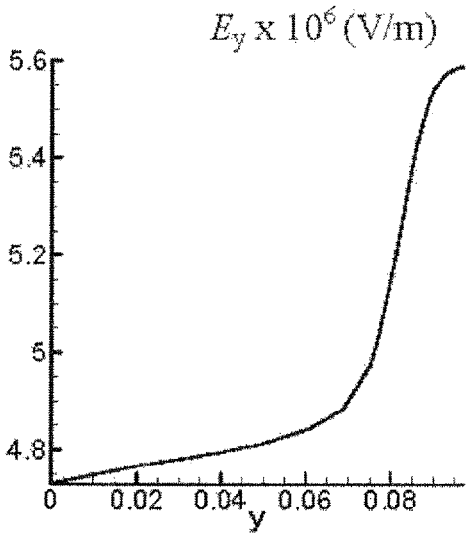
FIG. 12B 100 μm
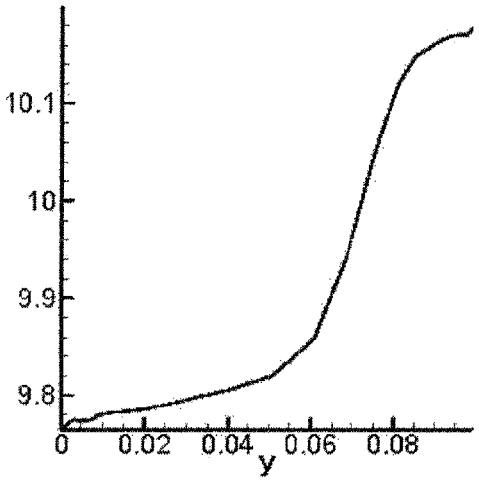
FIG. 12C 50 μm
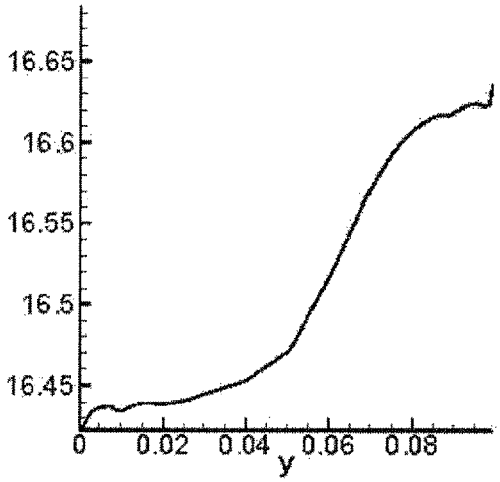
FIG. 12D 30 μm
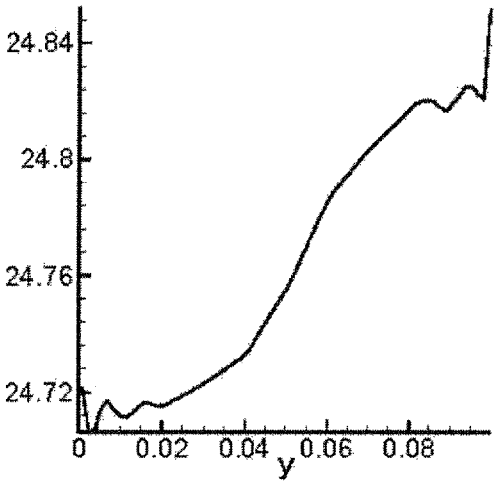
FIG. 12E 20 μm
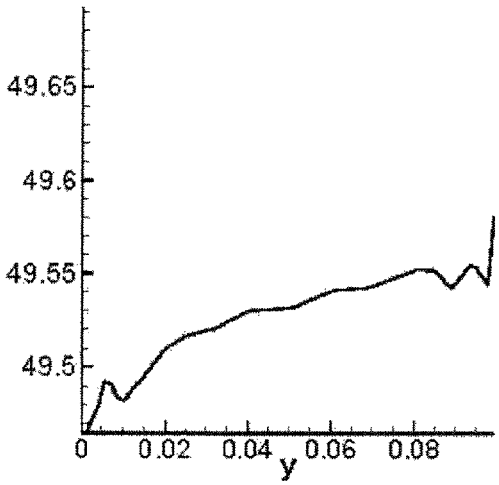
FIG. 12F 10 μm

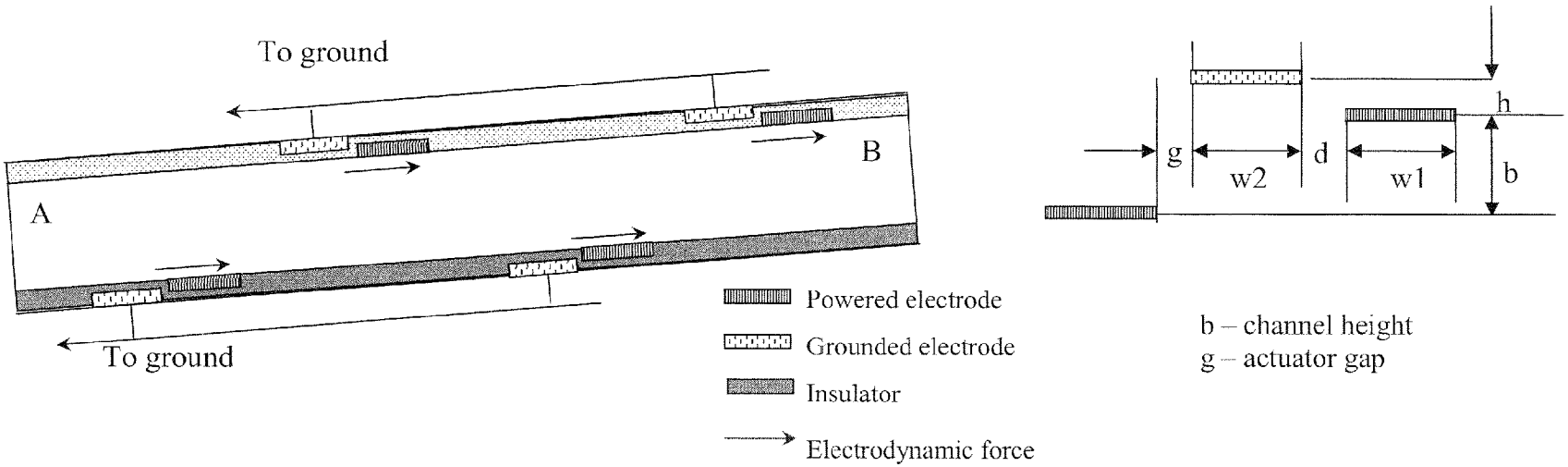
FIG. 42
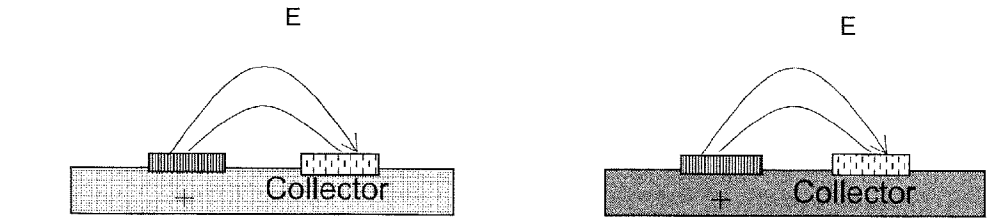
FIG. 43A
FIG. 43B
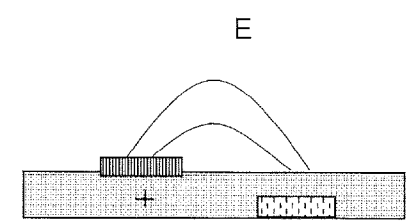
FIG. 43C (a) Straight pumping (b) Swirl pumping

SYSTEM, METHOD, AND APPARATUS FOR MICROSCALE PLASMA ACTUATION

CROSS-REFERENCE TO RELATED APPLICATIONS

The present application is the U.S. National Stage Application of International Patent Application No. PCT/US2011/033483, filed on Apr. 21, 2011, which claims the benefit of U.S. Provisional patent application No. 61/326,332, filed Apr. 21, 2010, both of which are hereby incorporated by reference herein in their entirety, including any figures, tables, or drawings.

BACKGROUND OF INVENTION

Traditionally, to produce an electrical glow discharge, a DC voltage potential is placed across two electrodes. If the voltage potential is gradually increased, at the breakdown voltage $V_B$, the current and the amount of excitation of the neutral gas becomes large enough to produce a visible plasma. According to Paschen's law, the breakdown voltage for a particular gas depends on the product (p.d) of the gas pressure and the distance between the electrodes. For any gas, there is said to be a unique p.d value referred to as the Stoletow point where volumetric ionization is the maximum. For example, the Stoletow point for air requires a minimum $V_B$=360 V and p.d=5.7 Torr-mm. Typical plasma actuators have an interelectrode gap of ±d mm where d~3-5 mm. Such actuators produce mN/m thrust with kN/m$^3$ thrust density with 10 s of watts input. In such actuators the electric field generated by charge separation is concentrated near the electrodes and the bulk region does not get much influence of the high electric field as the quasi-neutral plasma dominates the bulk region. Thus, an alternative configuration is needed such that the entire region is space charge separated, thus minimizing the quasi-neutral region and improving thrust density.

BRIEF SUMMARY

Embodiments of the subject invention relate to systems, methods, and apparatus for providing microscale plasma actuation. In an embodiment of the subject invention, a device is provided having a flow passage with at least one surface and at least one electrode pair positioned thereon for effecting fluid flow through the flow passage. In an embodiment, when at least one electrode of an electrode pair of the at least one electrode pair is powered with a voltage differential, a sheath region is generated in the flow passage, wherein the sheath region has a high electric field relative to the remainder of the flow passage. In an embodiment, the number density of ions in the sheath region is significantly different than the number density of electrons in the sheath region. In an embodiment, a cathode sheath region is generated extending from the cathode of the electrode pair, wherein the number density of ions in the cathode sheath region is significantly greater than the number density of electrons in the cathode sheath region. In an embodiment, an anode sheath region is generated extending from the anode of the electrode pair, wherein the number density of ions in the anode sheath region is significantly less than the number density of electrons in the anode sheath region. In an embodiment, the polarity of the electrodes in the electrode pair is reversed and the cathode sheath becomes an anode sheath and vice versa.

In an embodiment, a first electrode of an electrode pair of the at least one electrode pair is separated from a second electrode of the electrode pair by an interelectrode distance.

In an embodiment, the first electrode is separated from the second electrode in a horizontal direction by a horizontal distance substantially in the general direction of fluid flow in the flow passage near the electrode pair. In an embodiment, the first electrode is separated from the second electrode in a vertical direction by a vertical distance orthogonal to the horizontal distance. In an embodiment, the first electrode is separated from the second electrode in a depth direction by a depth distance orthogonal to both the horizontal distance and the vertical distance. In an embodiment, the first electrode is separated from the second electrode by a total distance, wherein the total distance is the total distance between the first electrode and the second electrode including any distance components in the horizontal, vertical, and depth directions. In an embodiment, the horizontal, vertical, depth, and/or total distance between the first electrode and the second electrode is less than 1 mm. In an embodiment, the horizontal, vertical, depth, and/or total distance between the first electrode and the second electrode is less than 100 microns. In an embodiment, the horizontal, vertical, depth, and/or total distance between the first electrode and the second electrode is less than 50 microns In an embodiment, the horizontal, vertical, depth, and/or total distance between the first electrode and the second electrode is less than 20 microns.

In an embodiment, the horizontal, vertical, depth, and/or total distance between the first electrode and the second electrode is less than 1 micron. In an embodiment, the horizontal, vertical, depth, and/or total distance between the first electrode and the second electrode is about 1 micron.

In an embodiment of the subject invention, an electrohydrodynamic (EHD) body force is used to effect the flow of a fluid through a micro channel, expansion slot, or other flow region. In an embodiment, a plurality of electrodes are arranged and powered to create a plasma discharge, which can impart an EHD body force to a fluid. Various configurations of electrodes can be used to control the flow of the fluid into, out of, or through the flow region. In an embodiment, a surface discharge can be produced by arranging and powering electrodes on one surface of a flow region. In an embodiment, a volumetric discharge can be produced by arranging and powering electrodes across the flow region. In an embodiment when one or more electrodes of the plurality of electrodes are powered with a voltage differential, a sheath region is generated in the flow region, as discussed above.

In an embodiment, a surface discharge is generated by powering a pair of electrodes of the plurality of electrodes, wherein a first electrode of the electrode pair is separated from a second electrode of the electrode pair by an insulating material. In an embodiment, the first electrode is separated from the second electrode by an interelectrode distance. In an embodiment, the first electrode is separated from the second electrode in a horizontal direction by a horizontal distance substantially in the general direction of fluid flow in the flow passage near the electrode pair, and the first electrode is separated from the second electrode in a vertical direction by a vertical distance through the insulating material and orthogonal to the horizontal distance. In an embodiment, the first electrode is also separated from the second electrode in a depth direction by a depth distance orthogonal to both the horizontal distance and the vertical distance. In an embodiment, the first electrode is separated from the second electrode by a total distance, wherein the total distance is the total distance between the first electrode and the second electrode including any distance components in the horizontal, vertical, and depth directions. In an embodiment, the horizontal, vertical, depth, and/or total distance between the first electrode and the second electrode is less than 1 mm. In an embodiment, the horizontal, vertical, depth, and/or total distance between the first electrode and the second electrode is less than 100 microns. In an embodiment, the horizontal, vertical, depth, and/or total distance between the first electrode and the second electrode is less than 50 microns In an embodiment, the horizontal, vertical, depth, and/or total distance between the first electrode and the second electrode is less than 20 microns.

In an embodiment, the horizontal, vertical, depth, and/or total distance between the first electrode and the second electrode is less than 1 micron.

In an embodiment, the horizontal, vertical, depth, and/or total distance between the first electrode and the second electrode is about 1 micron.

In an embodiment, a volumetric discharge is generated by powering a pair of electrodes of the plurality of electrodes, wherein a first electrode of the electrode pair is separated from a second electrode of the electrode pair by a portion of the flow region. In an embodiment, the first electrode is separated from the second electrode by an interelectrode distance. In an embodiment, the first electrode is separated from the second electrode in a horizontal direction by a horizontal distance substantially in the general direction of fluid flow in the flow passage near the electrode pair, and the first electrode is separated from the second electrode in a vertical direction by a vertical distance across the portion of the flow region and orthogonal to the horizontal distance. In an embodiment, the first electrode is also separated from the second electrode in a depth direction by a depth distance orthogonal to both the horizontal distance and the vertical distance. In an embodiment, the first electrode is separated from the second electrode by a total distance, wherein the total distance is the total distance between the first electrode and the second electrode including any distance components in the horizontal, vertical, and depth directions. In an embodiment, the horizontal, vertical, depth, and/or total distance between the first electrode and the second electrode is less than 1 mm. In an embodiment, the horizontal, vertical, depth, and/or total distance between the first electrode and the second electrode is less than 100 microns.

In an embodiment, the horizontal, vertical, depth, and/or total distance between the first electrode and the second electrode is less than 50 microns. In an embodiment, the horizontal, vertical, depth, and/or total distance between the first electrode and the second electrode is less than 20 microns. In an embodiment, the horizontal, vertical, depth, and/or total distance between the first electrode and the second electrode is less than 1 micron. In an embodiment, the horizontal, vertical, depth, and/or total distance between the first electrode and the second electrode is about 1 micron.

BRIEF DESCRIPTION OF DRAWINGS

FIG. 11 shows an ion ($N_i$) and electron ($N_e$) density distribution along y-direction with various gaps from d=200 to 10 μm, where reference density is $n_0=10^{17}$ $m^{-3}$ in accordance with an embodiment of the subject invention.

FIG. 12 shows an electric field $E_y$ (V/m) along y-direction with various gap from d=200 to 10 μm in accordance with an embodiment of the subject invention.

FIG. 42 shows a schematic of a conduit design according to an embodiment of the subject invention.

FIGS. 43A-43C illustrate different arrangements of electrodes in a conduit according to embodiments of the subject invention.

DETAILED DISCLOSURE

Embodiments of the subject invention relate to systems, methods, and apparatus for providing microscale plasma actuation. In an embodiment of the subject invention, electrodynamic principles are used to generate high thrust density using localized electrical discharge. In an embodiment, the thrust density of plasma actuators is improved over traditional plasma actuators. In an embodiment, thrust density is improved by several orders of magnitude. In an embodiment, the power required by such actuators to control neighboring flow is reduced. Embodiments of the subject invention can be used in various applications including, but not limited to, flow management, propulsion, noise control, micropumping, and space propulsion related industry, among other possible applications.

Figure 1A:
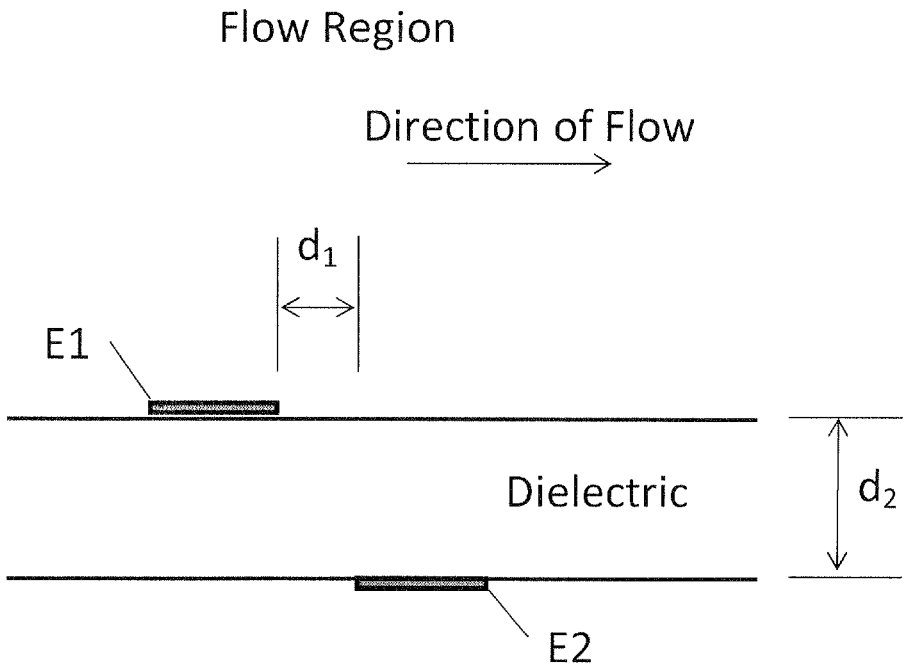
FIGS. 1A-1B show plasma actuators in accordance with embodiments of the subject invention.
Figure 1B:
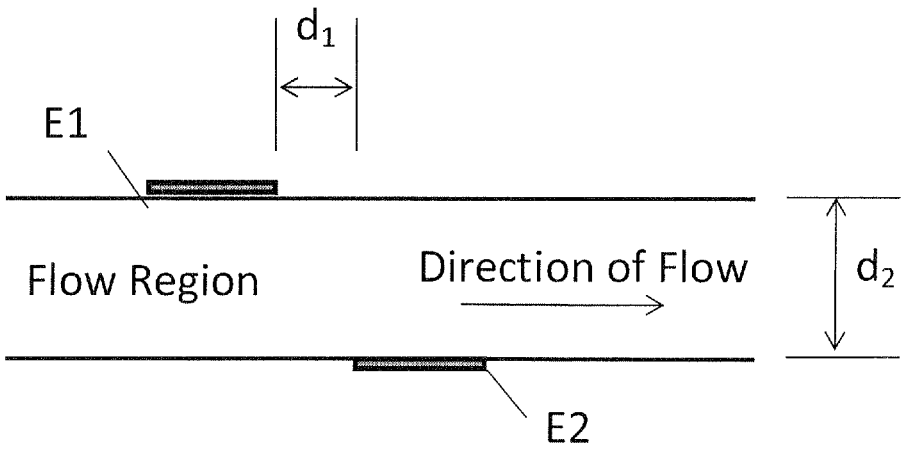

The Figures provided are not necessarily to scale and the relative distances between electrodes and electrode pairs can vary from those shown. As shown in FIGS. 1A and 1B, according to embodiments of the subject invention, one or more plasma actuators are provided having at least one pair of electrodes separated by an interelectrode gap. FIG. 1A shows a plasma actuator capable of producing a surface discharge in a flow region containing a fluid. In the embodiment shown, an electrode E1 is separated from an electrode E2 in a horizontal direction by a horizontal distance $d_1$ substantially in the general direction of fluid flow in the flow passage near E1 and E2. The electrodes are also separated by a dielectric or other insulating material in a vertical direction by a vertical distance $d_2$ through the insulating material and orthogonal to the horizontal distance. In an embodiment, the electrodes are also separated in a depth direction by a depth distance orthogonal to both the horizontal and vertical distances. In an embodiment, the electrodes are separated by a total distance, wherein the total distance is the total distance between the first electrode and the second electrode including any distance components in the horizontal, vertical, and depth directions. When a voltage potential is applied to the electrodes, a surface discharge is produced in the flow region, which induces movement of the fluid in the direction of flow.

FIG. 1B shows a plasma actuator capable of producing a volume discharge in a flow region containing a fluid. In the embodiment shown, an electrode E1 is separated from an electrode E2 in a horizontal direction by a horizontal distance $d_1$ substantially in the general direction of fluid flow in the flow passage near E1. The electrodes are also separated across the flow region in a vertical direction by a vertical distance $d_2$ across the flow region and orthogonal to the horizontal distance. In an embodiment, the electrodes are also separated in a depth direction by a depth distance orthogonal to both the horizontal and vertical distances. In an embodiment, the electrodes are separated by a total distance, wherein the total distance is the total distance between the first electrode and the second electrode including any distance components in the horizontal, vertical, and depth directions. When a voltage potential is applied to the electrodes, a volume discharge is produced in the flow region, which induces movement of the fluid in the direction of flow.

Figure 2:
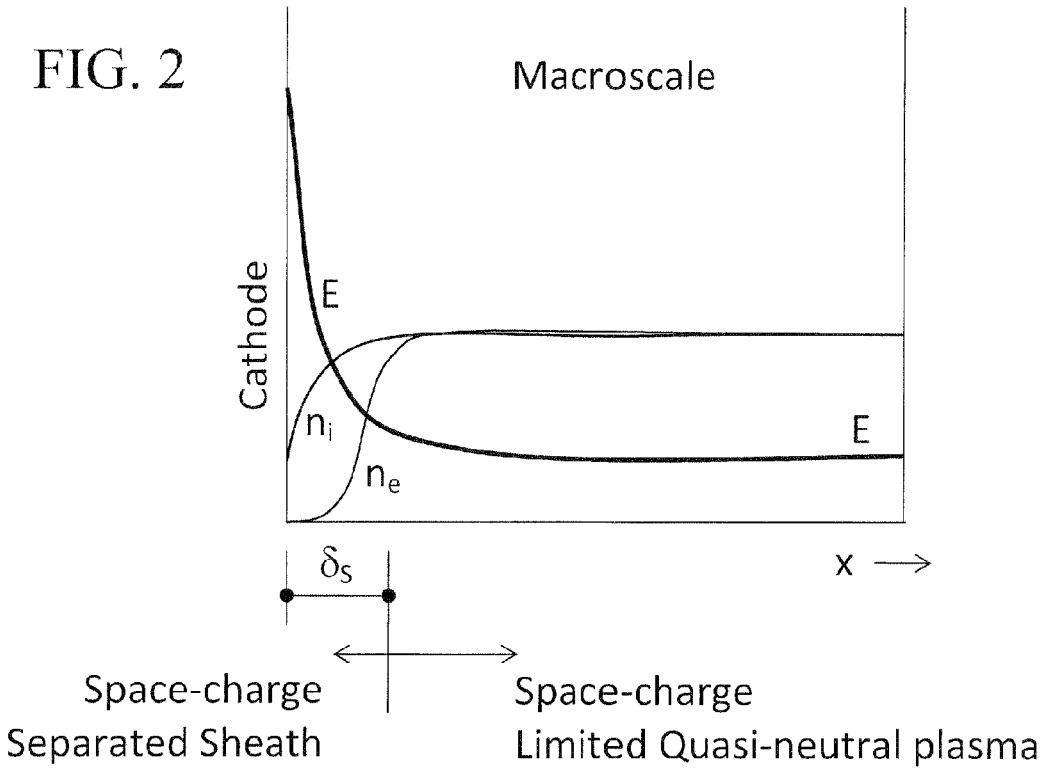
FIG. 2 shows electronic charge and number density of ions and electrons produced by a macroscale plasma actuator.

Traditional macroscale plasma actuators have a horizontal, vertical, depth, and/or total distance of ±d mm where d~3-5 mm. Such electrodes can be powered by DC or AC supply. Such actuators can produce mN/m thrust with kN/m$^3$ thrust density with 10 s of watts input. As shown in FIG. 2, in macroscale actuators configured as shown in FIG. 1A or 1B, the electric field generated by charge separation is generally concentrated near the electrodes and the bulk region does not get much influence of the high electric field as the quasi-neutral plasma dominates the bulk region. The thickness $\delta_s$ of this region of high electric field, called the sheath region, and corresponding space charge $q=e(n_i-n_e)$ is of the order of a Debye length $\delta_D$. Here x is the distance from the beginning of the actuator in the horizontal direction, E is the electronic charge, and $n_i$ and $n_e$ are the number densities of ions and electrons respectively. The beginning of the actuator can be defined as the downstream end of the downstream electrode of a powered electrode pair. Thus, in the embodiments shown in FIGS. 1A and 1B, the beginning of the actuator can be defined as the left most end of the electrode E1. Atmospheric air has a Debye length $\delta_D$ on the order of microns. It appears that the majority region of quasi-neutral plasma generates negligible electric field and hence negligible electric force qE.

Figure 3:
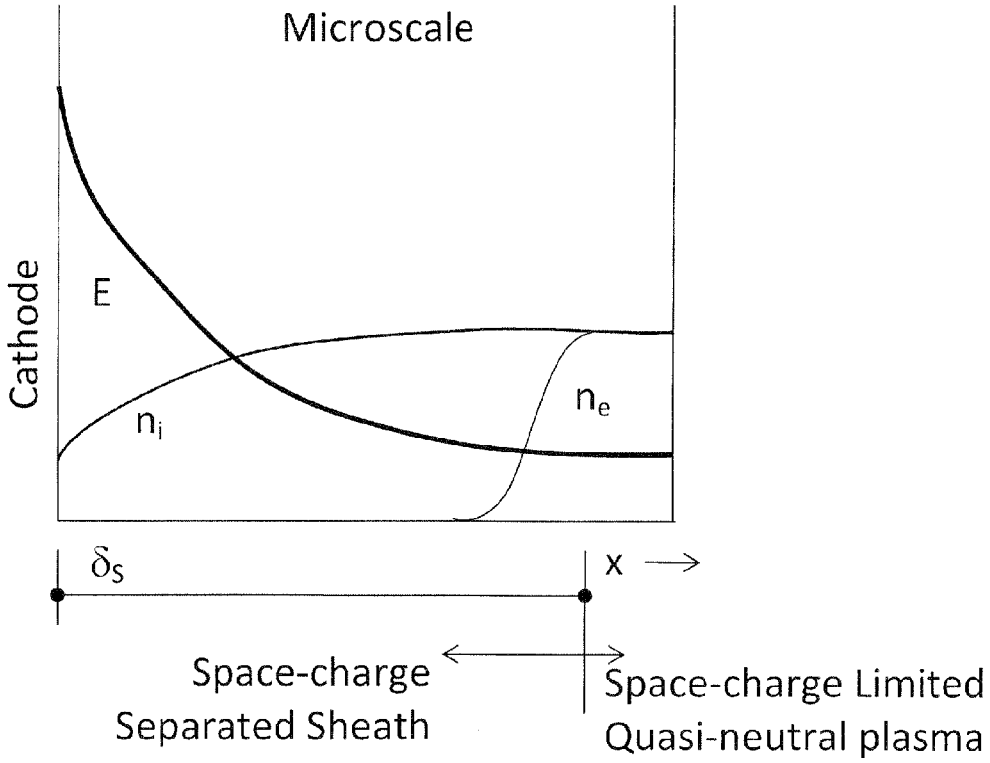
FIG. 3 shows electronic charge and number density of ions and electrons produced by a microscale plasma actuator in accordance with an embodiment of the subject invention.
Figure 4:
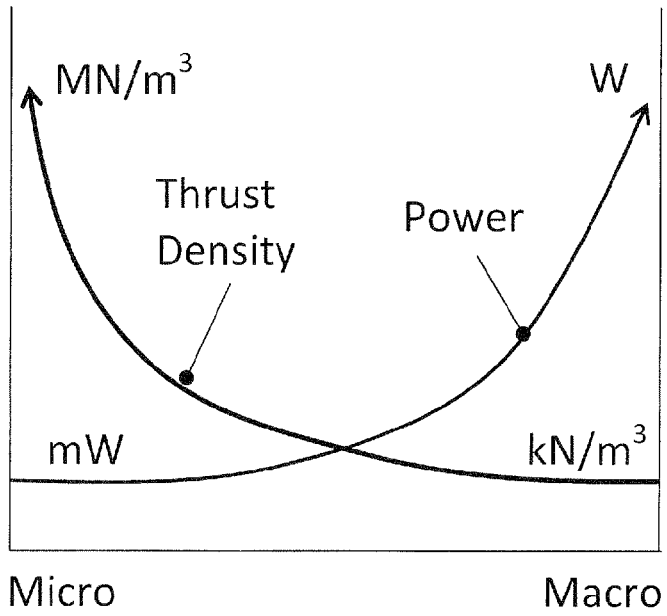
FIG. 4 shows input power and thrust density for macroscale and microscale plasma actuators in accordance with an embodiment of the subject invention.

In an embodiment of the subject invention, the horizontal, vertical, depth, and/or total distance is reduced to micron scale. In contrast to traditional actuators, when such microscale actuators are powered, a high electric field is generated across a very small gap, such as less than 20 microns. As shown in FIG. 3, in an embodiment where a microscale actuator is configured as shown in FIG. 1A or 1B, the majority of the region is space charge separated. In an embodiment, the quasi-neutral region is minimized. In an embodiment, thrust density is significantly improved. In an embodiment, $MN/m^3$ thrust density is produced. A relative comparison of the estimated thrust density as a function of actuator scale is given in FIG. 4. In an embodiment, an added benefit of such microscale actuators is their low input power requirement. In an embodiment, only a few mW are required to power such microscale actuators.

Specific embodiments can operate at atmospheric pressure, while other embodiments can operate at less than or greater than atmospheric pressure, such as in the range of greater than 1/1,000,000 atm, in the range of 1/1,000,000 atm to 1/100,000 atm, in the range of 1/100,000 atm to 1/10,000 atm, in the range of 1/10,000 atm to 1/1000 atm, in the range of 1/1000 atm to 1/100 atm, in the range of 1/100 atm to 1/10 atm, in the range of 1/10 atm to 1 atm, in the range of 1 atm to 10 atm, in the range of 10 atm to 100 atm, and in the range of 100 atm to 1000 atm, where atm equals atmospheric pressure. At different pressures the Debye length can change. As the thickness of the sheath region is on the order of the Debye length, the thickness of the sheath region can change with pressure, for the same electrode structure and drive voltage. As an example, at atmospheric pressure, the Debye length can be on the order of a micron, where at a pressure in the range of 1/100 atm to 1/1000 atm the Debye length can be on the order of a millimeter (mm). Specific embodiments can have: flow regions that have thicknesses less than or equal to the thickness of the sheath region, such that the sheath region extends over the entire flow region; flow regions that have thicknesses less than or equal to 95% of the thickness of the sheath region, such that the sheath region extends over 95% of the flow region; flow regions that have thicknesses less than or equal to 75% of the thickness of the sheath region, such that the sheath region extends over 75% of the flow region; flow regions that have thicknesses less than or equal to 50% of the thickness of the sheath region, such that the sheath region extends over 50% of the flow region; and flow regions that have thicknesses less than or equal to 25% of the thickness of the sheath region, such that the sheath region extends over 25% of the flow region. In a preferred embodiment, the sheath region extends to 90% to 100% of the flow region. There can be a sheath region associated with a surface plasma discharge extending from each of one or more interior surfaces of the flow region, and/or there can be a sheath region associated with a volume plasma discharge where electrodes of an electrode pair are separated by the flow region. In a specific embodiment, the sheath region can be defined as the region wherein $n_i > n_e$ (extending from cathode) or where $n_e > n_i$ (extending from anode), as shown in FIG. 3. In specific embodiments, the sheath region extends more than 1%, more than 5%, or more than 10% of the way into the flow region. The flow region can be within a volume surrounded by surfaces and/or can be above a surface.

In an embodiment as shown in FIGS. 1A and 1B, the horizontal $d_1$, vertical $d_2$, depth, and/or total distance between the electrode E1 and the electrode E2 is less than 1 mm. In an embodiment, the horizontal $d_1$, vertical $d_2$, depth, and/or total distance between the electrode E1 and the electrode E2 is less than 100 microns. In an embodiment, the horizontal $d_1$, vertical $d_2$, depth, and/or total distance between the electrode E1 and the electrode E2 is less than 50 microns In an embodiment, the horizontal $d_1$, vertical $d_2$, depth, and/or total distance between the electrode E1 and the electrode E2 is less than 20 microns. In an embodiment, the horizontal $d_1$, vertical $d_2$, depth, and/or total distance between the electrode E1 and the electrode E2 is less than 1 microns. In an embodiment, the horizontal $d_1$, vertical $d_2$, depth, and/or total distance between the electrode E1 and the electrode E2 is about 1 microns. In an embodiment, the horizontal $d_1$, vertical $d_2$, depth, and/or total distance between the electrode E1 and the electrode E2 is great enough so that a plasma discharge is created when a certain voltage potential is applied to the electrodes. In an embodiment, the horizontal vertical $d_2$, depth, and/or total distance between the electrode E1 and the electrode E2 is great enough so that the insulating material between the electrode E1 and the electrode E2 breakdowns when a certain voltage potential is applied to the electrodes. In an embodiment, the certain voltage potential is less 750 V. In an embodiment, the certain voltage potential is between 300 and 750 V. In an embodiment, the certain voltage potential is about 500 V.

In an embodiment as shown in FIGS. 1A and 1B, when the electrode E1 and the electrode E2 are powered with a voltage differential, a sheath region is generated in the flow passage, wherein the sheath region has a high electric field relative to the remainder of the flow passage. In an embodiment, the sheath region is generated when a certain voltage potential is applied to the electrodes. In an embodiment, the certain voltage potential is less 750V. In an embodiment, the certain voltage potential is between 300 and 750 V. In an embodiment, the certain voltage potential is about 500 V. In an embodiment, the number density of ions in the sheath region is significantly different than the number density of electrons in the sheath region. In an embodiment, a cathode sheath region is generated extending from the cathode of the electrode pair, wherein the number density of ions in the cathode sheath region is significantly greater than the number density of electrons in the cathode sheath region. In an embodiment, an anode sheath region is generated extending from the anode of the electrode pair, wherein the number density of ions in the anode sheath region is significantly less than the number density of electrons in the anode sheath region. In an embodiment, the polarity of the electrodes in the electrode pair is reversed and the cathode sheath becomes an anode sheath and vice versa.

In an embodiment of the subject invention, a device is provided having a flow passage with at least one surface and at least one electrode pair positioned thereon for effecting fluid flow through the flow passage. In an embodiment, when at least one electrode of an electrode pair of the at least one electrode pair is powered, a sheath region is generated in the flow passage, as discussed above.

In an embodiment, a first electrode of an electrode pair of the at least one electrode pair is separated from a second electrode of the electrode pair by an interelectrode distance. In an embodiment, the first electrode is separated from the second electrode in a horizontal direction by a horizontal distance substantially in the general direction of fluid flow in the flow passage near the electrode pair. In an embodiment, the first electrode is separated from the second electrode in a vertical direction by a vertical distance orthogonal to the horizontal distance. In an embodiment, the first electrode is separated from the second electrode in a depth direction by a depth distance orthogonal to both the horizontal distance and the vertical distance. In an embodiment, the first electrode is separated from the second electrode by a total distance, wherein the total distance is the total distance between the first electrode and the second electrode including any distance components in the horizontal, vertical, and depth directions. In an embodiment, the horizontal, vertical, depth, and/or total distance between the first electrode and the second electrode is less than 1 mm. In an embodiment, the horizontal, vertical, depth, and/or total distance between the first electrode and the second electrode is less than 100 microns. In an embodiment, the horizontal, vertical, depth, and/or total distance between the first electrode and the second electrode is less than 50 microns In an embodiment, the horizontal, vertical, depth, and/or total distance between the first electrode and the second electrode is less than 20 microns. In an embodiment, the horizontal, vertical, depth, and/or total distance between the first electrode and the second electrode is less than 1 microns. In an embodiment, the horizontal, vertical, depth, and/or total distance between the first electrode and the second electrode is about 1 microns. In an embodiment, the horizontal, vertical, depth, and/or total distance between the first electrode and the second electrode is great enough so that a plasma discharge is created when a certain voltage potential is applied to the electrodes. In an embodiment, the horizontal, vertical, depth, and/or total distance between the first electrode and the second electrode is great enough so that the insulating material between the electrode E1 and the electrode E2 breakdowns when a certain voltage potential is applied to the electrodes. In an embodiment, the certain voltage potential is less 750 V. In an embodiment, the certain voltage potential is between 300 and 750 V. In an embodiment, the certain voltage potential is about 500 V.

Figure 5:
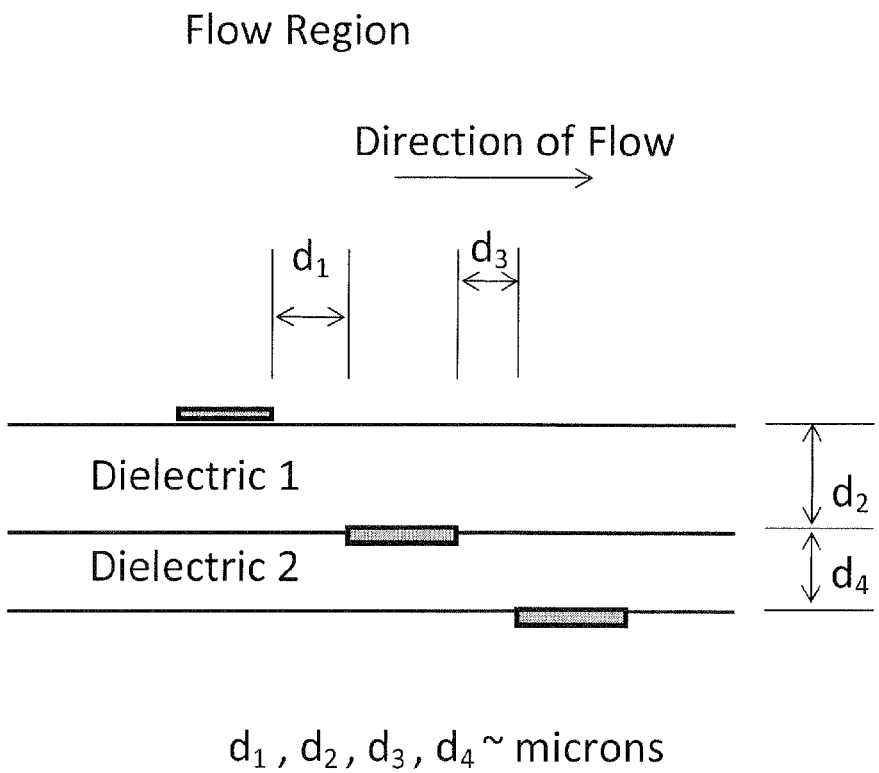
FIG. 5 shows a multibarrier microactuator in accordance with an embodiment of the subject invention.

In an embodiment of the subject invention, a plurality of electrode pairs are used. Such electrode pairs can be arranged and powered in various configurations as described below with reference to FIGS. 17-46. In the embodiment shown in FIG. 5, a multibarrier microactuator (MBMA) is provided with layers of micro-gapped electrodes sandwiched between dielectrics. In an embodiment, distances $d_1$, $d_2$, $d_3$, and/or $d_4$, are approximately 1 micron. In an embodiment, distances $d_1$, $d_2$, $d_3$, and/or $d_4$, are less than 20 microns. In an embodiment, the electrodes are sequentially paired and powered with a phase lag. In an embodiment, higher thrust density is produced than that achieved using traditional plasma actuators. In an embodiment, $GN/m^3$ thrust density is produced.

In an embodiment of the subject invention dielectric barrier discharge (DBD) plasma actuators are applied to microscale applications. In an embodiment, microscale plasma actuators can induce higher force density than traditional macroscale plasma actuators. In an embodiment, orders of magnitude higher force density can be produced. The physics of such actuation can be simulated using a multiscale ionized gas (MIF) flow code based on the high-fidelity finite-element procedure. In an embodiment, a two-dimensional volume discharge with nitrogen as a working gas is used; in other embodiments, other fluids can be used. The volume discharge can be investigated using a first-principles approach solving coupled system of hydrodynamic plasma equations and Poisson equation for ion density, electron density, and electric field distribution. The quasi-neutral plasma and the sheath regions can then be identified. In an embodiment, the simulation shows that, as the gap between electrodes is reduced, the sheath structure dominates the plasma region. In an embodiment, a first generation plasma micropump is provided. The multiscale plasma-gas interaction inside a two-dimensional cross section of the microscale pump geometry can be similarly simulated. In an embodiment, the simulation shows that a reasonable mass flow rate can be pumped using a set of small active electrodes.

Figure 6:
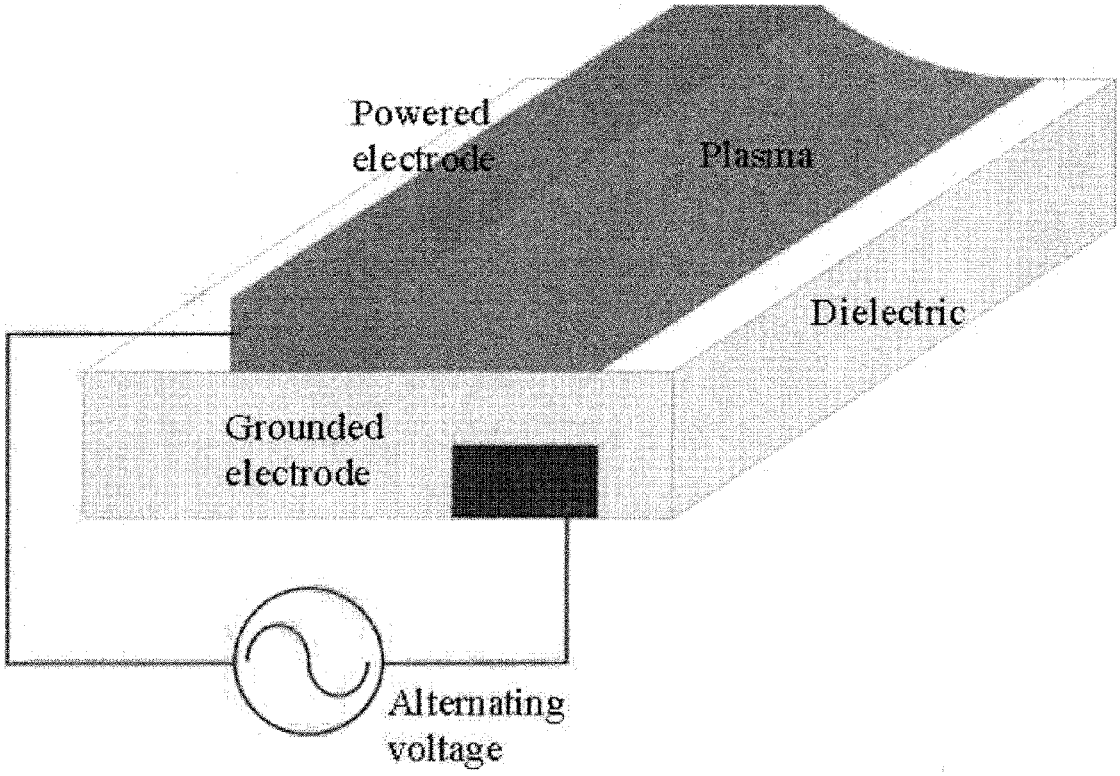
FIG. 6 shows a schematic of a rf dielectric barrier discharge (DBD) actuator for asymmetric configurations in accordance with an embodiment of the subject invention.

The plasma that has been used for traditional flow actuation at atmospheric pressure is a weakly ionized gas, where the ions are fairly evenly dispersed within the flow region and are often near the ambient pressure and temperature. The dielectric barrier discharge (DBD) plasma actuator for flow actuation shown in FIG. 6 uses an asymmetric configuration of electrodes differentially powered at a radio frequency (rf). This configuration can create an elcctrohydrodynamic (EHD) force generated by the interaction of the charged particles with an external electric circuit. Researchers have investigated application of EHD force for drag reduction behind the airfoils and fuselages at a high angle-of-attack. J. R. Roth, Phys. Plasmas 10, 2117 (2003); M. L. Post and T. C. Corke, AIAA J. 42, 2177 (2004); D. V. Gaintonde, M. R. Visbal and S. Roy, 36th AIAA Plasmadynamics and Lasers Conference, AIAA 2005-5302, Toronto, Canada. However, a weakness of traditional DBD actuators is the relatively small flow actuation effect. It has been shown to be quite effective only at low speeds (10-30 m/s). In an embodiment of the subject invention, microscale discharge is used to increase the higher EHD force density of a sheath region within the flow region. In an embodiment, lower power is required to produce the EHD force.

In an embodiment of the subject invention, a plasma discharge is generated at atmospheric pressures using a pair of electrodes positioned several microns apart. In an embodiment, such a gap lowers the breakdown voltage requirement (hence, lowers power consumption) to drive the discharge. Such microscale discharge can be used for many applications, including, but not limited to, $NO_x$ and $SO_x$ remediation, volatile organic compounds destruction, ozone generation, excimer formation as UV radiation sources, materials processing, and surface modification as plasma reactors, among other possible applications. K. H. Becker, K. H. Schoenbach, and J. G. Eden, J. Phys. D: Appl. Phys. 39, R55 (2006).

In an embodiment, the size of an actuator is dictated by the breakdown voltage of the working material. Electrical breakdown is the process by which a non-conducting material (e.g., dielectric) transforms into a conductor as a result of a sufficiently strong electric field. This transformation can occur when the applied voltage at least equals the breakdown voltage. Typically, the breakdown characteristic of an interelectrode gap is a function of the product of the gas pressure p and the gap length d based on Paschen's law. Studies have been reported in the literature documenting electrical breakdown voltage varying from 300 to 750 V in microscale gap (~10-$10^2$ μm). L. Baars-Hibbe, P. Sichler, C. Schrader, N. Lucas, K.-H, Gericke, and S. Buttgenbach, J. Phys. D: Appl. Phys. 38, 510 (2005); T. Ono, D. Y. Sim, and M. Esashi, J. Micromech. Microeng. 10, 445 (2000). Torres and Dhariwal and Germer showed that Paschen's law was not valid for gaps of less than 5 μm between electrodes. J. M. Torres and R. S. Dhariwal, Nanotechnology 10, 102 (1999); L. H. Germer, J. Appl. Phys. 30, 46 (1959). The deviation of Paschen's curve has been conjectured as a result of the quantum tunneling of electrons in which electrons may pass through a barrier without expending sufficient energy. In an embodiment, before breakdown, the current in the interelectrode gap is very low. However, once a breakdown voltage is applied to the electrodes, the electrical discharge can lead to current spikes.

Experimental challenges, such as reduced length scales, unsteady phenomena, and rapid collisional interaction in microgaps, make it difficult to predict the behavior of microscale actuators through experimentation. However, numerical simulation can be used to predict such behavior despite such experimental challenges.

Numerical investigations of microscale discharge have been documented in the published literature. Three basic models have been used to describe the evolution of charged particles in plasma discharges. The first one is the hydrodynamic model, which is the most popular. The second one is the kinetic model, which is the particle-in-cell/Monte Carlo collision (PIC/MCC) model. The third one is the hybrid kinetic-fluid simulation model, which is often used for modeling high-density plasma reactors. Kushner presented a two-dimensional plasma hydrodynamic model of microscale discharge devices operating at pressures of 450-1000 Torr and dimensions of 15-40 μm. M. J. Kushner, J. Appl. Phys. 95, 846 (2004). He found that such devices typically require more applied voltages to operate at lower pressures and because of this, they resemble discharges obeying Paschen's curve for breakdown. Boeuf et al. utilized a fluid-based model to explain the physical mechanisms occurring in microhollow cathode discharges. J. P. Boeuf, L. C. Pitchford, and K. H. Schoenbach, Appl. Phys. Lett. 86, 071501 (2005). Wang et al. simulated a microscale discharge in helium at atmospheric pressure based on the hydrodynamic model and found that it resembled a macroscopic low pressure dc glow discharge in many respects. Q. Wang, D. J. Economou, and V. M. Donnelly, J. Appl. Phys. 100, 023301 (2006).

A one-dimensional PIC-MCC model was developed by Choi et al. for current-driven atmospheric-pressure helium microscale discharge. J. Choi, F. Iza, J. K. Lee, and C. M. Ryu, IEEE Trans. Plasma Sci. 35, 5 (2007). The PIC-MCC simulation results were compared with the hydrodynamic model results. The results showed the sheath widths were comparable between the PIC-MCC and the hydrodynamic model simulation, and the peaks of the electron and ion densities were within the same orders of magnitude. However, the density profiles were significantly different. Radjenovic et al. utilized the PIC-MCC model and found the deviation from Paschen's law when the gap between electrodes was smaller than 5 μm. M. Radmilović-Radjenovi ić, J. K. Lee, F. Iza, and G. Y. Park, J. Phys. D: Appl. Phys. 38, 950 (2005). They conjectured that because the electron mean free path was of the order of a few micrometers at atmospheric pressure, the electrical breakdown was initiated by the secondary emission processes instead of a gas avalanche process at small inter-electrode spacing.

The third approach to simulate microscale plasma discharge is using the hybrid kinetic-fluid model. In this model the reaction rates are obtained by solving a basic Boltzmann equation, while the transport of electrons, ions, and neutrals is carried out via fluid models. Farouk at al. simulated a de argon microglow-discharge at atmospheric pressure for a pin-plate electrode configuration with interelectrode gap spacing of 200 μm together with an external circuit. T. Farouk, B. Farouk, D. Staack, A. Gutsol, and A. Fridman, Plasma Sources Sci. Technol. 15, 676 (2006). The temperature measurements, which were around 500 K, suggested the discharge as a nonthermal, nonequilibrium plasma. The measured and predicted temperatures were found to compare favorably.

A hydrodynamic plasma model can be used to simulate reasonable physics of a microscale discharge at relatively low computational cost. A two-dimensional microscale volume discharge for a working gas of atmospheric nitrogen can be simulated based on a self-consistent model of charged and neutral particles. Numerical results can then be compared with previously reported experimental data. An error analysis for such volume discharge can then be used to benchmark the accuracy of the microscale plasma model. Further, the same model can be implemented to simulate the plasma-gas interactions of a first generation plasma micropump.

A hydrodynamic plasma model can be utilized for multiscale plasma discharge simulation at atmospheric pressure, such as the model described in H. Kumar and S. Roy, Phys. Plasmas 12, 093508 (2005). The model can use an efficient finite element algorithm anchored in the multiscale ionized gas (MIG) flow code. The unsteady transport for electrons and ions can be derived from conservation laws in the form of a mass conservation equation. The species momentum can be modeled using the drift-diffusion approximation under isothermal condition that can be derived from the hydrodynamic equation. At atmospheric pressure, the drift-diffusion approximation can be reasonable and computationally efficient. The continuity equations for ion and electron number densities can be found by:

$$\frac{\partial n_\alpha}{\partial t} + \frac{\partial (n_\alpha V_{\alpha j})}{\partial x_j} = \beta |\Gamma_e| - r n_i n_e, \text{ for } \alpha = e, i, \text{ and } j - 1, 2, \tag{1}$$

where n is the number density, V is the species hydrodynamic velocity, r is the electron-ion recombination rate, subscript j is the flow direction of x and y, and subscript i and e are ion and electron, respectively. In an embodiment, the working gas is nitrogen at 760 Torr, but other fluids and pressures can be used. The value of r given by Kossyi et al. can be used, I. A. Kossyi, A. Y. Kostinsky, A. A. Matveyev, and V. P. Silakov, Plasma Sources Sci. Technol. 1, 207 (1992). The discharge can be maintained using a Townsend ionization scheme. The ionization rate can be expressed as a function of effective electron flux $|\Gamma_e|$ and Townsend coefficient β:

$$\beta = Ape^{-B/(|E|/p)}, |\Gamma_e| = \sqrt{(n_e V_e)_x^2 + (n_e V_e)_y^2}, \tag{2}$$

where A and B are pre-exponential and exponential constants, respectively, p is the gas pressure, and E is the electric field, i.e., $E = -\nabla\phi$. The ionic and electronic fluxes in Equation (1) can be written as:

$$n_i V_{ij} = n_i \mu_i (E + V_{ij} \times B_z) - D_i \frac{\partial n_i}{\partial x_j}, \tag{3}$$

$$n_e V_{ej} = n_e \mu_e (E + V_{ej} \times B_z) - D_e \frac{\partial n_e}{\partial x_j}, \tag{4}$$

where the Lorentz force term, V×B, brings in the effect of the magnetic field. The magnetic field effect can be neglected for some simulations. After some algebraic manipulations, the following equations can be derived:

$$\frac{\partial n_i}{\partial t} + \frac{\partial}{\partial x_j}\left\{ n_i \mu_i E_{x_i} - D_i \frac{\partial n_i}{\partial x_j} \right\} = \beta |\Gamma_e| - r n_i n_e, \tag{5}$$

$$\frac{\partial n_e}{\partial t} + \frac{\partial}{\partial x_j}\left\{ -n_e \mu_e E_{x_i} - D_e \frac{\partial n_e}{\partial x_i} \right\} = \beta |\Gamma_e| - r n_i n_e, \tag{6}$$

where μ is the mobility and $D_e$ is the electron diffusion calculated from the Einstein relation, which is a function of the mobility $\mu_e$, Boltzmann's constant $k_B$, and the electron temperature, i.e., $De = \mu_e k_B T_e / e$. The ion mobility $\mu_i$ is expressed as a function of a reduced field (E/p).

The relation between electric field and charge separation can be found by the Poisson equation:

$$\nabla\cdot(\in E)=q, \tag{7}$$

where $\in$ is the dielectric constant, the net space charge $q=e(n_i-n_e)$, and e is the elementary charge.

The system of Equations (5)-(7) can be normalized using the following normalization scheme: $\tau=t/t_0$, $z_j=x_j/d$, $N_e=n_e/n_0$, $N_i=n_i/n_0$, $u_{ej}/V_{ej}/V_B$, $u_{ij}=V_{ij}/V_B$, and $\phi=e\phi/k_BT_e$ where $V_B$ is the Bohm velocity, $V_B=\sqrt{k_BT_e/m_i}$, reference length d, which is usually a domain characteristic length in the geometry, the reference time $t_0=10^{-9}$ s, and reference density $n_0=10^{17}$ $m^{-3}$ for weakly ionized gas.

In microscale flows, Knudsen number (Kn) can be an important dimensionless parameter that determines the validity of continuum model for different regimes of fluid flow. S. Roy, R. Raju, H. F. Chuang, B. A. Cruden, and M. Meyyappan, J. Appl. Phys. 93, 8 (2003). The Kn is defined as the ratio of the fluid mean free path $\lambda$ and macroscopic characteristic length A, i.e., $Kn=\lambda/\Lambda$. As Kn increases up to $10^{-3}$, the no-slip boundary condition no longer applies. For the flow problem in microscale pump, the Kn is $2.6\times10^{-4}$ assuring continuum flow with no-slip wall boundary condition. For a globally incompressible nitrogen gas (Mach number less than 0.3), the continuity and momentum equations can be written as:

$$\frac{\partial V_{fj}}{\partial x_j}=0, \tag{8}$$

$$\frac{\partial V_{fj}}{\partial t}+V_{fj}\frac{\partial V_{fj}}{\partial x_j}=\frac{qE_j}{\rho}-\frac{1}{\rho}\frac{\partial p}{\rho\partial x_j}+\frac{\mu}{\rho}\frac{\partial^2 V_{fj}}{\partial x_1^2}, \tag{9}$$

where subscript f denotes the working fluid with bulk density $\rho$ and bulk viscosity $\mu$, and qEj is the electrodynamic body force calculated from solving the plasma Equations (5)-(7).

The finite element method (FEM) can be used for solving partial differential equations (PDE). The FEM is based on the Galerkin Weak Statement (GWS) and approximates the solution of the PDE. In the FEM, the global domain can be divided in several elements, and the solution in each element can be constructed from the basis function. The FEM has several advantages, such as the ease to implement the method with complicated Neumann (flux) or Robin (convection) boundary conditions. One principle of the FEM is the construction of a solution approximation. A real world problem distributed over a domain $x_j$ can be approximated as a Taylor series of known coefficients $a_i$ and functions $\psi_i(x_j)$:

$$L(v)=\sum_i a_i\psi_i(x_j) \tag{10}$$

The plasma governing Equations (5)-(7) or fluid Equations (8) and (9) can be written generally as L(v)=0 where v is the vector containing $N_i$, $N_e$, and $\phi$ or $V_j$ and p. The GWS approach requires that the measure of the approximation error should vanish in an overall integrated sense. A. J. Baker and D. W. Pepper, Finite Element 1-2-3 McGraw Hill, Columbus, (1991); G. F. Carey and J. T. Oden, Finite Elements: A Second Course Prentice Hall, Englewood Cliffs, (1981), Vol. 2. This gives a mathematical expression for the minimization of the weighted residual over the domain:

$$GWS=\int_\Omega wL(v)d\Omega=0 \tag{11}$$

where $\Omega$ is the domain and w is the weighted basis function chosen to be a Strum-Louville function for orthogonality.

The MIG flow code can be modular and anchored in the FEM. It can be developed and verified with one-, two-, and three-dimensional problems, including fluid dynamics and heat transfer related problems, micro/nanoscale flow, specifically to modeling dc/rf induced DBDs, and designing electromagnetic propulsion thrusters. Computed solutions can show details of the distribution of charged and neutral particles and their effects on the flow dynamics for the various applications.

The MIG flow code can employ the Newton-Raphson scheme for dealing with nonlinear terms. To solve the global sparse matrix, an iterative sparse matrix solver called generalized minimal residual can be applied. The Newton-Raphson iteration for nonlinear solver can be considered converged at any given time step when the $L^2$ norms of all the normalized solution variables and residuals are below a chosen convergence criterion of $10^{-5}$.

Simulated Embodiments

The behavior of some particular embodiments of the subject invention has been simulated as discussed below; however, the invention is not limited to the simulated embodiments. As discussed herein, other embodiments can be made, used, or sold according to the subject invention.

A. DC Volume Discharge

Figure 7:
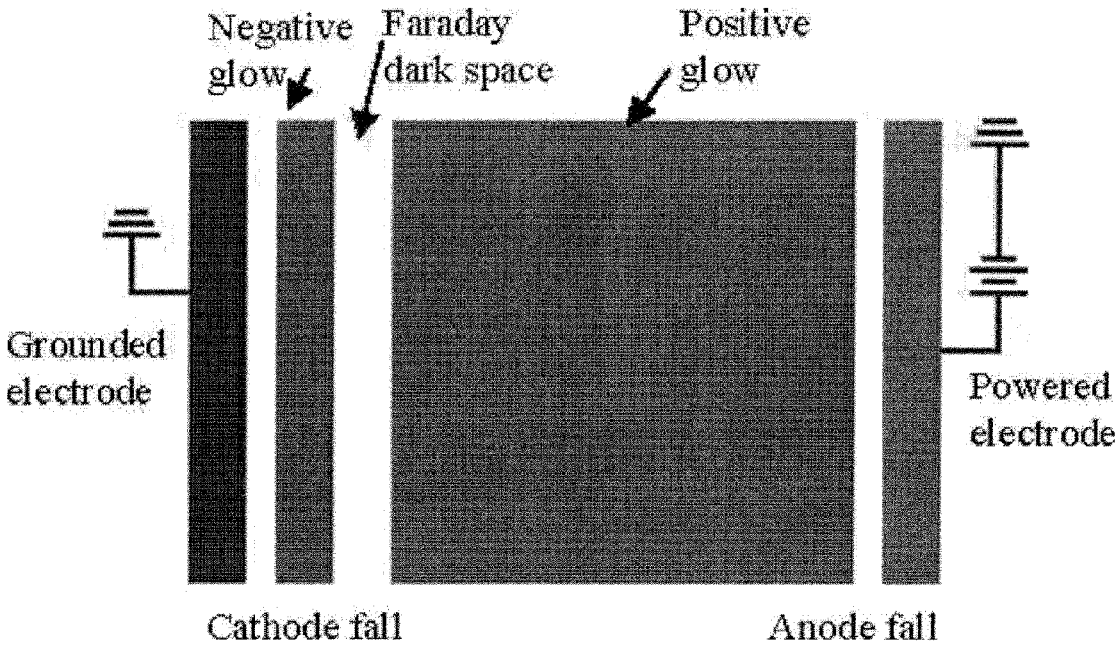
FIG. 7 shows a schematic representation of various glows with dc discharge in accordance with an embodiment of the subject invention.

In an embodiment of the subject invention, a direct current (dc) volume discharge forms plasma, sustained by a dc through an ionized medium as shown in FIG. 7. A high voltage difference between electrodes can result in the electrical breakdown of the gas. These discharges can be characterized by continuous steady currents. In an embodiment, the discharges are mostly sustained by secondary emissions.

Figure 8A:
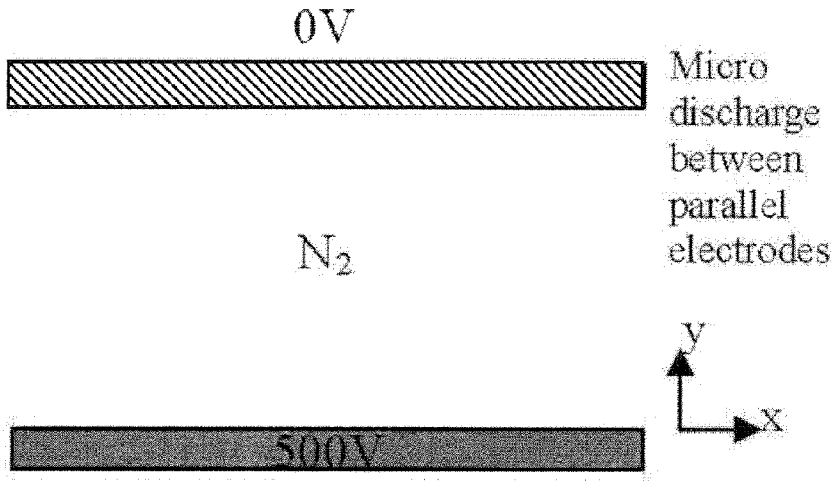
FIGS. 8A-8B show a schematic of two-dimensional microscale volume discharge with nitrogen gas, and computational mesh with 3111 nodes and 750 elements, respectively, in accordance with an embodiment of the subject invention.
Figure 8B:
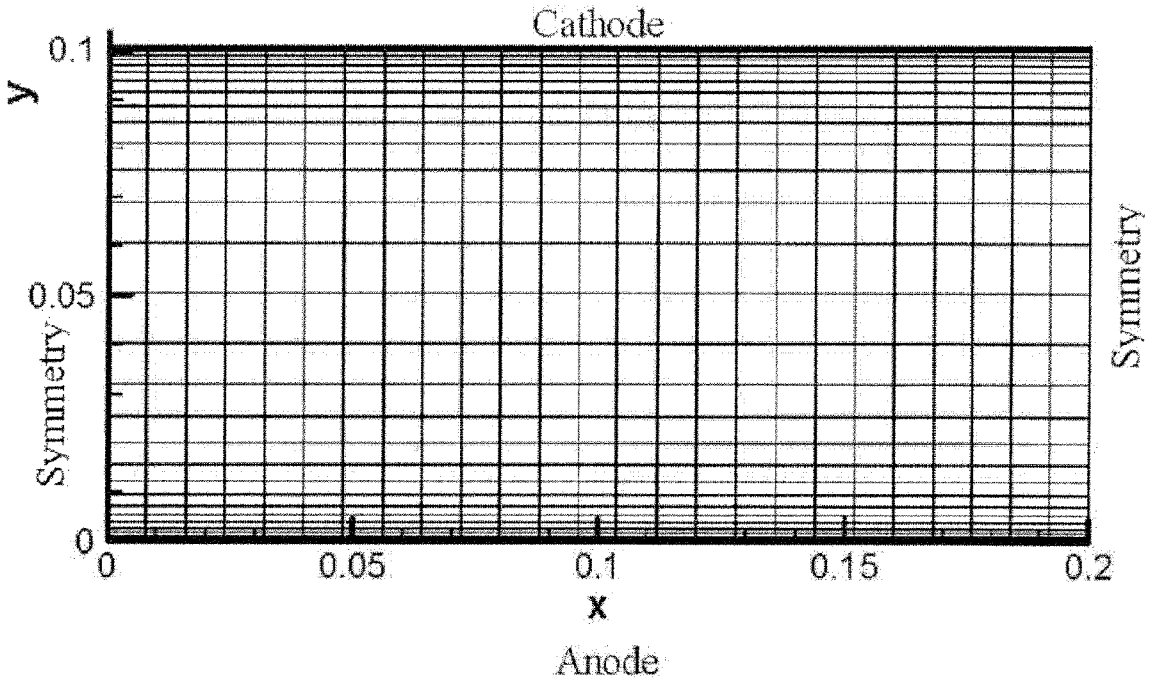

In an embodiment, a two-dimensional dc volume discharge can be produced using parallel electrode plates. The distance between the plates (interelectrode distance or gap) and pressure can be varied as previously discussed. Gaps varied from 200 to 5 μm at atmospheric pressure were simulated using the method described above. The working gas was nitrogen ($N_2$), and the discharge was driven by a voltage of 500 V as shown in FIG. 8A. A computational mesh consisting of 25×30 biased biquadratic (nine-node) quadrilateral elements was used with the first node 0.1 μm away from the wall as shown in FIG. 8B. The thickness of the electrodes at the top and bottom surface was neglected. An electrode potential of 500 V was applied through an external circuit. In the computational mesh shown in FIG. 8B, the anode is at y=0, while the cathode is at y=0.1. A vanishing ion density was imposed at the anode, while the electron density at the cathode was calculated from the flux balance using a secondary-emission coefficient of 0.1. The left and right boundaries of the computational domain were maintained at symmetry conditions. Initial distributions of electrons and ions were based on the dc sheath solution. S. Roy and D. Gaitonde, J. Appl. Phys. 96, 2476 (2004). A uniform time step of $10^{-12}$ s was used for the time integration. The results of the simulation are described below with reference to FIGS. 11-14. Wang and Roy, J. Appl. Phys. 106, 013310 (2009).

B. Plasma Micropump

Figure 9:
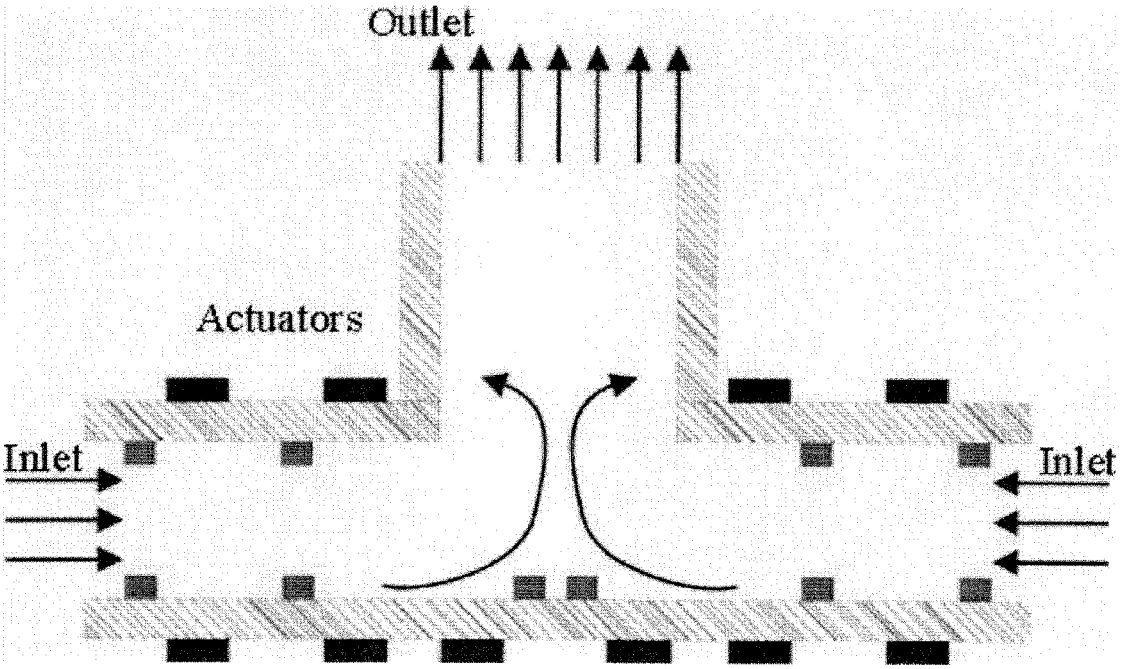
FIG. 9 shows a schematic of a microplasma pump in accordance with an embodiment of the subject invention.
Figure 10A:
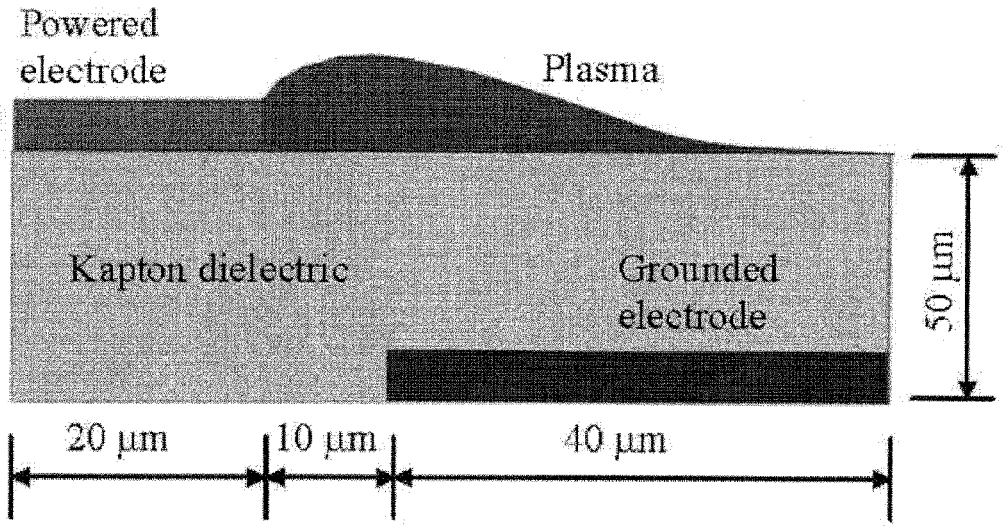
FIG. 10A-10B show schematics of microscale plasma actuator, and computational mesh with 13635 nodes and 3350 elements, respectively, in accordance with an embodiment of the subject invention.
Figure 10B:
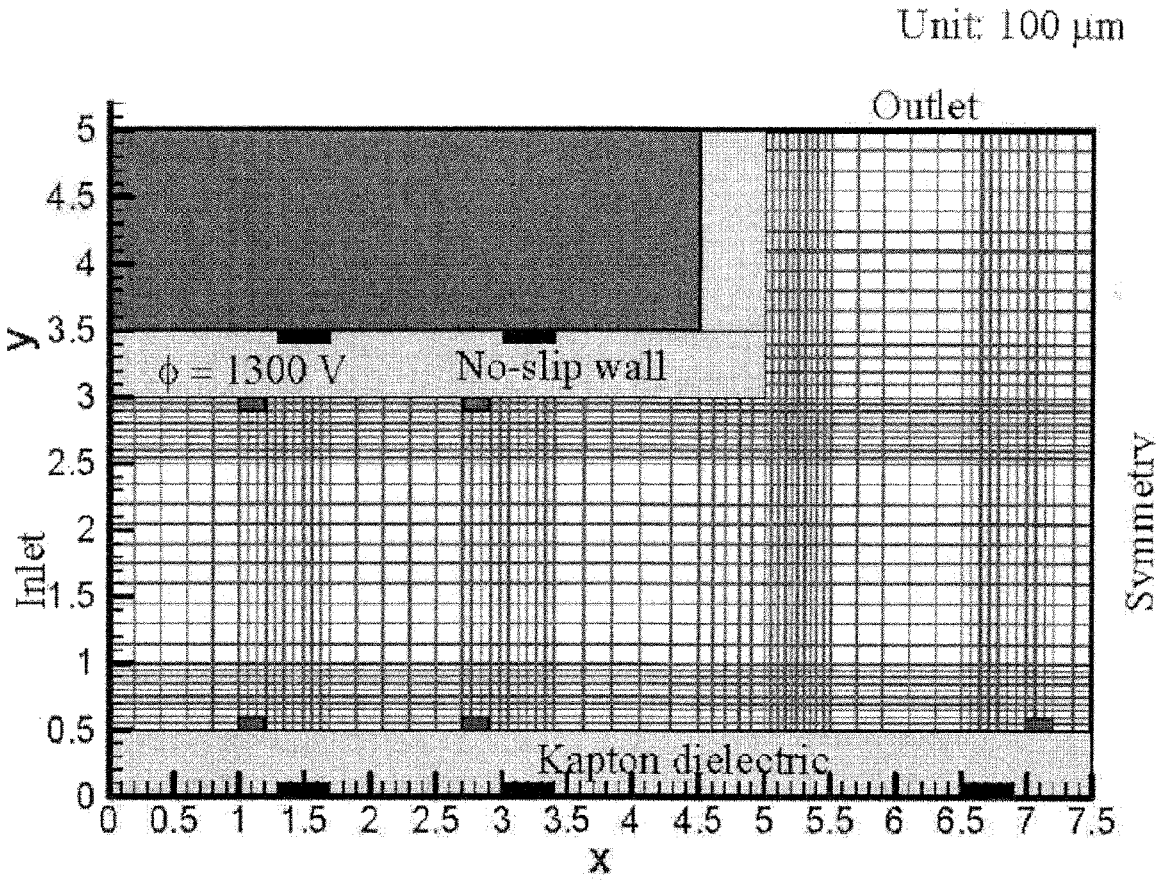

In an embodiment of the subject invention, a plasma micropump is provided. A cross-section of an embodiment of a plasma micropump is shown in FIG. 9. As described below with reference to FIGS. 17-46, various other actuator configurations can be used with the subject invention. The embodiment shown in FIG. 9 includes four pairs of DBD actuators at both of the pump inlets and two pairs of DBD actuators at the center of the pump. In the simulated embodiment, the pump inlet openings were 250 μm at both sides and the single outlet opening is 500 μm at the top. FIG. 10A shows the configuration of a single DBD actuator that can be used in the pump. Wang and Roy, J. Appl. Phys. 106, 013310 (2009). In the simulated embodiment, the powered electrode was 20 μm wide, while the grounded electrode was 40 μm wide. The gap between electrodes was 10 μm at streamwise direction and 50 μm in vertical direction. Other dimensions are useable with the subject invention as discussed above FIG. 10B shows the two-dimensional computational mesh used for simulation of the pump with a Kapton polyimide insulator, i.e., dielectric constant $\in_d$=4.5 $\in_0$, where $\in_0$ is permittivity of vacuum. Wang and Roy, J. Appl. Phys. 106, 013310 (2009). As shown, only half of the pump was simulated due to its symmetric configuration. The computational mesh consisted of 67×50 elements and 13,635 nodes. The boundary condition of potential ϕ was equal to 1300 (at y=0 and 3.5). For the flow simulation, gauge pressure was equal to zero at the inlet and the outlet. The right boundary was maintained as symmetry, and based on low Kn ($<10^{-3}$) all the dielectric surfaces were maintained at zero wall velocity. The results of the simulation are described below with reference to FIGS. 15-16. Wang and Roy, J. Appl. Phys. 106, 013310 (2009).

Simulation Results

A. DC Volume Discharge

Figure 13:
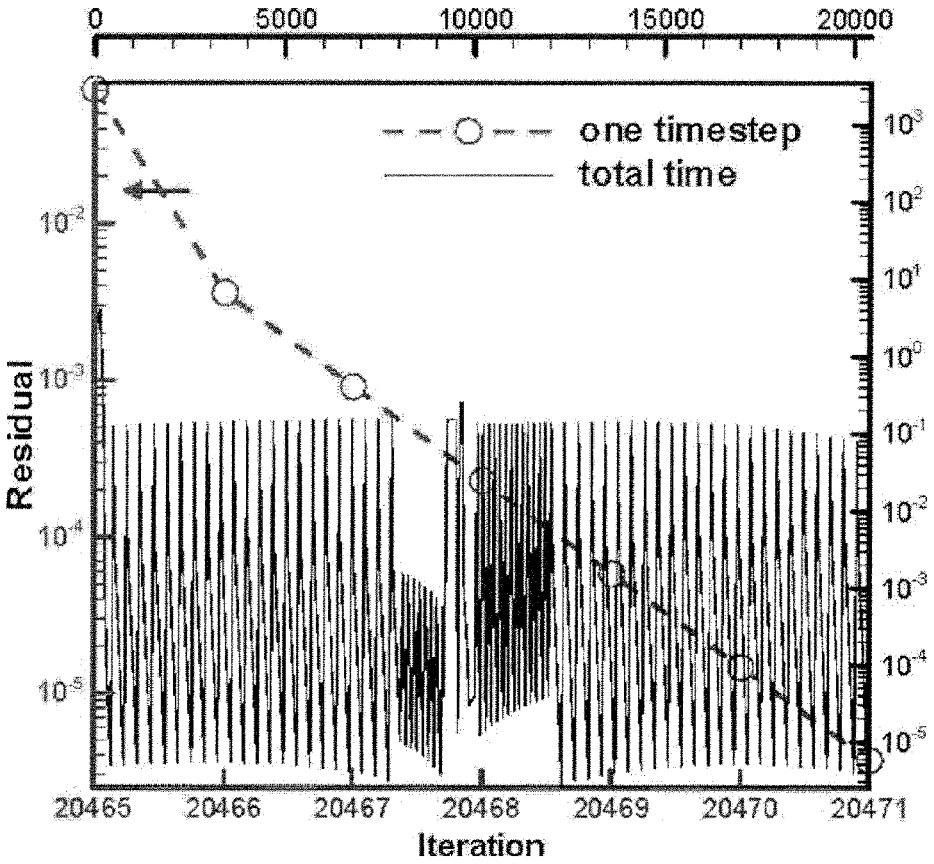
FIG. 13 shows a convergence for one time step (iteration from 20 465 to 20 471) and total time steps (iteration from 0 to 20 471) in accordance with an embodiment of the subject invention.
Figure 14:
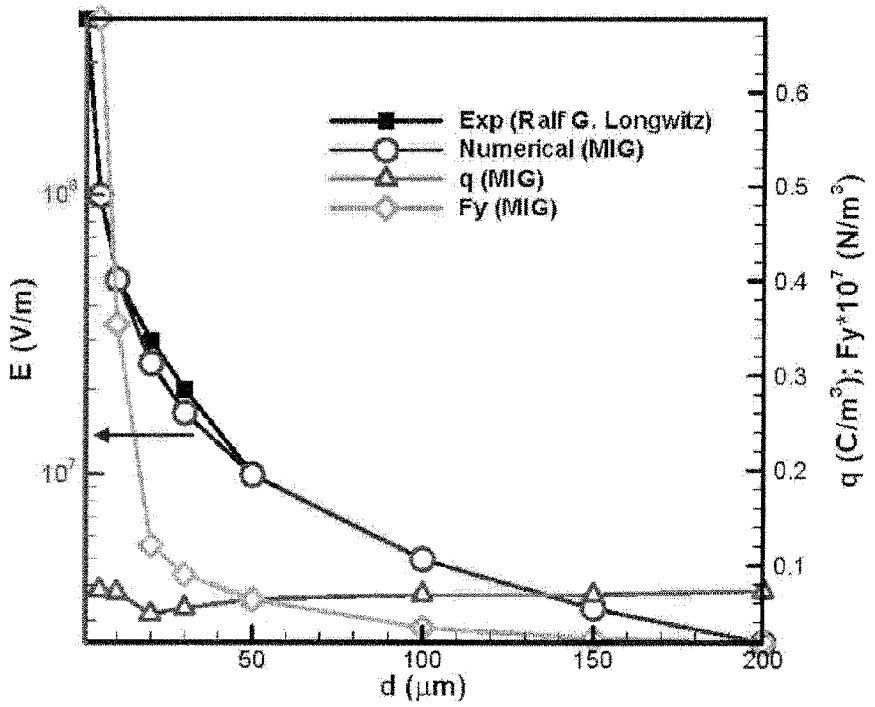
FIG. 14 shows a comparison of numerical results and experimental data for electric field strength from d=5 to 50 μm, where the charge density (q) and the electric force ($F_y$) are calculated from numerical results in accordance with an embodiment of the subject invention.

The simulation results for ion and electron densities along y-direction (distance from anode to cathode) with various gaps from d=200 to 10 μm at atmospheric pressure (760 Torr) are presented in FIG. 11. The variables for y, $N_e$, and $N_i$ were normalized using the following normalization scheme: y=d/pl, $N_e=n_e/n_0$, and $N_i=n_i/n_0$ where reference length pl varied from 2000 to 100 μm, and reference density $n_0=10^{17}$ $m^{-3}$. As shown, with decreasing gap d, the sheath became more dominant to the plasma region. The location of the sheath was roughly at the bifurcation of ion and electron densities. The sheath thickness was a few Debye lengths based on the pressure, and Debye shielding confined the potential variation shown in FIG. 12. In embodiments of the subjection invention, the function of a sheath is to form a potential barrier so that more electrons are repelled electrostatically. The potential lines are bent toward the cathode due to a very low density of electrons. This high potential can drive electrons away from the cathode and form a cathode sheath thickness. According to the order of accuracy of Newton-Raphson scheme for the nonlinear system of equations, the ideal convergence was quadratic convergence. However, FIG. 13 shows the convergence was between linear and quadratic because of linearization of the Jacobian matrix for numerical efficiency. The convergence was below $10^{-5}$ for every time step. FIG. 14 shows the simulated electric field data with the published experimental data of Longwitz. R. G. Longwitz, "Study of gas ionization in a glow discharge and development of a microgas ionizer for gas detection and analysis," Ph. D. thesis, Institute of Microsystems and Microelectronics, Swiss Federal Institute of Technology, Lausanne, Switzerland, (2004). As shown, there is very good agreement for interelectrode gaps from 50 to 5 μm. The computed charge density q slightly decreased as the gap d decreased, but it increased at the gap below 10 μm because much less electrons exist in the plasma region. Based on the calculation of the electric force (qE), the force $F_y$ is 1 $MN/m^3$ at 20 μm gap. Note that such force density is three orders of magnitude higher than that of macroplasma actuators. As the gap decreases the force increases sharply. For example, at 5 μm gap the force density increases approximately sevenfold to 6.8 $MN/m^3$.

B. Plasma Micropump

Figure 15A:
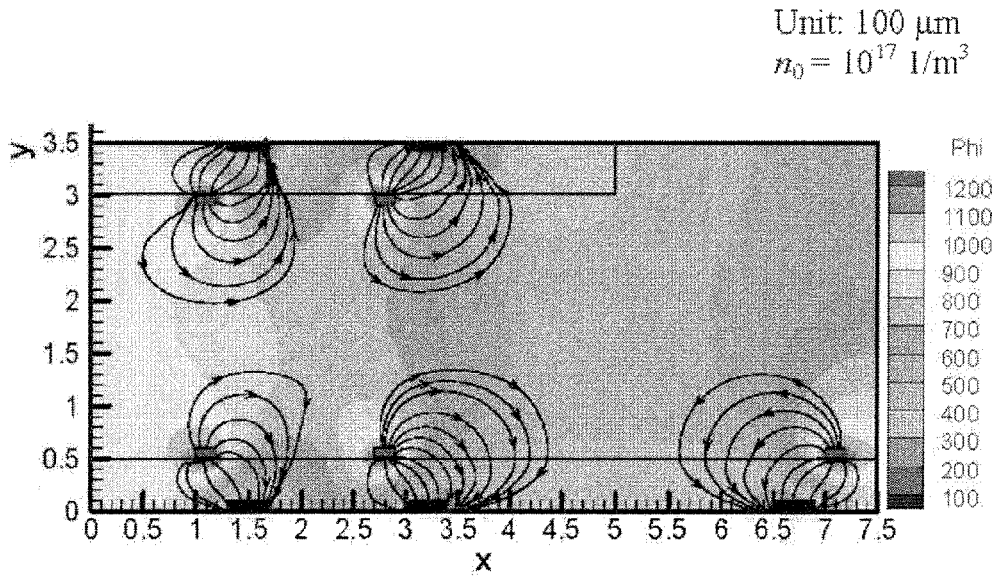
FIGS. 15A-15C show a potential (ϕ) distribution with electric potential lines, a ion number density ($N_i$) contour, and an electron number density ($N_e$) contour, respectively, in accordance with an embodiment of the subject invention.
Figure 15B:
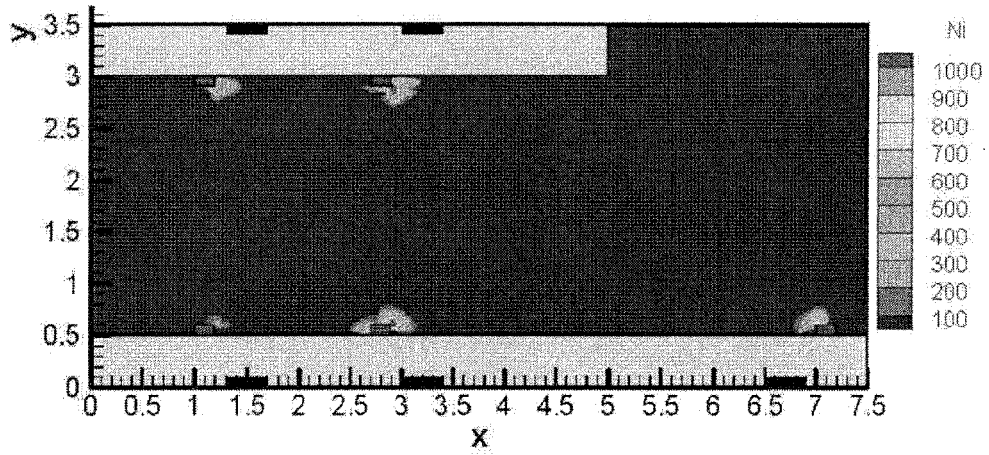
Figure 15C:
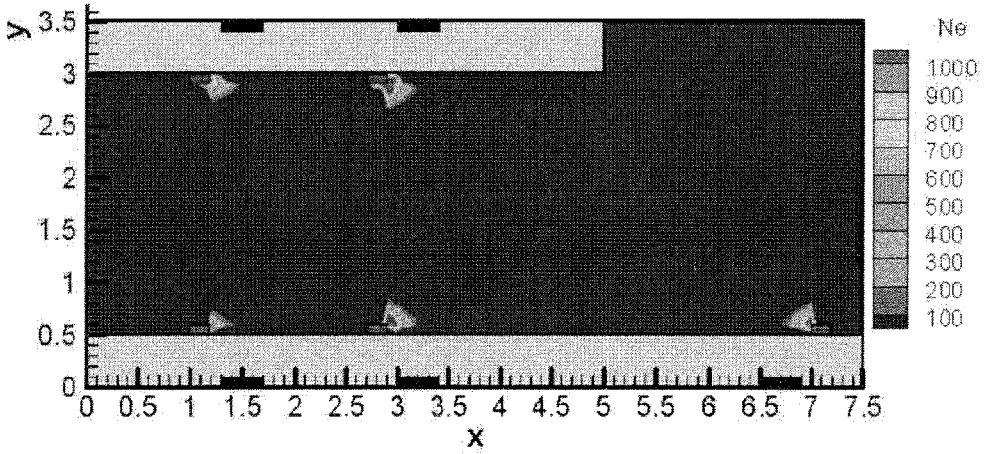

FIGS. 15A, 15B, and 15C show the contour of potential (ϕ), ion number density ($N_i$), and electron number density ($N_e$) respectively from the plasma micropump simulation described above. FIG. 15A is based on an applied potential of 1300 V on the powered electrode (red). The electric field lines are acting from the powered electrode to the grounded electrode. Due to a large difference of potential between electrodes, the fluid is ionized at local regions as shown in FIGS. 15B and 15C. The net charge densities are concentrated inside the boundary layer near the wall, and almost zero away from the wall. The charge densities depositing on the dielectric surface cause a net electric force in the direction from the powered electrode to the grounded electrode. Therefore, outside the plasma region, flow is mainly driven by viscous force.

Figure 16A:
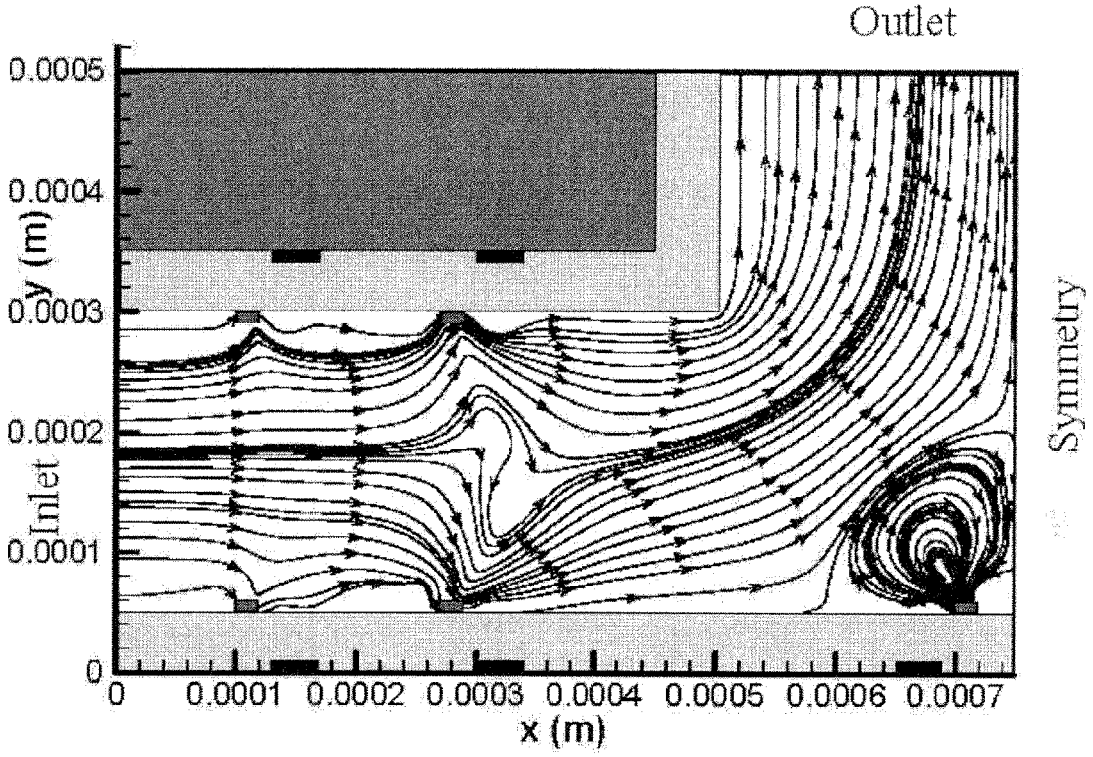
FIGS. 16A-16B show the velocity stream traces inside the microplasma pump and a V velocity component distribution normal to the outlet, respectively, in accordance with an embodiment of the subject invention.
Figure 16B:
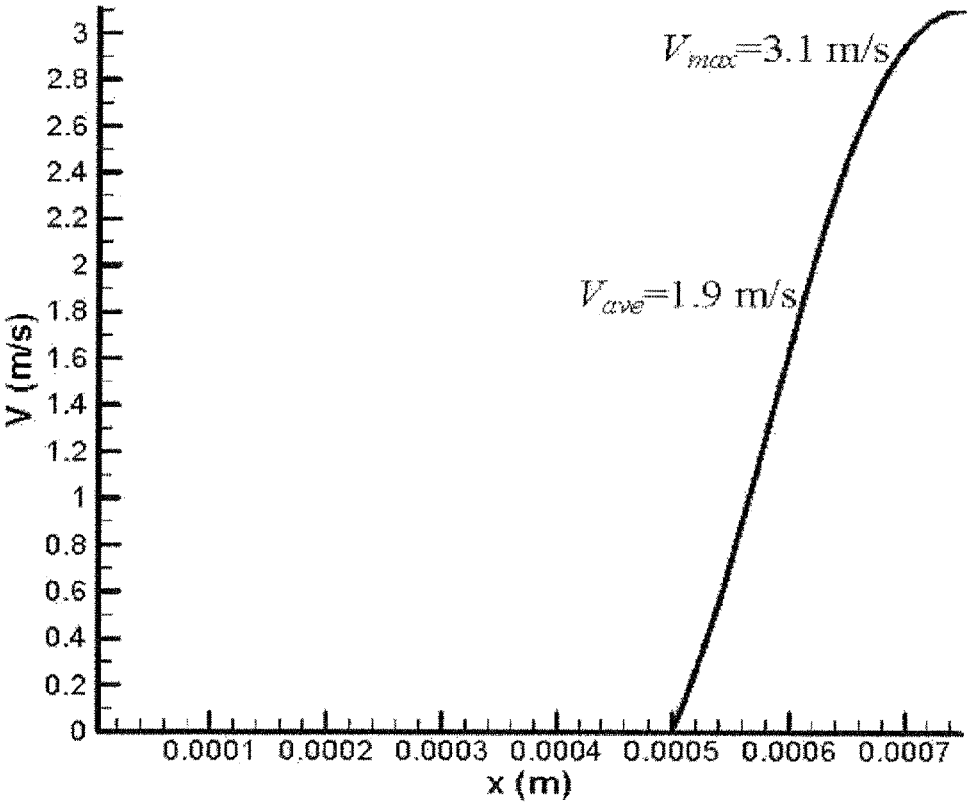

An advantage of a plasma micropump in accordance with an embodiment of the subject invention is to push the flow continuously without intermittent pulsing. In an embodiment, the micropump avoids wear on moving parts because there are no moving parts positioned inside the micropump. FIG. 16A shows simulated flow behavior inside the plasma micropump. As shown, the plasma drives the fluid into the pump at the inlet due to the net near-wall jet created by DBD actuators. FIG. 16A also shows one of the DBD actuators at the right (symmetry) boundary of the model. In an embodiment, this actuator is used for altering the fluid flow direction from horizontal to vertical and pushes the fluid up toward the outlet. In the embodiment shown, the actuator also creates a strong vertical structure inside the pump that can influence the mass flow rate of the plasma micropump due to the energy loss. FIG. 16B shows the simulated V velocity distribution along x-direction normal to the outlet. As shown, the V velocity increases sharply from the wall (at x=0.0005 m) and becomes flat at $V_{max}$=3.1 m/s at the middle of the pump (at x=0.000 75 m). Despite three orders of magnitude higher thrust density, the net inducement of the air flow in these microactuators is similar to that of a standard macroscale plasma actuator. This is because the area in which these microactuators are in contact with air is also orders of magnitude smaller than macroscale actuators. Based on the operating voltage of 1300 V and the properties of nitrogen as the working gas, simple calculation can deduce a maximum flow rate for the micropump of $Q_{max}$=46.5 ml/min. Such flow rate can be useful for the application of biological sterilization and decontamination, micropropulsions, and cooling of microelectronic devices, among other applications. D. J. Laser and J. G. Santiago, J. Micromech. Microeng. 14, R35 (2004).

In an embodiment of the subject invention, one or more plasma actuators generate a sheath region within a flow region. In an embodiment, the sheath region has a high electric field relative to the remainder of the flow region. In an embodiment, the number density of ions in the sheath region is significantly greater than the number density of electrons in the sheath region. In an embodiment, the number density of ions is about eight times greater than the number density of electrons in the sheath region. In an embodiment, at least two distinct regions are generated in the flow region: a quasi-neutral plasma region where $N_i \approx N_e$; and a sheath region where $N_i >> N_e$. In an embodiment, the sheath region is a layer of sheath. In an embodiment, the layer of sheath is attached to the cathode. In an embodiment, the sheath region is of several Debye lengths. In an embodiment, the electron density in the sheath region is close to zero and an electric field arises out of this charge separation. In an embodiment, approaching the sheath edge there is an abrupt drop in the charge difference within a small spatial extent. In an embodiment, this region of presheath where separation in ion and electron density curves begins and where electron density is much less than ion density. In an embodiment, by decreasing the interelectrode gap d, the sheath becomes more dominant to the plasma region. In an embodiment, a plasma micropump is provided using one or more microscale plasma actuators as described above. In an embodiment, the plasma micropump produces an air flow rate of around 46.5 ml/min. As discussed herein, such a plasma micropump can be used in a wide range of applications from microbiology to space exploration and cooling of microelectronic devices, among other applications.

In an embodiment of the subject invention, an electrohydrodynamic (EHD) body force is used to effect the flow of a fluid through a micro channel, expansion slot, or other flow region. In an embodiment, a plurality of electrodes are arranged and powered to create a plasma discharge, which can impart an EHD body force to a fluid. Various configurations of electrodes can be used to control the flow of the fluid into, out of, or through the flow region. In an embodiment, a surface discharge can be produced by arranging and powering electrodes on one surface of a flow region. In an embodiment, a volumetric discharge can be produced by arranging and powering electrodes across the flow region. In an embodiment when one or more electrodes of the plurality of electrodes are powered, a sheath region is generated in the flow region, wherein the sheath region has a high electric field relative to the remainder of the flow region. In an embodiment, the number density of ions in the sheath region is significantly greater than the number density of electrons in the sheath region. In an embodiment, at least one pair of electrodes of the plurality of electrodes is separated by an interelectrode distance of less than 20 microns. In an embodiment, the interelectrode distance is about 1 microns. In an embodiment, the interelectrode distance is in the direction of fluid flow.

In an embodiment of the subject invention, an expansion slot or micro channel can be formed with electrodes arranged therein. A small plasma discharge can be generated in the vicinity of an exposed (powered) electrode to induce an electrohydrodynamic (EHD) body force, which can induce flow of a fluid in a particular direction. The electrodes can be arranged in the expansion slot or micro channel as electrode pairs. One embodiment can incorporate electrode pairs on the same surface and maintained at a potential bias using steady, pulsed direct, or alternating current. Another embodiment can incorporate electrode pairs separated by an insulative material where one electrode of the pair is powered with dc or ac operating at a radio frequency with respect to the other. In an embodiment, one electrode of the pair is powered at RF voltages, while the other electrode of the pair is grounded. In another arrangement, both electrodes are powered with signals separated by a beat frequency. In an embodiment when an electrode pair is powered, a sheath region is generated in the expansion slot or micro channel, wherein the sheath region has a high electric field relative to the remainder of the expansion slot or micro channel. In an embodiment, the number density of ions in the sheath region is significantly greater than the number density of electrons in the sheath region. In an embodiment, the pair of electrodes is separated by an interelectrode distance of less than 20 microns. In an embodiment, the interelectrode distance is about 1 microns. In an embodiment, the interelectrode distance is in the direction of fluid flow.

In another embodiment, electrodes are arranged and powered such that an EHD body force is produced that induces flow of a fluid into or out of an expansion slot, micro channel, or other flow region. In another embodiment, electrodes are arranged and powered such that an EHD body force is produced that induces flow of a fluid through a flow region. In an embodiment, such electrodes are arranged near the exit-plane of the flow region in order to induce flow toward one or more exits. In an embodiment, the use of EHD body forces can reduce, or substantially eliminate, shear forces on the surface of a micro channel, expansion slot, or other flow region, resulting in a smooth flow of the fluid and increased flow.

In an embodiment, some electrodes can be fully or partially submerged or embed in an insulative material, such as a dielectric. In an embodiment, some electrodes can be coated with a material having insulating properties, such as a dielectric material. In an embodiment, some electrodes can be exposed to the fluid.

In an embodiment, voltages are applied to different electrodes at different times in order to control the flow of fluid through the flow region. In an embodiment, a controller is provided that controls the timing of voltage application to the electrodes. In an embodiment, the controller is controlled according to a computer program stored on one or more computer-readable media.

In an embodiment, the flow region can have various configurations. In an embodiment, the flow region comprises one or more micro channels or expansion slots. Such conduits can have various cross-sections as further described below. In an embodiment, a channel or slot is formed having internal structures formed therein to further control flow through the conduit. In an embodiment, micro channels or expansion slots are formed having a uniform cross-section along their length. In another embodiment, such conduits can narrow or expand at one or both ends. In an embodiment, protrusions can be formed at the entrance, exit, or within such conduits to further direct the flow of a fluid into, out of, a through the conduit.

In an embodiment, a propulsion system is provided having a plenum chamber. In an embodiment, a thruster chip is incorporated into an exit-plane of the plenum chamber. In an embodiment, such a chip is incorporated into another portion of the propulsion system. In an embodiment, the thruster chip is a microelectromechanical systems (MEMS) device. In an embodiment, one or more expansion slots are formed in the chip. In an embodiment, one of the one or more expansion slots has a plurality of electrodes arranged on at least one side of the expansion slot such that when the electrodes are selectively powered greater fluid flow is induced through the expansion slot by means of EHD body forces. In an embodiment, such electrodes are arranged and selectively powered in order to control fluid flow through the propulsion system.

In an embodiment, electrodes are arranged to produce a discharge at an entrance of a micro channel, expansion slot, or other flow region, to draw fluid into the flow region. For example, by arranging electrodes on either side of an entrance to an expansion slot counter-rotating vortices can be produced that draw fluid into the slot. The same or different principles can be applied at an exit to the slot to draw fluid out of the slot.

In an embodiment, a plurality of electrodes is arranged and selectively powered to induce fluid flow through a micro channel, expansion slot, or other flow region. In an embodiment, a pair of electrodes, among the plurality, is arranged along a surface of the flow region. Power can be applied to one or both electrodes to produce a surface dielectric barrier discharge (DBD). The DBD can in turn produce an EHD body force that induces flow in the fluid. In an embodiment, the EHD body force is produced by powering an exposed electrode at RF voltages, while an embedded electrode is grounded. In another arrangement, both electrodes are powered with signals separated by a beat frequency.

In an embodiment, a pair of electrodes, among the plurality, is positioned across a portion of the flow region from each other, such that the flow region is intersected by a straight line drawn between a point on one of the pair of electrodes and a point one the other of the pair of electrodes. Power can be applied to one or both electrodes to produce a volumetric plasma discharge. The discharge can produce an EHD body force that induces flow in the fluid. In an embodiment, the pair of electrodes is arranged on different surfaces forming the flow region. In an embodiment, the pair of electrodes is arranged on a curved or angled surface, such as a cylindrical surface. In an embodiment, one electrode of the pair is powered, while the other electrode of the pair is grounded. In another arrangement, both electrodes are powered at different voltages.

In an embodiment, pairs of electrodes, among the plurality, are powered in parallel (i.e., at the same time) to generate multiple plasma discharges within the flow region at the same time. In an embodiment, pairs of electrodes, among the plurality, are powered in series to generate sequential plasma discharges within the flow region. In an embodiment, a particular electrode, among the plurality, can be paired with a first electrode, among the plurality, to generate a first plasma discharge. Later, the particular electrode can be paired with a second electrode, among the plurality, to generate a second plasma discharge. Various configurations of electrodes can be used with the subject invention. Illustrative examples are provided below.

A specific embodiment can incorporate a power source; a first electrode in contact with a first dielectric layer and connected to the power source; a second electrode in contact with a second dielectric layer and connected to the power source; and a ground electrode. The power source drives the first electrode with a first ac voltage pattern with respect to the ground electrode and drives the second electrode with a second ac voltage pattern with respect to the ground electrode such that application of the first voltage pattern produces a first plasma discharge in a flow region, and a first electric field pattern in the flow region, and application of the second voltage pattern produces a second plasma discharge in the flow region and a second electric field pattern in the flow region. The first and second electrodes are offset along the direction of flow in the flow region and the first voltage pattern and the second voltage pattern have a phase difference such that the first and second electric fields drive flow in the flow region in different portions of the flow region at different times. In an embodiment, the distance between the first electrode and the ground electrode is less than 20 microns. In an embodiment, the first interelectrode distance is about 1 microns. In an embodiment, the distance between the second electrode and the ground electrode is less than 20 microns. In an embodiment, the second interelectrode distance is about 1 microns.

In an embodiment, the first dielectric and the second dielectric layer are arranged in a stacked configuration, such that the first dielectric layer contacts the second dielectric layer. The first electrode can be positioned near the flow region. The first dielectric can be positioned between the flow region and the second electrode such that both electrodes are positioned in the same direction from the flow region. Alternatively, the flow region, or at least a portion of the flow region can be positioned between the first and second electrodes. The first dielectric insulator layer and the second dielectric insulator layer have different dielectric strengths or can have the same dielectric strengths. The first electrode is offset from the second electrode in a direction parallel to a direction of flow in the flow region and one or more additional electrodes can be offset from the first and second electrodes and provide corresponding one or more additional electric fields to promote flow in the flow region.

Figure 17:
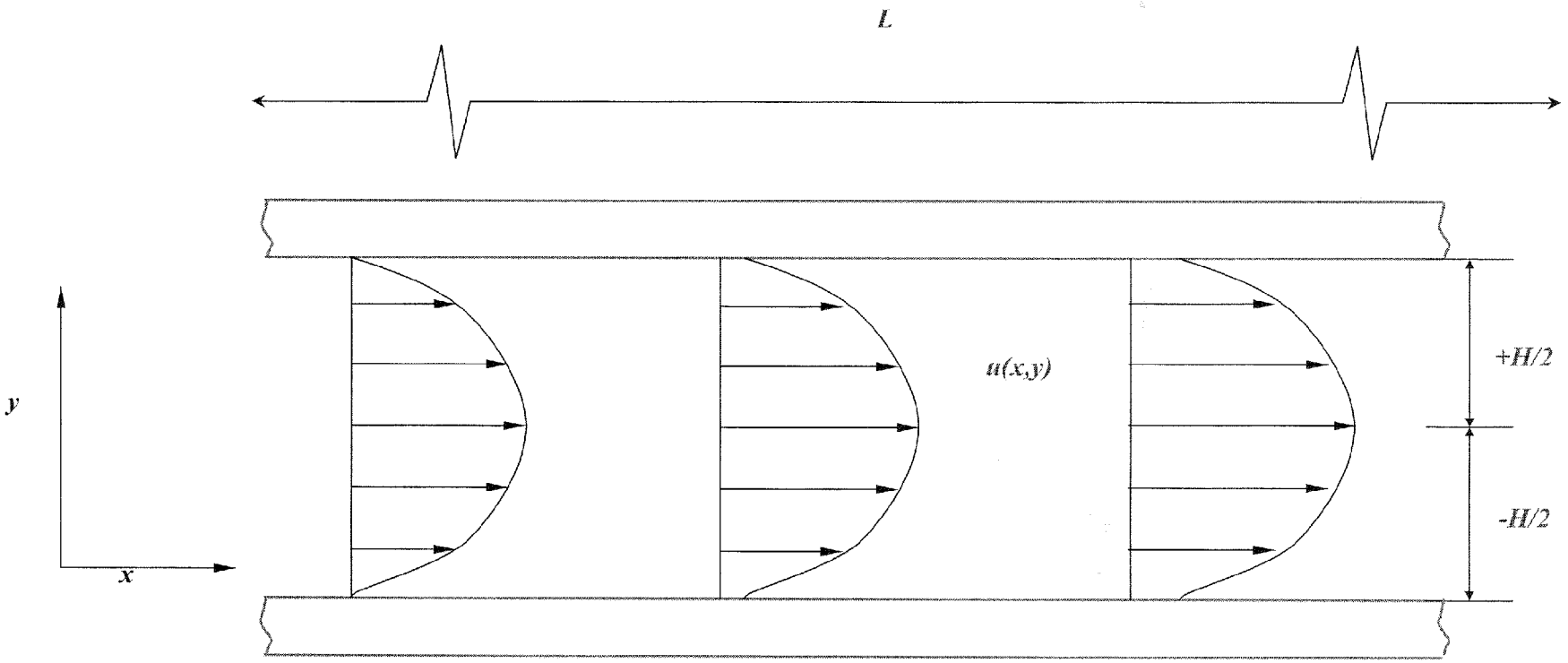
FIG. 17 shows fluid flow inside a micro channel in accordance with an embodiment of the subject invention.

FIG. 17 shows fluid flow inside a micro channel in accordance with an embodiment of the subject invention. As shown, the micro channel has a channel height H and a length L. In an embodiment, the micro channel also has width W in a dimension perpendicular to the x and y axis shown. As discussed below in relation to FIGS. 40 and 41, the micro channel can have various configurations and cross-sections. In an embodiment, the micro channel is composed of two parallel plates of length L and width W separated by a distance H. In the embodiment shown, the length L is in the same dimension as the intended streamwise flow of fluid through the micro channel.

Micro channels useable with the subject invention may vary in size and dimension. In an embodiment, the micro channel width W is equal to the channel height H. In an embodiment, the channel width W is considerably larger than the channel height H. In an embodiment, the channel width W is 30 to 40 times greater than the channel height H. In an embodiment, the channel width W is less than 30 times greater than the channel height H. In an embodiment, the channel width W is more than 40 times greater than the channel height H. In an embodiment, the channel width W is less than the channel height H. The length L of the micro channel can also vary. In an embodiment, the length L of the micro channel is considerably greater than its width W. In an embodiment, the channel length L is 75 to 150 times greater than the channel width W. In an embodiment, the channel length L is more than 150 times greater than the channel width W. In an embodiment, the channel length L is less than 75 times greater than the channel width W. In an embodiment, the channel length L is less than the channel width W.

In embodiments, the channel height H of the micro channel ranges from 1 to 2 μm. In other embodiments, the channel height H of the micro channel ranges from 100 to 300 nm. In other embodiments, the channel height H is less than 100 nm. In other embodiments, the channel height H is more than 2 μm. In a particular embodiment, the micro channel has height, width, and length of about 1.2, 40, and 4000 μm respectively. In another embodiment, the micro channel has height, width, and length of about 1.33, 52.25, and 7500 μm respectively.

In an embodiment, a plurality of electrodes are arranged along the length of the micro channel and powered to induce flow of a fluid through the micro channel. In an embodiment, electrodes are arranged at or near the entrance of the micro channel to draw fluid into the micro channel. In an embodiment, electrodes are arranged at or near the exit of the micro channel to draw fluid out of the micro channel. In an embodiment, at least one pair of electrodes of the plurality of electrodes is separated by an interelectrode distance of less than 20 microns. In an embodiment, the interelectrode distance is in the direction of fluid flow. In an embodiment, the interelectrode distance is about 1 microns. In an embodiment, the interelectrode distance is about 3 microns. In an embodiment, the interelectrode distance is about 5 microns. In an embodiment, the interelectrode distance is between 1 and 15 microns. In an embodiment, the interelectrode distance is between 1 and 10 microns. In an embodiment, the interelectrode distance is less than 5 microns. In an embodiment, the interelectrode distance is between 1 and 5 microns. In an embodiment, the interelectrode distance is between 3 and 5 microns. Various configurations of electrodes can be used with the subject invention. Illustrative examples are further discussed below.

Figure 18:
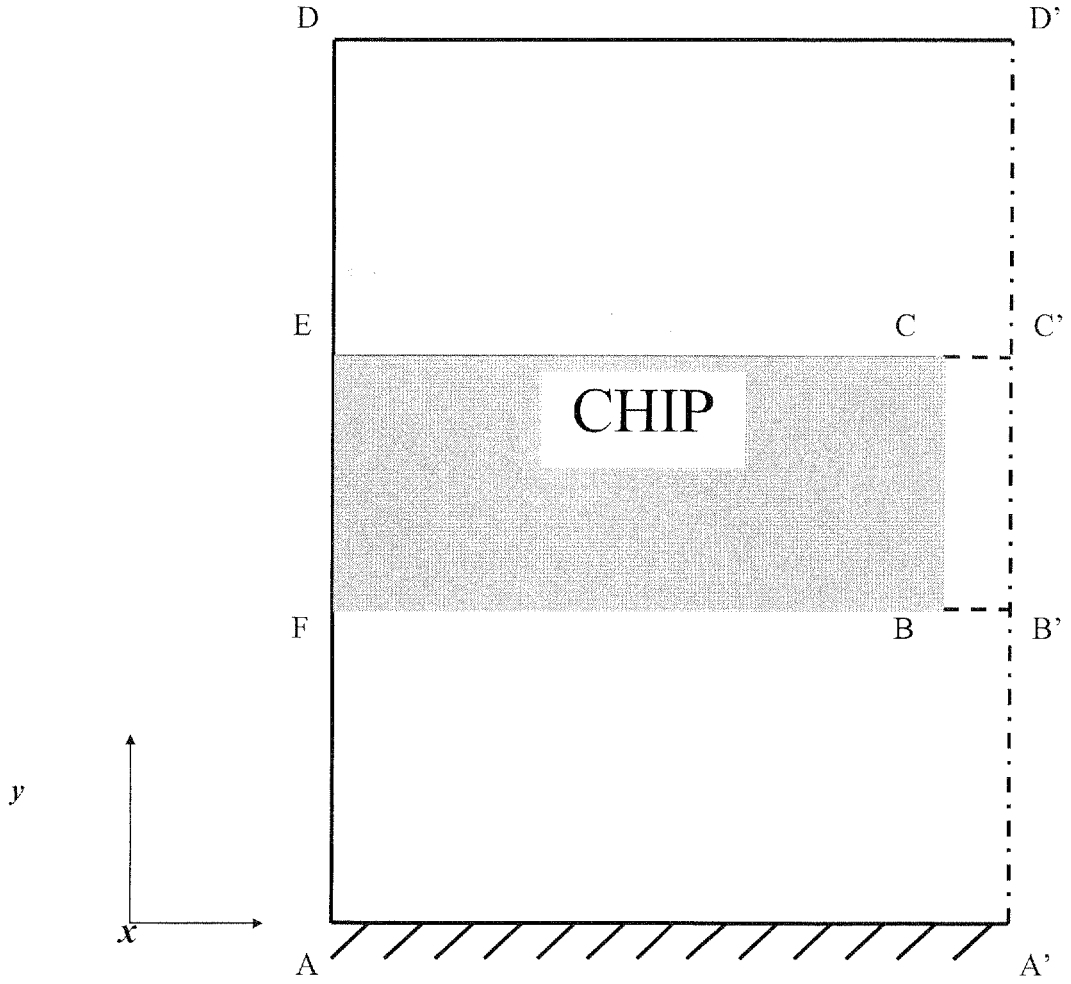
FIG. 18 shows geometry of a single expansion slot in a thruster chip in accordance with an embodiment of the subject invention.

In embodiments, one or more expansion slots are configured similar to the micro channels discussed above in relation to FIG. 17: wherein the channel height H is analogous to the expansion slot width, half of which is represented here by the section BB'; the channel width W is analogous to the slot length, which in FIG. 18 extends in a dimension perpendicular to the x and y axis (extending into or out of the page); and the channel length L is analogous to the expansion slot or chip thickness (i.e., the flow length), represented here by the section BC. Expansion slots useable with the subject invention may vary in size and dimension. In embodiments, the expansion slots have the same proportions and/or dimensions as the micro channels discussed above. The electrode configurations useable with the expansion slots can also mirror those described in relation to micro channels as further discussed below.

In an embodiment, the slot length is 50 to 100 times greater than the slot width. In an embodiment, the slot length is less than 50 times greater than the slot width. In an embodiment, the slot length is more than 100 times greater than the slot width. In an embodiment, the slot length is less than the slot width. In an embodiment, the slot thickness is 4 to 8 times greater than the slot width. In an embodiment, the slot thickness is less than 4 times greater than the slot width. In an embodiment, the slot thickness is more than 8 times greater than the slot width. In an embodiment, the slot thickness is less than the slot width.

In embodiments, the slot length of an expansion slot ranges from 3 mm to 1 cm in length. In embodiments, the slot length is less than 2 mm long. In embodiments, the slot length is more than 1 cm long. In embodiments, the slot width ranges from 100-200 μm. In embodiments, the slot width is less than 100 μm. In embodiments, the slot width is more than 200 μm. In embodiments, the slot or chip thickness ranges from 400 μm to 1.5 mm. In embodiments, the slot thickness is less than 400 μm. In embodiments, the slot thickness is more than 1.5 mm. In a particular embodiment, an expansion slot has width, thickness, and length of about 100 μm, 500 μm, and 6.5 mm respectively. In another embodiment, an expansion slot has width, thickness, and length of about 100 μm, 400 μm, and 1 cm respectively. As discussed below in relation to FIG. 41, the expansion slot can have various cross-sections. As discussed below in relation to FIG. 40, in embodiments, the width of the expansion slot is not uniform across its thickness.

In an embodiment, a plurality of electrodes are arranged along the length of an expansion slot and powered to induce flow of a fluid through the slot. In an embodiment, electrodes are arranged at or near the entrance of the expansion slot to draw fluid into the slot. In an embodiment, electrodes are arranged at or near the exit of the expansion slot to draw fluid out of the slot. Various configurations of electrodes can be used with the subject invention. In an embodiment, at least one pair of electrodes of the plurality of electrodes is separated by an interelectrode distance of less than 20 microns. In an embodiment, the interelectrode distance is in the direction of fluid flow. In an embodiment, the interelectrode distance is about 1 microns. In an embodiment, the interelectrode distance is about 3 microns. In an embodiment, the interelectrode distance is about 5 microns. In an embodiment, the interelectrode distance is between 1 and 15 microns. In an embodiment, the interelectrode distance is between 1 and 10 microns. In an embodiment, the interelectrode distance is less than 5 microns. In an embodiment, the interelectrode distance is between 1 and 5 microns. In an embodiment, the interelectrode distance is between 3 and 5 microns. Illustrative examples are further discussed below.

Figure 19:
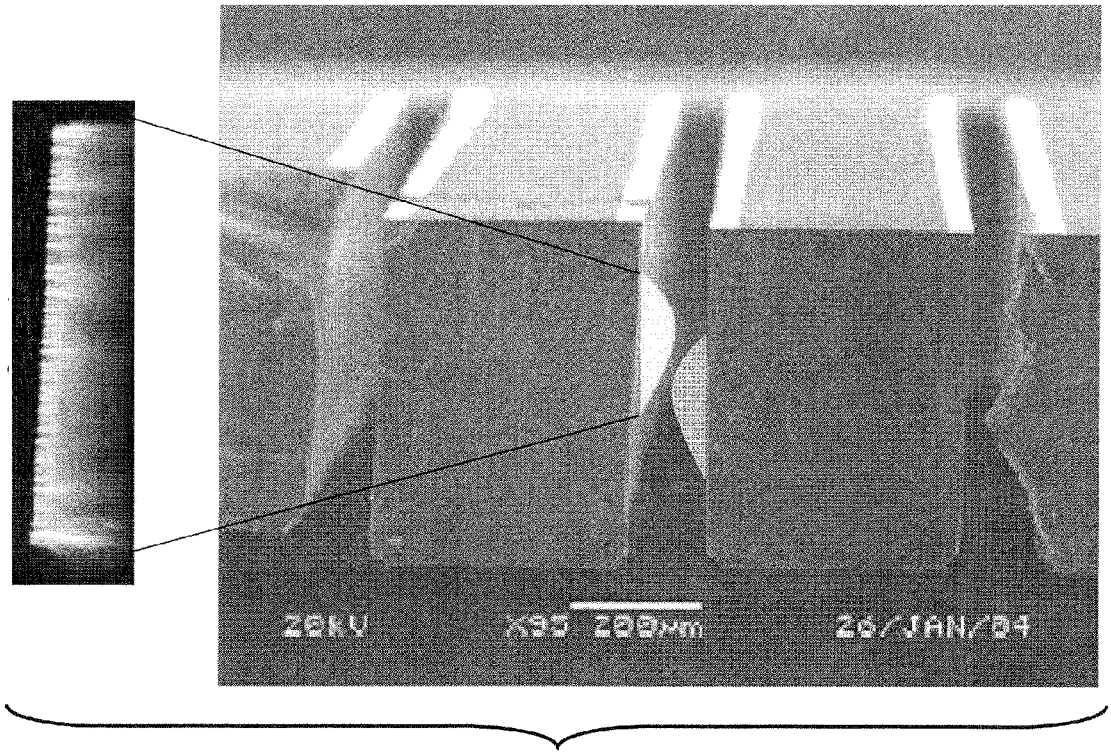
FIG. 19 shows a simulation of induced plasma within an expansion slot in accordance with an embodiment of the subject invention.

In an embodiment, pairs of electrodes are arranged and powered so as to generate a plasma discharge. FIG. 19 shows a simulation of induced plasma within an expansion slot in accordance with an embodiment of the subject invention. The image shown is substantially a cross-section of a thruster chip divided along the length of a number of expansions slots, such as the expansion slots discussed above in relation to FIG. 18. In an embodiment, a propellant fluid enters the expansion slots from the bottom of the image and flows through the slots substantially toward the top of the image. A scale of for the image is provided at the bottom. In the embodiment shown, plasma is induced along both sides of an expansion slot. As discussed below, various electrode configurations can be used to induce plasma in the expansion slot.

In an embodiment, a propulsion system of the present disclosure involves a multilayer arrangement of dielectric barriers between sets of electrodes. In an embodiment, several layers of a dielectric substrate are formed, each layer enveloping an electrode. In one embodiment, the inter-electrode gap is kept at a few microns to decrease the power requirement. Various configurations include differences in the number of insulation layers, insulation thicknesses, dielectric strengths, number of electrodes, electrode widths, inter-electrode gaps, applied frequencies, duty cycles, and voltages, for example.

Figure 20:
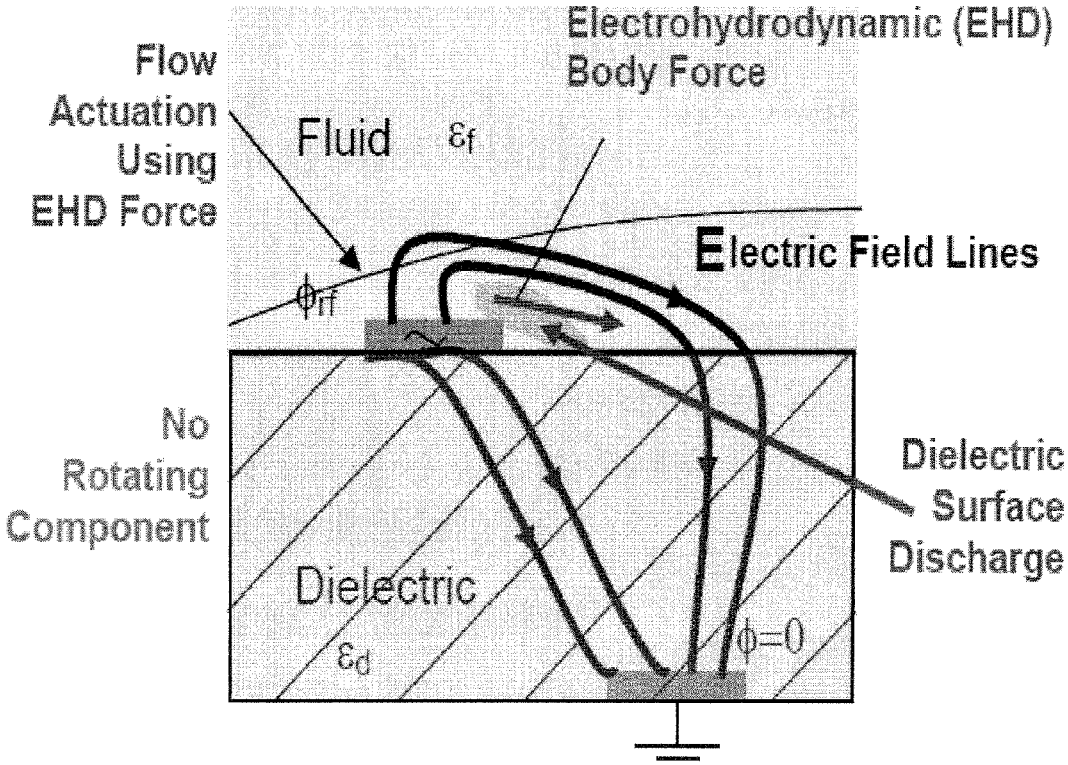
FIG. 20 is a schematic diagram for flow actuation using surface dielectric barrier discharge (DBD).
Figure 21:
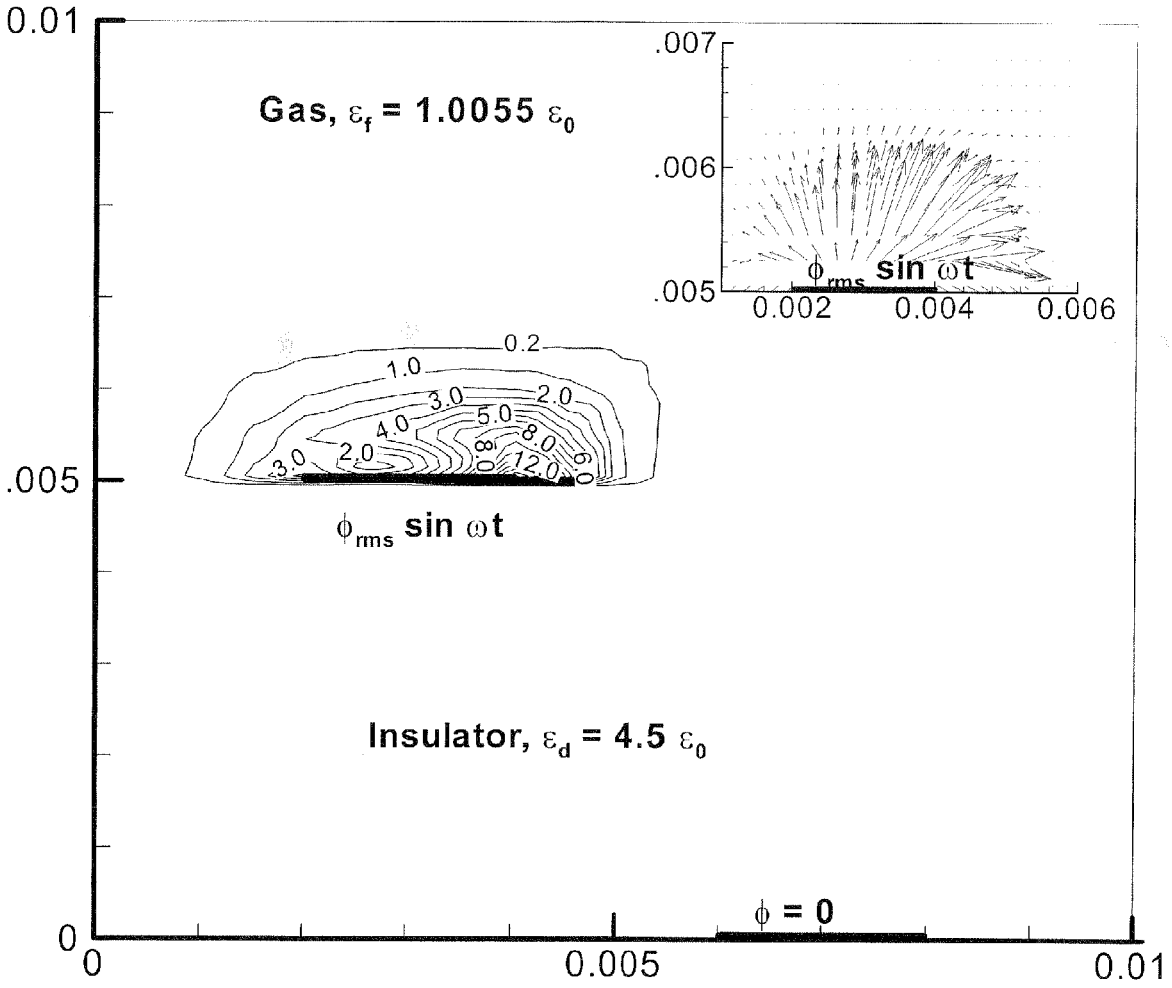
FIG. 21 is a diagram showing force variation of electric body force qE about the electrode-dielectric surface.
Figure 22:
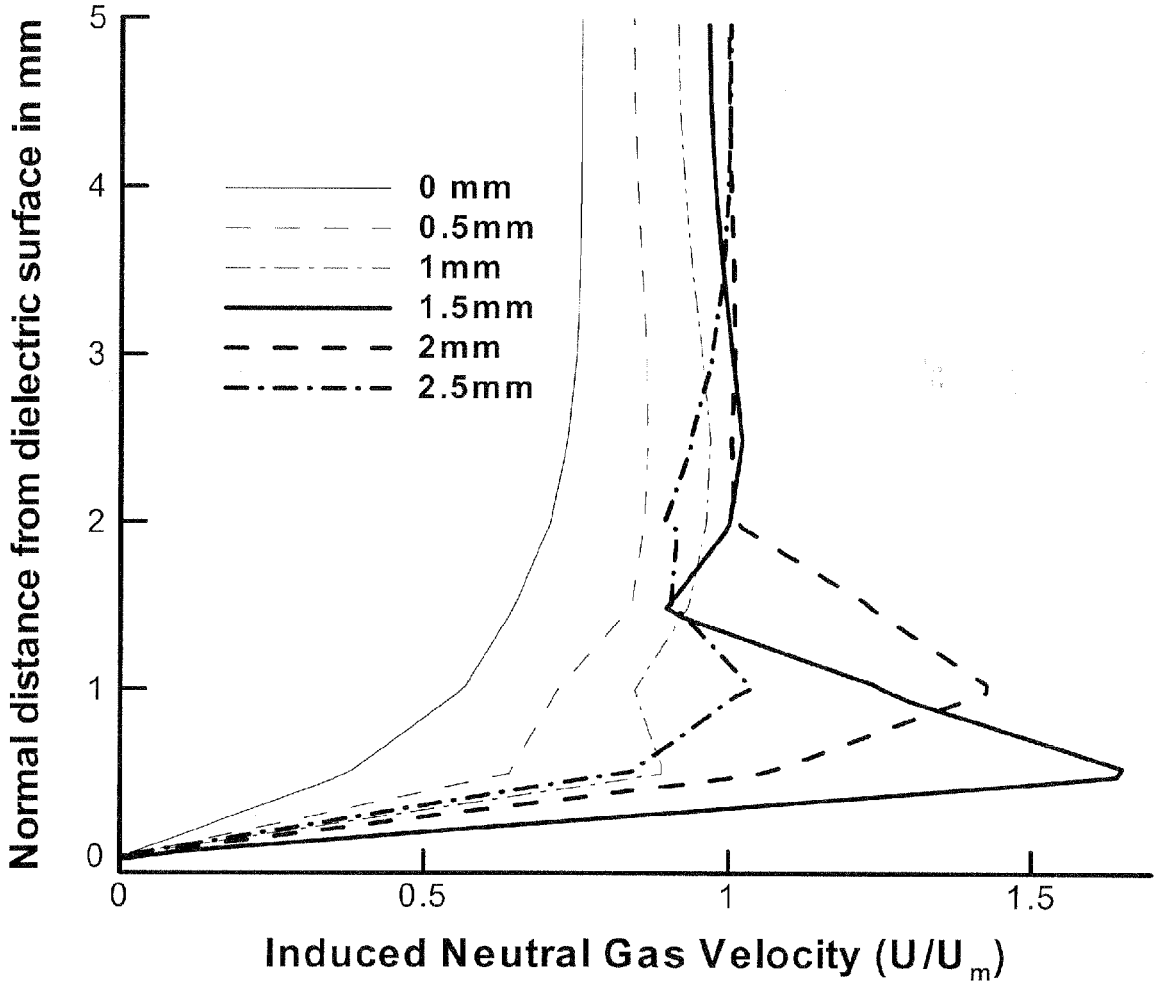
FIG. 22 is a diagram showing predicted streamwise gas velocity profiles induced by a body force, shown along different locations along the flow under a quiescent gas environment.

FIGS. 20-22 illustrate the process through which an electrodynamic qE body force actively controls the flow through an inducement of a wall jet in a quiescent condition. FIG. 20 shows the schematic for flow actuation using surface dielectric barrier discharge (DBD). Two electrodes are employed: the first exposed to the flow and the second embedded in the dielectric and displaced in the streamwise direction relative to the exposed electrode. The surface discharge so created contrasts with the volumetric effect observed when the electrodes are separated by the fluid. Typically, the actuator is excited by powering the exposed electrode at RF voltages, while the embedded electrode is grounded. In another arrangement, both electrodes are powered with signals separated by a beat frequency. The excitation induces a complex unsteady interaction between the two electrodes and the fluid, details of which depend on frequency, voltage, geometric configuration, and dielectric constants of the media.

In the surface discharge, within a very short time after breakdown, the discharge buildup at the dielectric surface sets off microdischarges of nanosecond duration, limiting the electric field at the location of the microdischarge such that the charge current at this position is cut off. Experimental evidence shows that there is no runaway state for the parameters under consideration and that an asymptotic (quasi) periodic state is reached, with a dominant frequency that is locked to the input perturbation. For a given interelectrode distance, as the applied voltage becomes sufficiently large, the dielectric surface adjacent to the RF electrode produces a harrier discharge, which weakly ionizes the surrounding gas. The combination of electrodynamic body force and collisional processes, whose detailed mechanics remain a matter of current research, ultimately transfers momentum acquired from the electric field by the charged particles to the neutrals which are the primary species.

Advantages of dielectric barrier-based discharges include, for example, an absence of moving parts, rapid on-off features, and the ability to apply body forces in a relatively precise manner by deploying advanced electromagnetic technology. Embodiments of the subject invention are thus suitable for flow control in micro channels or expansion slots, for example.

The electric field E exerts a net force qE through the space charge (q) separated plasma within the DBD. This microfilamentary discharge sustains an optical glow within a half cycle through many current pulses of nanosecond duration. The plasma can induce air flow up to several meters per second in atmospheric pressure. The parameters controlling such force include the applied voltage, frequency, dielectric characteristics, and the asymmetric configuration of the electrodes. The asymmetry in the location of the electrodes, coupled with the phase shift of the electrode when multiple devices are present, yields a directional asymptotic "push" on the bulk gas. The thickness of the exposed electrode affects the thrust produced by the actuator.

The variation of electric body force qE about the electrode-dielectric surface in FIG. 21 is predicted by using a multispecies formulation anchored in a high-fidelity finite element based multiscale ionized gas (MIG) flow code. The MIG code employs a self-consistent approach to model the near-wall physics of plasma gas interactions. The method is based on a versatile finite-element (FE) procedure adapted from fluid dynamics to overcome the stiffness of the equations generated by multi-species charge separation phenomena. A 2D bilinear finite element formulation is chosen with $4^{th}$ order Runge-Kutta time marching. The solution process consists of two steps. The first solves the equations for charge and electric field simultaneously. In the second step, the force so obtained is transferred to the airfoil after rotation and scaling. The MIG code also solves for the self-consistent fluid response. This implicitly assumes that the near-wall local fluid neutral velocity does not influence the distribution of electric parameters. This requires that the fluid density and pressure, or collisionality, are not much different from those employed in the plasma calculation.

The result computed for helium working gas describes a localized peak of the body force in the vicinity of the exposed electrode powered with a RF voltage of 1 kV rms at 5 kHz. The predicted streamwise gas velocity profiles induced by this force are shown along different locations in FIG. 22 under a quiescent gas environment. For atmospheric air, the induced peak velocity of the wall jet is about 1-2 m/s, which may be further accentuated by using a polyphase power supply. While this creates striking flow control effects at low speeds, the induced momentum may be too small for sufficiently actuating the high speed flows.

A first principle electrohydrodynamic (EHD) formulation can be used for modeling plasma discharge induced flows. Reported experiments and theoretical predictions have been traditionally limited to low speeds and low power due to the problems of arcing and low conversion of electrical energy into gas momentum. Thus, embodiments of the subject invention are directed to multibarrier actuators using several layers of dielectric barriers with embedded electrodes for moderate to high speed applications. Embodiments of the subject multibarrier actuators may vary in the number of insulation layers, insulation thickness, dielectric strength, number of electrodes, electrode width, electrode gap, applied frequency, duty cycle, and voltage, for example.

For flow control applications near atmospheric pressure, the allowable electrode spacing necessary for maximum volumetric ionization is d=0.077 mm. In many applications, this is an impractical limitation. One solution to this limitation comes from the development of RF glow discharge using an a.c. voltage potential across the electrodes. The frequency of the current should be such that within a period of the a.c. cycle, electrons travel to the electrodes and generate a charge, while the heavier ions do not. Based on reported experiments, the time-averaged plasma parameters for atmospheric glow discharge has air or other gases at 760±25 torr with relative humidity below 14%. A homogeneous glow can be maintained at about 3 to 10 kHz RF and rms electrode voltage between about 3 to 16 kV. For a gap distance of about 2-5 mm, the electron number density is $\sim 10^{17}$ $m^{-3}$ and volumetric power dissipation is about 1 $MW/m^3$.

In an embodiment, a sheath region is generated within a flow region, wherein the sheath region has a high electric field relative to the remainder of the flow passage. In an embodiment, the number density of ions in the sheath region is significantly greater than the number density of electrons in the sheath region.

Figure 23:
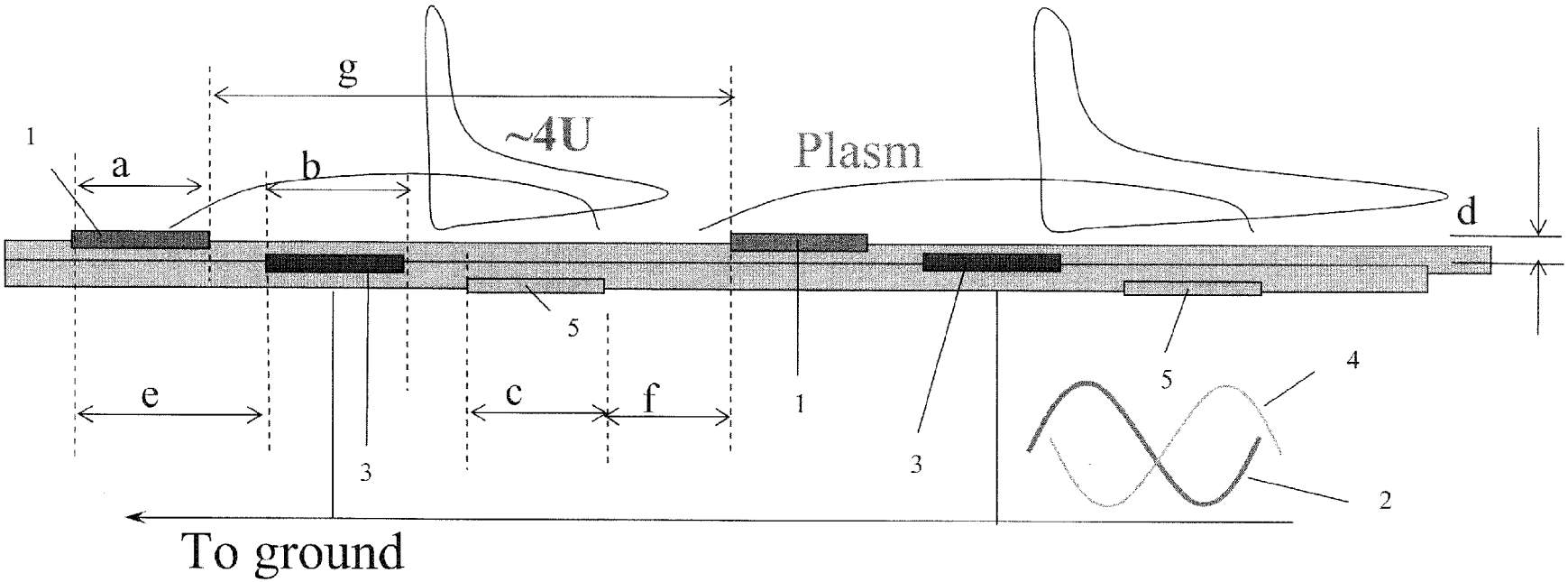
FIG. 23 is a schematic diagram of one embodiment of a multilayer actuator in accordance with the subject invention.

In an embodiment, a multilayer actuator is designed with several layers of dielectric, each incorporating an electrode. FIG. 23 shows a schematic for one embodiment of a bi-layer design as an example. In an embodiment, the interelectrode distance d is kept at a few microns, thereby reducing or eliminating the kHz RF power requirement. In an embodiment, the interelectrode distance d is less than 20 microns. In an embodiment, the interelectrode distance d is about 1 microns. In an embodiment, the interelectrode distance d is about 3 microns. In an embodiment, the interelectrode distance d is about 5 microns. In an embodiment, the interelectrode distance d is between 1 and 15 microns. In an embodiment, the interelectrode distance d is between 1 and 10 microns. In an embodiment, the interelectrode distance d is less than 5 microns. In an embodiment, the interelectrode distance is d between 1 and 5 microns. In a preliminary experiment, the electrodes are powered with wall ac supply (60 Hz) through neon transformers and tested for a stable glow. The voltage pattern 2 shown at the bottom right of FIG. 23 is applied between the electrode 1 nearest the surface and the ground electrode 3 in the middle of the dielectric layers, while voltage pattern 4 is applied between the electrode 5 farthest from the surface and the ground electrode 3. The electrode 1 nearest the surface can be exposed to the fluid in the flow region or can have a coating separating the electrode 1 surface from the fluid in the flow region, depending on the fluid properties (e.g., electrical conductivity) and other design parameters. The stable discharge at single phase power induces a significantly large body force in an extended region, resulting in a possible order of magnitude increase in wall jet velocity with minimum arcing. Initial measurements show at least four times increase in the induced jet velocity (~4 U). By using a set of phase lagged electrodes powered by a pulsed ac/dc supply, the induced wall jet can be improved by an order of magnitude, such as up to about 7-10 m/s.

Figure 24:
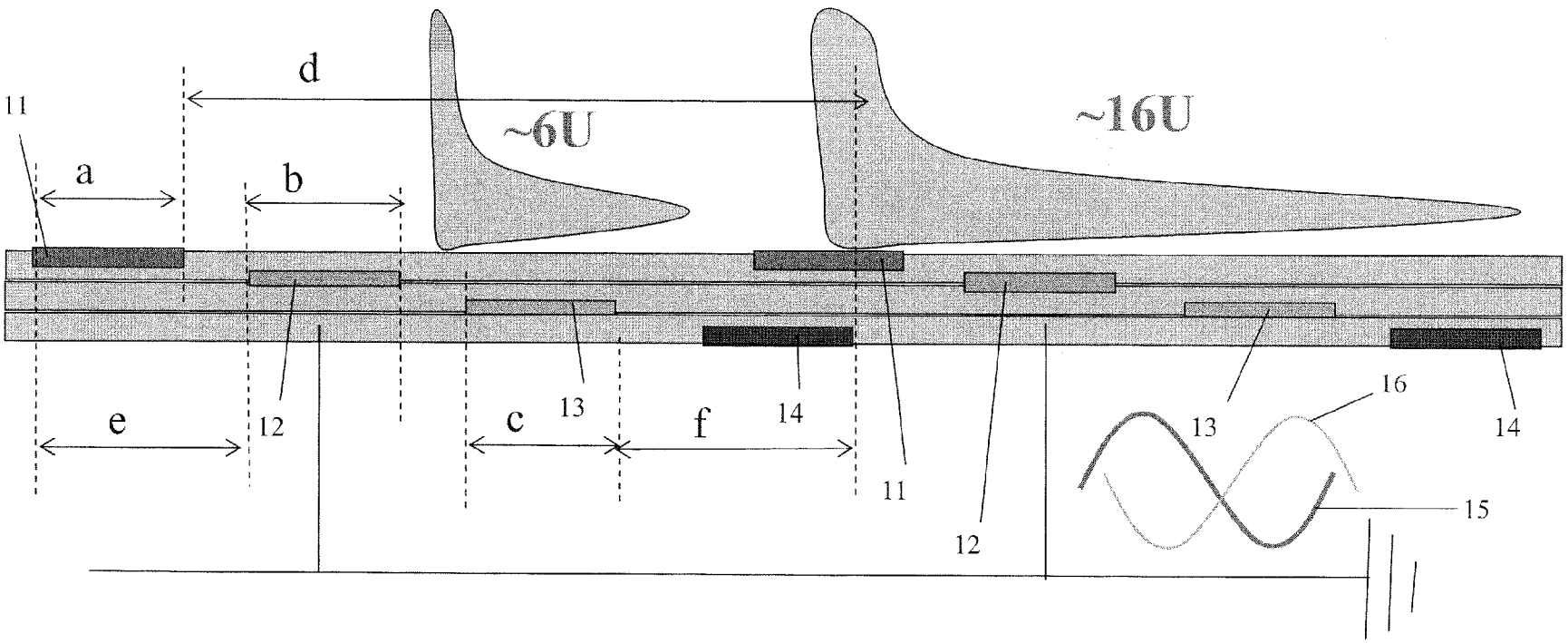
FIG. 24 is a schematic diagram of a second embodiment of a multilayer actuator of the present disclosure, with an increased number of layers.

FIG. 24 shows an extremely large acceleration gain (i.e. >15 U induced velocity) for the multilayer arrangement. The voltage pattern 15 is applied between the electrode 11 nearest the surface and the ground electrode 13, while the voltage pattern 16 is applied between electrode 12 and the ground electrode 13. This may be achieved for the same energy density of plasma as of a monolayer arrangement. In additional embodiments, the number of layers can be increased to increase the plasma coated surface area. This means more EHD body force and resulting gas velocity are induced. Also, at this velocity, small scale turbulence may dominate the flow actuation process. Further, the micron level insulator thickness may influence the induced force. The electrodes can be positioned and driven in a variety of configurations and patterns, respectively, to induce a variety of flow patterns. In embodiments, as discussed above, such electrodes can be positioned on various surfaces making up a propulsion system. For example, such electrodes can be positioned on a propellant tank, drain/fill valve, filter assembly, control valve, micro channel, expansion slot, or other conduit used in the propulsion system.

Figure 25:
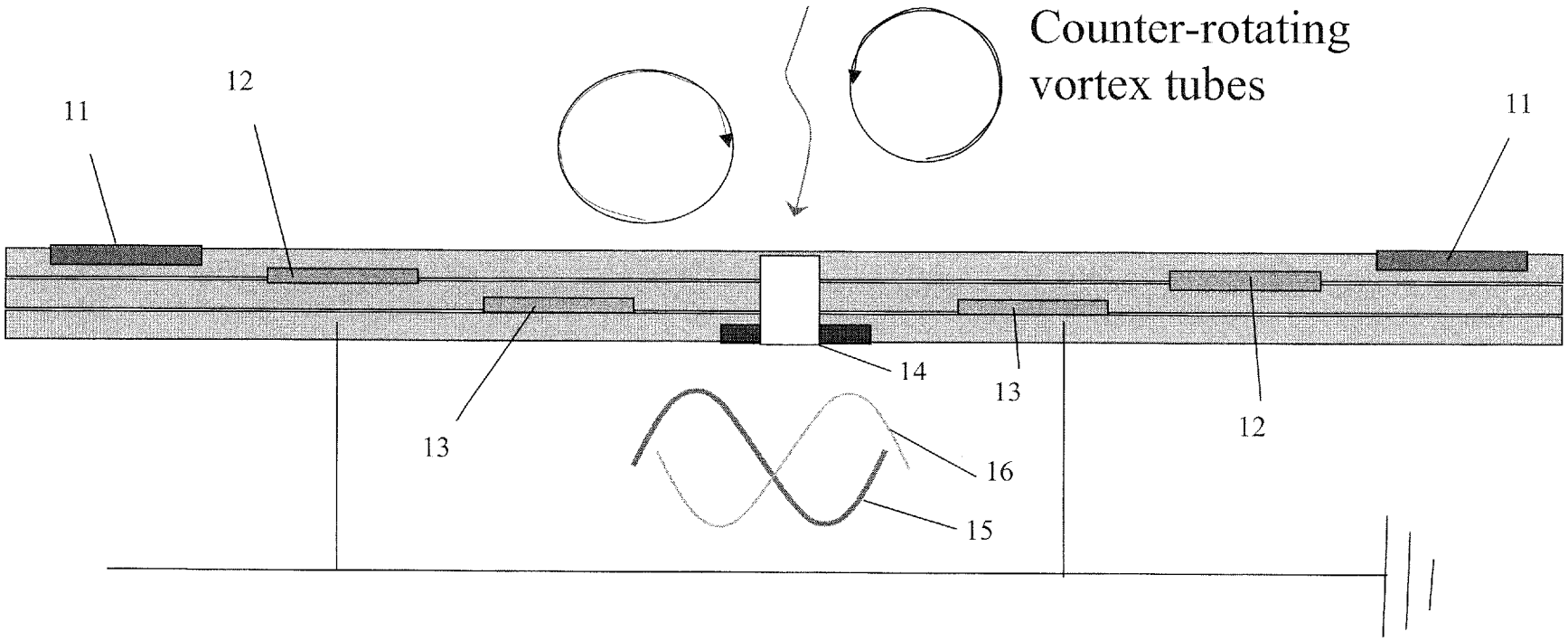
FIG. 25 is a schematic diagram showing that flow actuation may be used for creating large or small counter rotating vortices.

As an example, as shown in FIG. 25, flow actuation may be used for creating large or small counter rotating vortices. As discussed above, in embodiments, such vortices can be used to direct flow into or out of a conduit such as an expansion slot, micro channel, or other conduit. Based on the applied phase difference, these counter rotating vortex tubes can be slightly or greatly misaligned. In an embodiment, various vortex structures similar to those forming about different body shapes can be created. For example, the Karman vortex street for flow over a cylindrical object can be easily generated for electrode sets operating at a phase difference of $\pi/2$ with a select duty cycle. A powerful alternative for the synthetic jets can also be implemented with this design.

Figure 26:
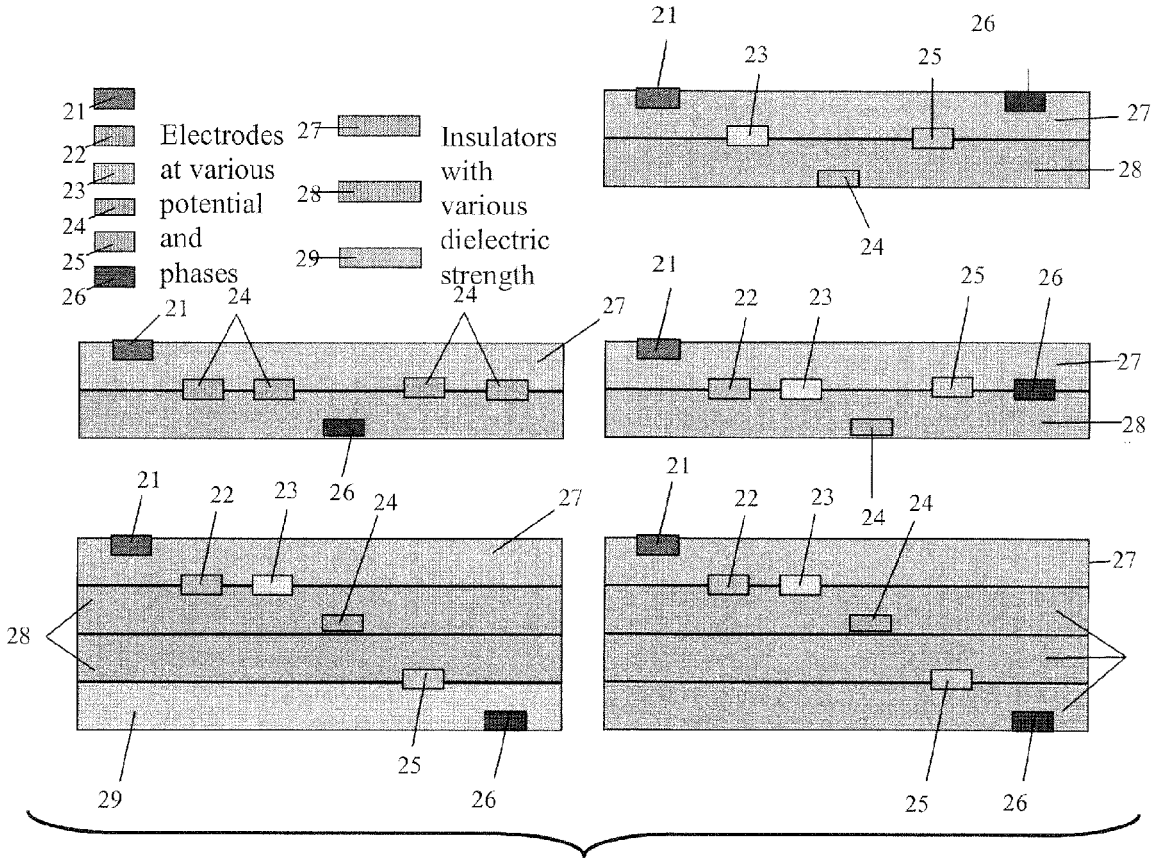
FIG. 26 illustrates several additional exemplary embodiments of the multilayer actuators of the present disclosure.

FIG. 26 illustrates several additional exemplary embodiments of the multilayer actuators in accordance with the subject invention, showing various geometric and electrical configurations. Various insulator materials such as KAPTON™ and TEFLON™ and their combinations, for example, can be utilized for minimum heat loss inside the dielectric material. Multilayer actuators of the present invention may have any number of insulation layers, insulation thicknesses, dielectric strengths, numbers of electrodes, electrode widths, inter-electrode gaps, applied frequencies, duty cycles, and voltages, for example. In an embodiment, such structures are applied to an interior surface of a micro channel, expansion slot, or other conduit to induce flow through the conduit.

Figure 27A:
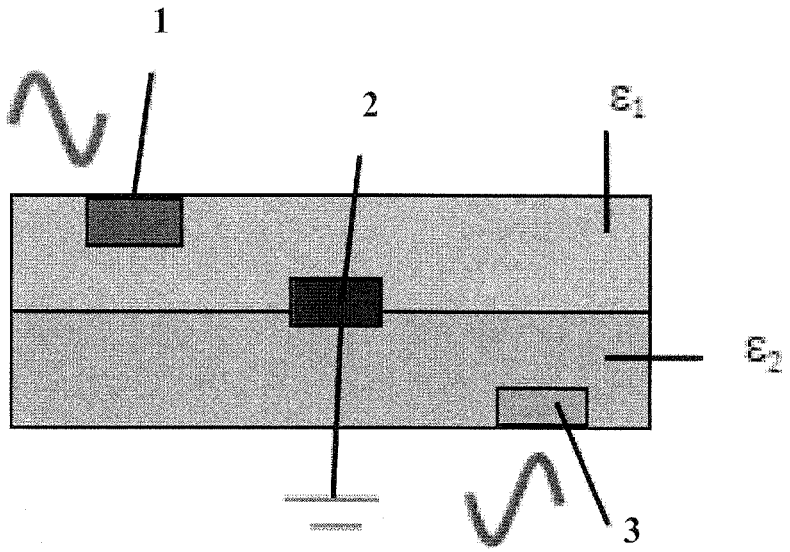
FIGS. 27A and 27B show specific embodiments of the invention having certain relationships between driving voltage and amplitudes and frequencies.
Figure 27B:
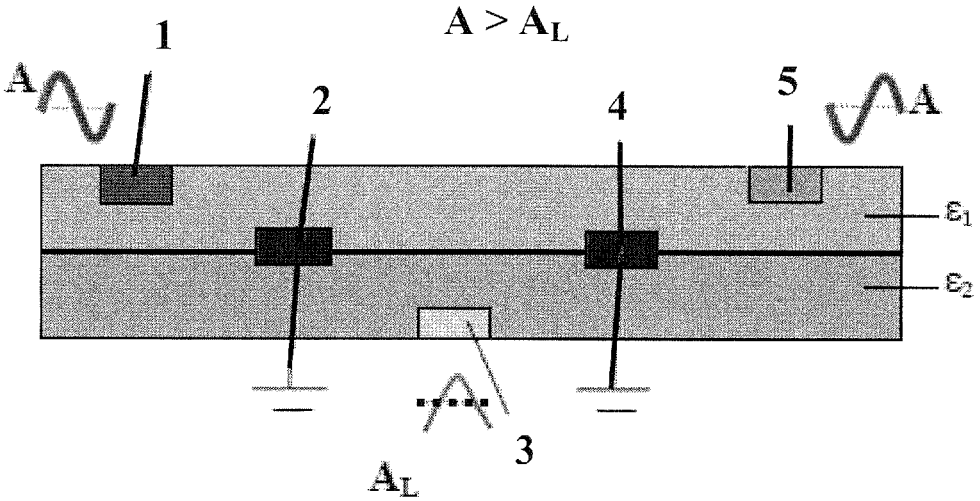

Referring to FIG. 27A, an embodiment is shown where the amplitude, A, and frequency, k, of the voltage applied between electrodes 1 and 2 and between electrodes 3 and 2 is the same. FIG. 27B shows an embodiment where the amplitude, $A_L$, and frequency, $k_L$, applied between electrodes 3 and 2 is different than the amplitude, A, and frequency applied between electrodes 1 and 2 and electrodes 5 and 4.

Figure 28A:
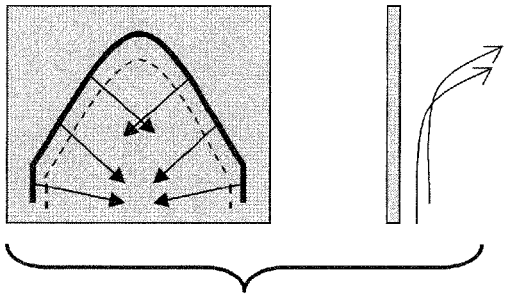
FIGS. 28A and 28B show specific embodiments of the invention for creating a flow force directed away from the substrate.
Figure 28B:
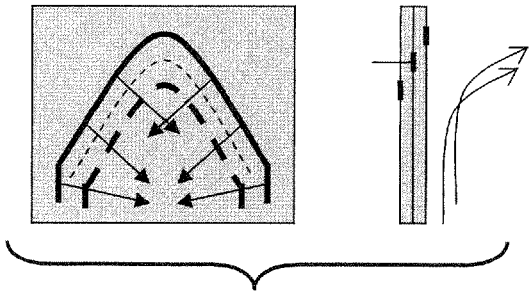

Additional embodiments of the invention can involve electrode structures incorporating curvatures or angles, such as triangle, square, or angle, with respect to the longitudinal dimension of the electrode pattern. Referring to FIGS. 28A and 28B, electrode patterns incorporating such curvatures are shown. FIG. 28A illustrates an electrode pattern having a cross-section as shown in the right side of FIG. 28A, where the longitudinal dimension of the electrode pattern incorporates a curvature, as shown on the left side of FIG. 28A. FIG. 28B shows an electrode pattern having a cross-section as shown in the right side of FIG. 28B, where the longitudinal dimension of the electrode pattern incorporates a curvature, as shown on the left side of FIG. 28B. The electrode patterns in FIGS. 28A and 28B can be used for bulk flow actuation and can create an upward body force away from the surface. The fluid receives a force from a plurality of directions such that fluid collides and is forced upward from surface or down toward surface. The arrows in FIGS. 28A and 28B show the direction of the flow when looking at a cross-section cut from the top to bottom of the respective electrode pattern with the ground electrode being on the inside of the curvature.

Figure 29A:
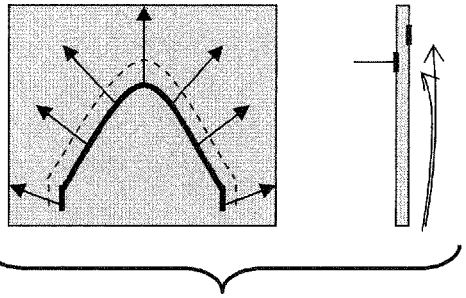
FIGS. 29A and 29B show specific embodiments of the invention for creating a flow force directed toward the substrate.
Figure 29B:
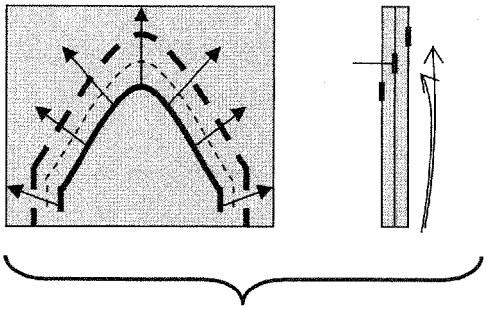

FIGS. 29A and 29B show the electrode patterns of FIGS. 28A and 28B, respectively, with the ground electrode being on the outside of the curvature in FIG. 29A and the electrode driven to create a body force from the inner electrode to the outer electrode. The arrows shown in FIGS. 29A and 299 show the flow created by driving the electrode structures in this manner.

Figure 30:
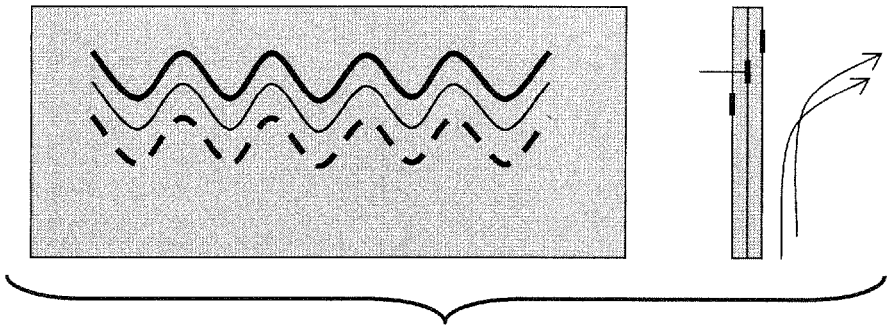
FIG. 30 shows a specific embodiment having a serpentine turbulator design for creating a flow force directed away from the substrate.

FIG. 30 shows an electrode structure having a serpentine turbulator design in the longitudinal dimension. The arrows on the right side show the flow for a cross-section cut from top to bottom where the electrodes are driven to produce a body force from the outer electrode to the inner electrode with respect to one of the curved sections.

Figure 31:
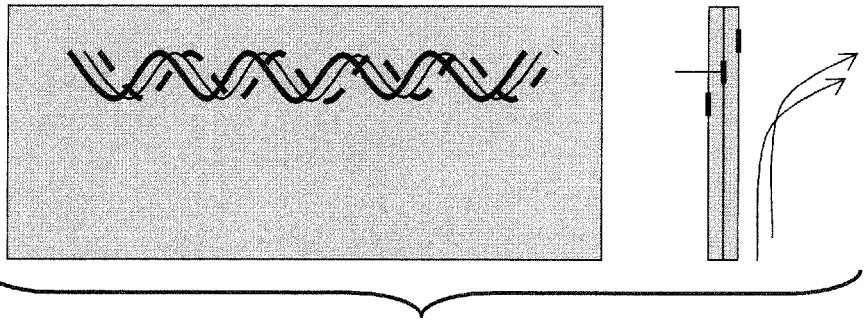
FIG. 31 shows a specific embodiment having a serpentine turbulator design for creating a flow force directed toward the substrate.

FIG. 31 shows another embodiment having a serpentine turbulator design in the longitudinal dimension where the electrodes have a different orientation from the electrode pattern in FIG. 30. The arrows show the flow for a cross-section out from top to bottom at a location where the body force is away from the surface.

Figure 32:
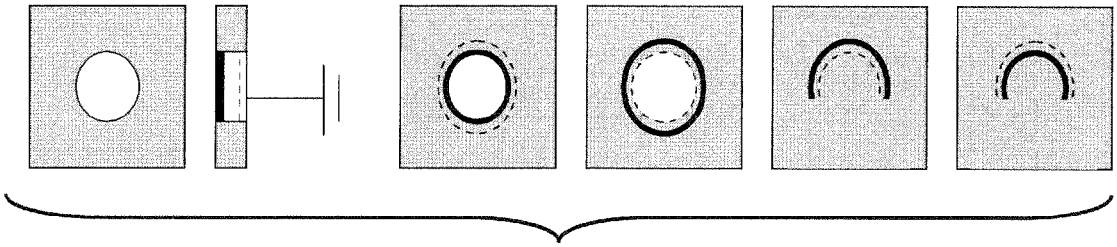
FIG. 32 shows various specific embodiments of the subject invention.

A variety of curvatures can be implemented in accordance with the subject invention. FIG. 32 shows additional embodiments of electrode patterns incorporating curvatures in the longitudinal dimension of the electrodes, including an electrode pattern surrounding an aperture in the substrate and an electrode pattern in the shape of a half circle. Other shapes include, but are not limited to, angles, triangles, rectangles, polygons, and other shapes that vary from straight. The electrode pattern surrounding the aperture can be designed and driven to pull flow up through the aperture or driven to force flow into the aperture. Likewise, the electrode pattern in the half circle can be designed and driven to force flow away from the substrate or designed and driven to pull flow toward the substrate.

Figure 33A:
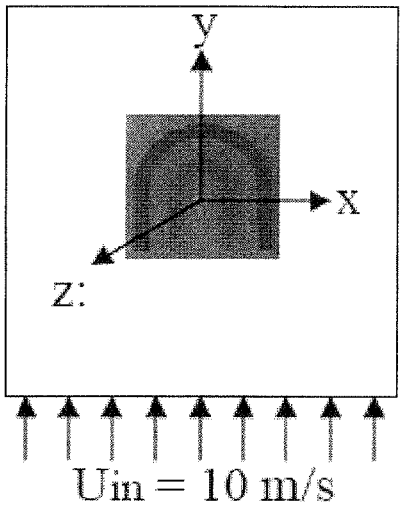
FIGS. 33A and 33B show an embodiment having a horseshoe shaped electrode pattern.
Figure 34:
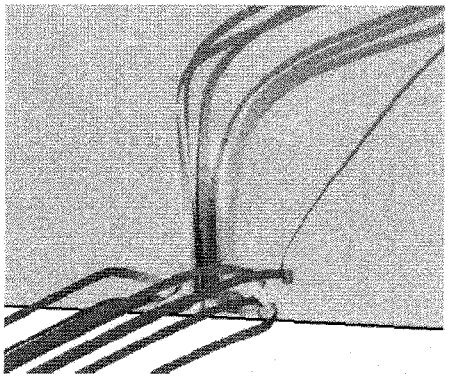
FIG. 34 shows a flow pattern for the embodiment of FIG. 21A.
Figure 33B:
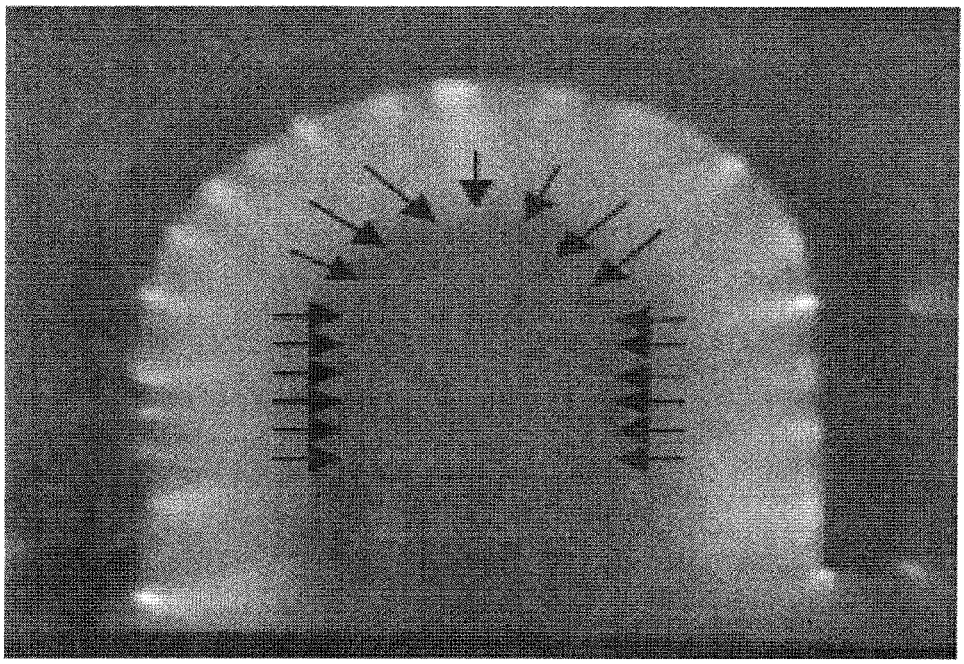
Figure 35A:
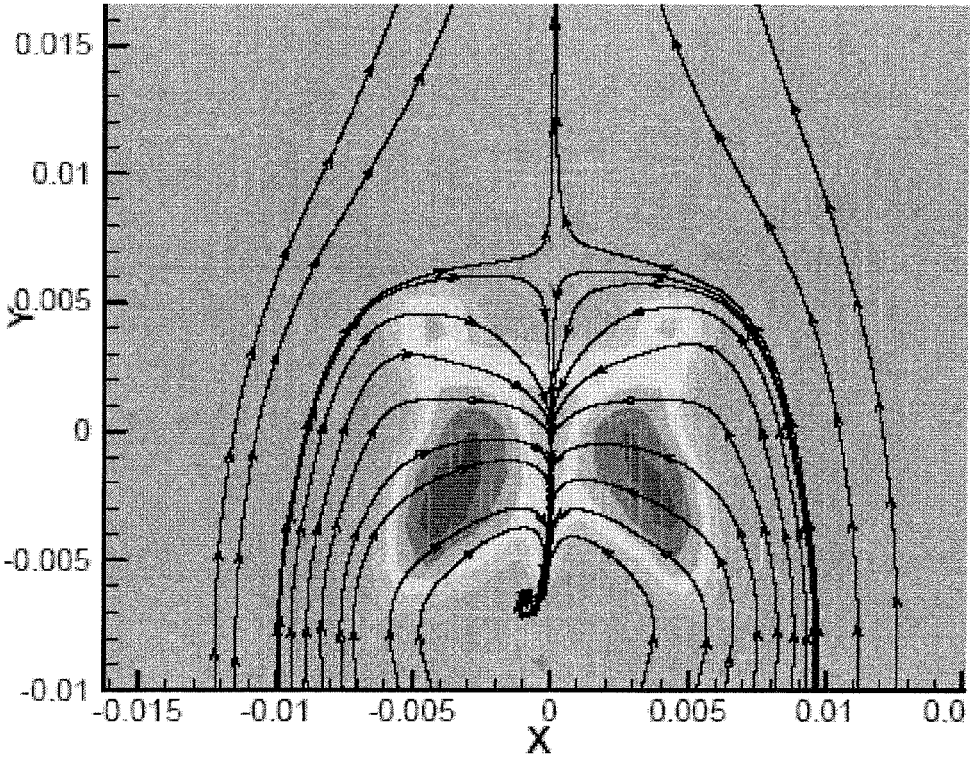
FIGS. 35A-35C show data illustrating the operation of the embodiment of FIG. 21A.
Figure 35B:
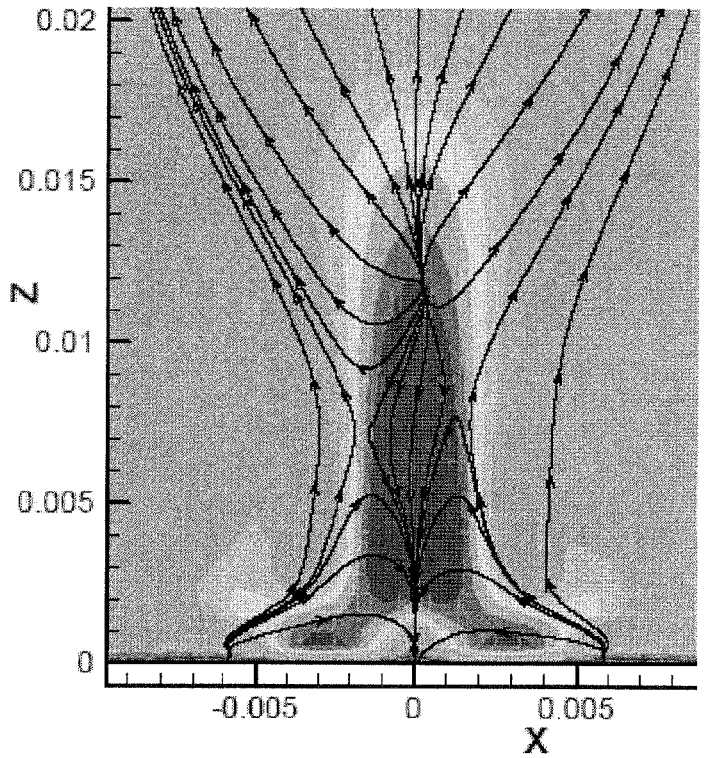
Figure 35C:
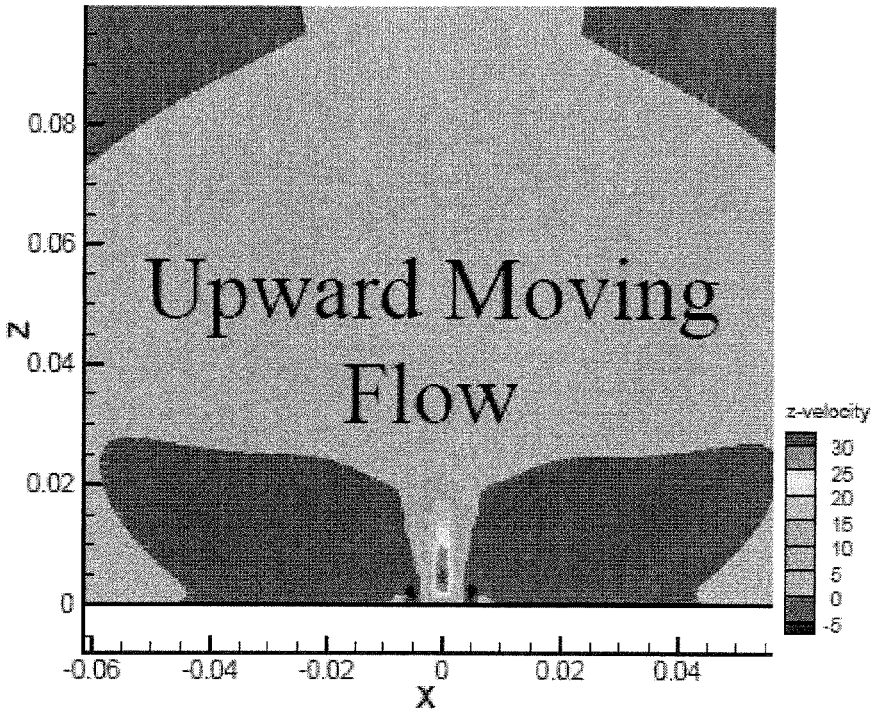

FIGS. 33A and 33B show an electrode pattern similar to the pattern in FIG. 28A and the corresponding glow pattern, respectively. The electrode pattern of FIG. 33A is driven to create the body force from the outer electrode to the inner electrode. FIG. 34 shows flow traces, and FIGS. 35A-35C show data illustrating the upward body force produced by this electrode pattern when driven in this matter where the summation of the flow-force creates an upward flow force.

In embodiments, such electrode patterns can be positioned on various surfaces of a propulsion system and powered to control flow of a propellant fluid through the system. For example, such electrodes can be positioned on a propellant tank, drain/fill valve, filter assembly, control valve, micro channel, expansion slot, or other conduit used in the propulsion system. Various illustrative examples are provided and discussed below. These examples are not meant to limit the subject invention.

Figure 36:
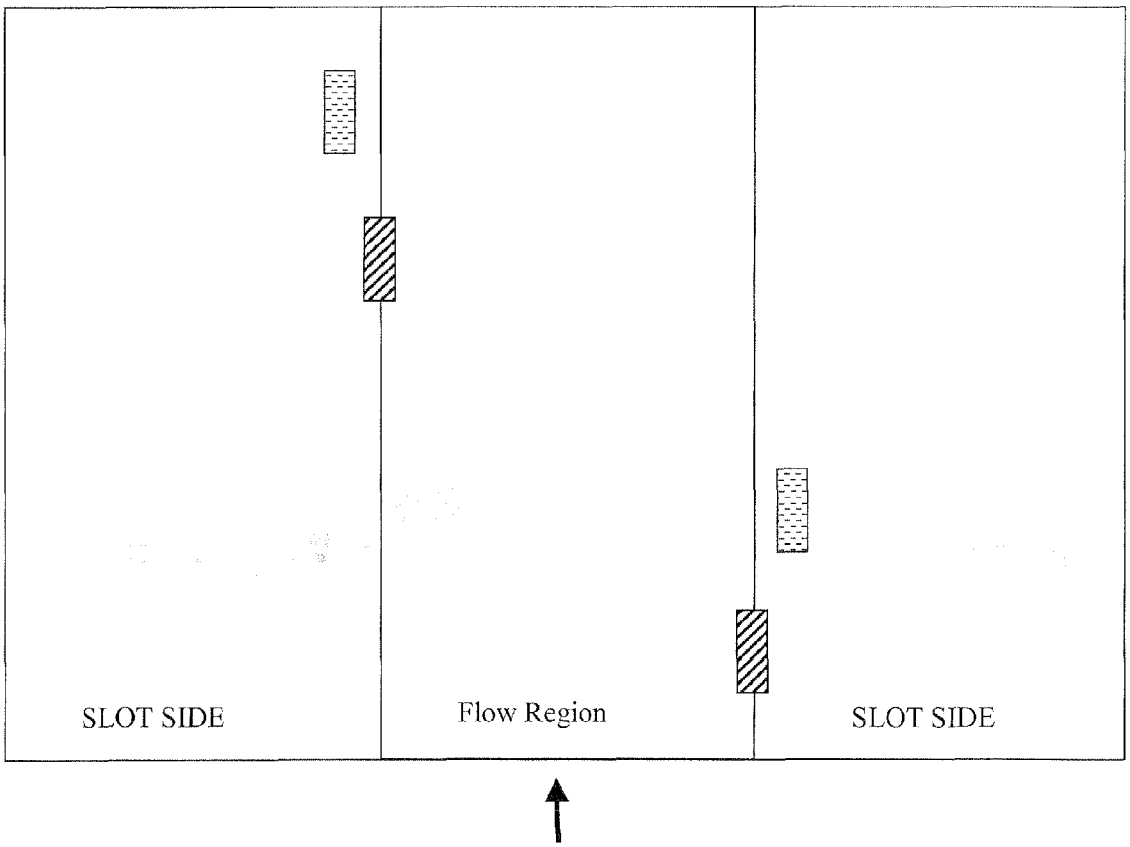
FIG. 36 shows a schematic diagram of a conduit configured to use a DBD in accordance with an embodiment of the subject invention.

FIG. 36 shows a schematic diagram of a conduit, such as a micro channel, expansion slot, or other conduit, configured to use a DBD in accordance with an embodiment of the subject invention. In the embodiment shown, two pairs of electrodes are formed in surfaces of the conduit. In an embodiment, the pairs of electrodes are powered to produce a DBD that induces flow of a propellant through the conduit. In an embodiment, the pairs of electrodes are powered in parallel. In an embodiment, the pairs of electrodes are powered sequentially. In an embodiment, multilayer actuators, such as the multilayer actuators discussed above, are formed in surfaces of the conduit. In an embodiment, at least one of the pairs of electrodes is separated by an interelectrode distance of less than 20 microns. In an embodiment, the interelectrode distance is about 1 microns. In an embodiment, the interelectrode distance is about 3 microns. In an embodiment, the interelectrode distance is about 5 microns. In an embodiment, the interelectrode distance is between 1 and 15 microns. In an embodiment, the interelectrode distance is between 1 and 10 microns. In an embodiment, the interelectrode distance is less than 5 microns. In an embodiment, the interelectrode distance is between 1 and 5 microns. In an embodiment, the interelectrode distance is between 3 and 5 microns.

Figure 37:
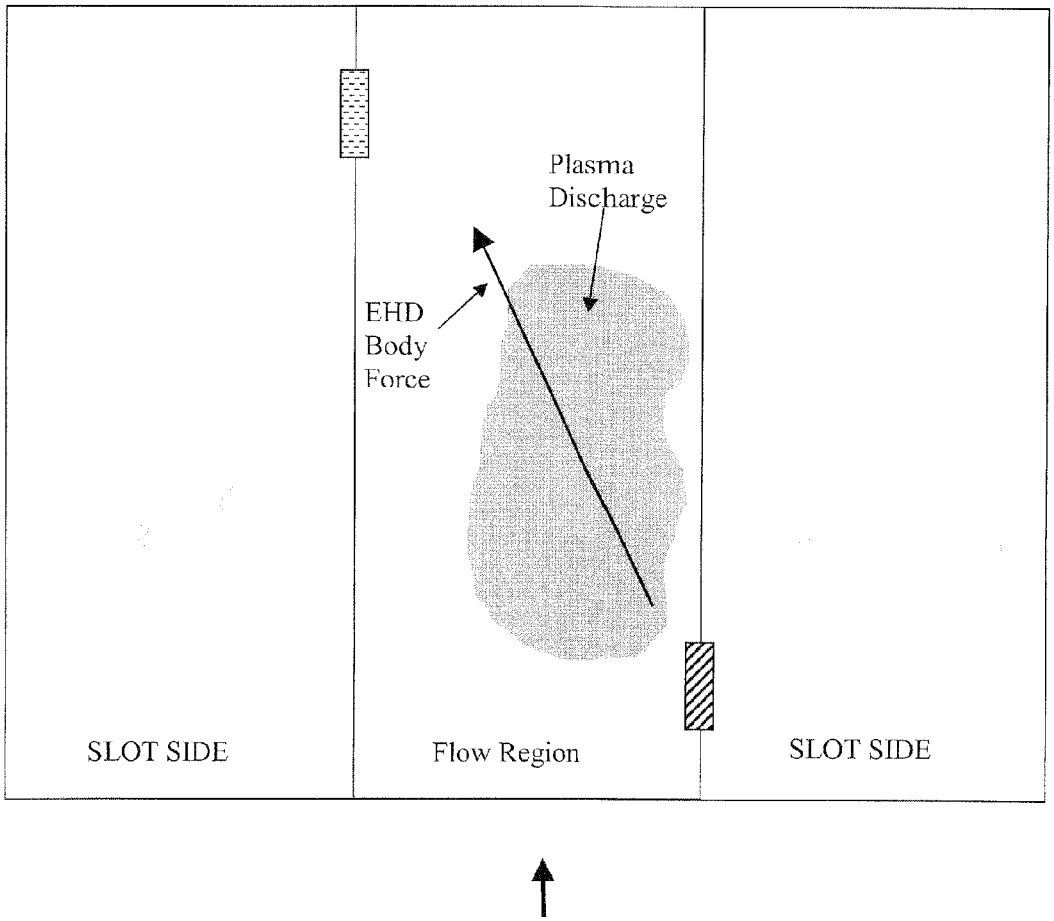
FIG. 37 shows a schematic diagram of a conduit using a volumetric plasma discharge in accordance with an embodiment of the subject invention.

FIG. 37 shows a schematic diagram of a conduit, such as a micro channel, expansion slot, or other conduit, using a volumetric plasma discharge in accordance with an embodiment of the subject invention. In the embodiment shown, a pair of electrodes is formed in surfaces of the conduit. In an embodiment, the pairs of electrodes are powered to generate a volumetric plasma discharge. The volumetric discharge in turn produces an EHD body force that induces flow of a propellant through the conduit. In an embodiment, the pair of electrodes is separated by an interelectrode distance of less than 20 microns. In an embodiment, the interelectrode distance is about 1 microns. In an embodiment, the interelectrode distance is about 3 microns. In an embodiment, the interelectrode distance is about 5 microns. In an embodiment, the interelectrode distance is between 1 and 15 microns. In an embodiment, the interelectrode distance is between 1 and 10 microns. In an embodiment, the interelectrode distance is less than 5 microns. In an embodiment, the interelectrode distance is between 1 and 5 microns. In an embodiment, the interelectrode distance is between 3 and 5 microns.

Figure 38:
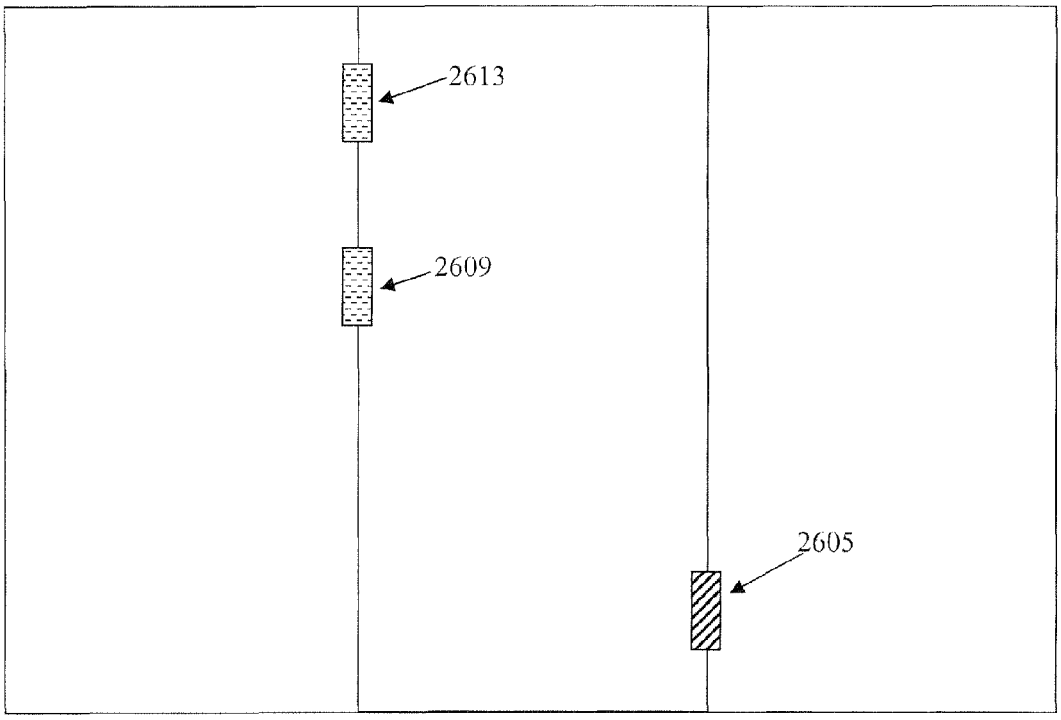
FIG. 38 shows a schematic diagram of a conduit configured to use volumetric plasma discharges in accordance with another embodiment of the subject invention.

FIG. 38 shows a schematic diagram of a conduit, such as a micro channel, expansion slot, or other conduit, configured to use volumetric plasma discharges in accordance with another embodiment of the subject invention. In the embodiment shown, three electrodes 2605, 2609, 2613 are formed on surfaces of the conduit. In an embodiment, the electrodes can be powered in pairs to produce volumetric plasma discharges within the conduit. In an embodiment, the electrode 2605 is first powered with the electrode 2609 to produce a first volumetric plasma discharge within the conduit. The electrode 2605 is later powered with the electrode 2613 to produce a second volumetric plasma discharge further down the conduit. In an embodiment, at least one of the powered pairs is separated by an interelectrode distance of less than 20 microns. In an embodiment, the interelectrode distance is about 1 microns. In an embodiment, the interelectrode distance is about 3 microns. In an embodiment, the interelectrode distance is about 5 microns. In an embodiment, the interelectrode distance is between 1 and 15 microns. In an embodiment, the interelectrode distance is between 1 and 10 microns. In an embodiment, the interelectrode distance is less than 5 microns. In an embodiment, the interelectrode distance is between 1 and 5 microns. In an embodiment, the interelectrode distance is between 3 and 5 microns.

Figure 39:
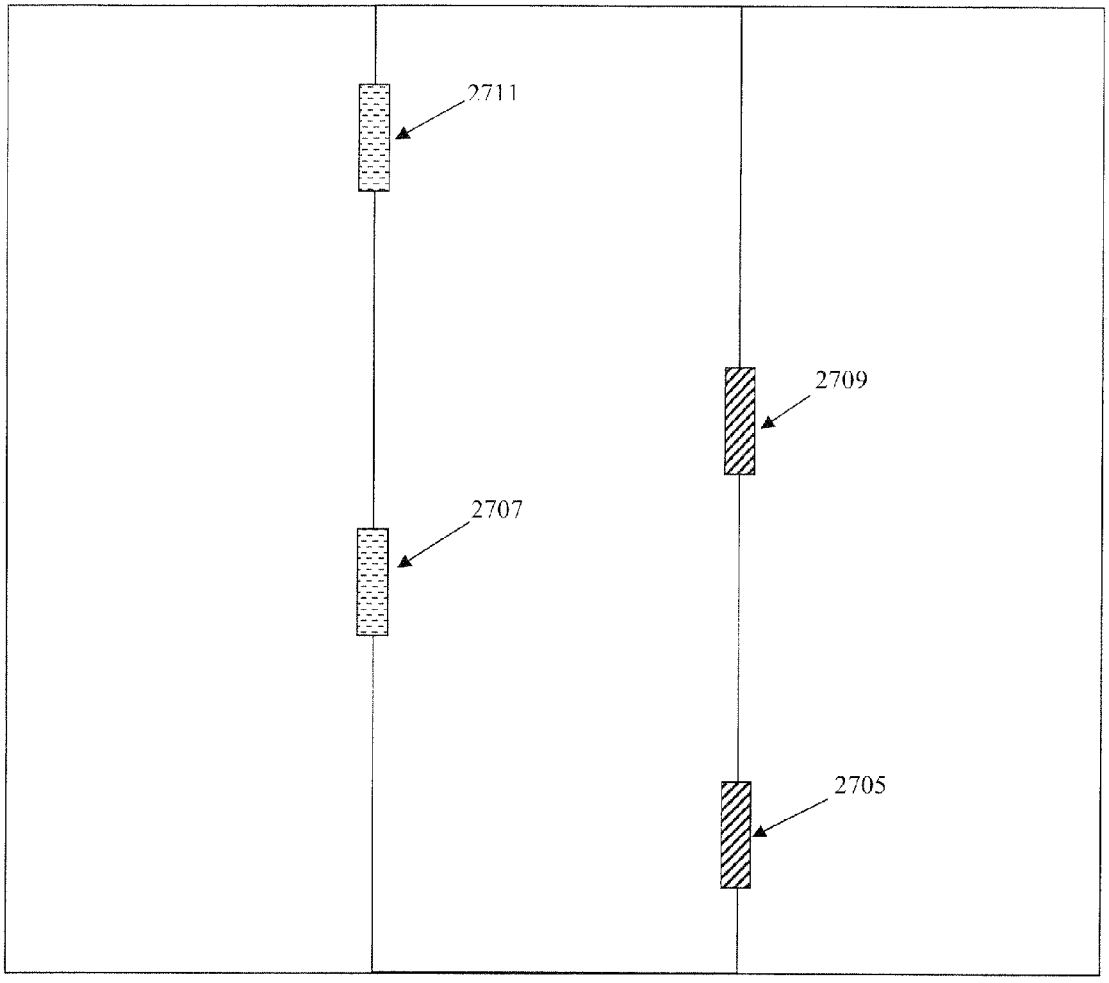
FIG. 39 shows a schematic diagram of a conduit configured to use volumetric plasma discharges in accordance with yet another embodiment of the subject invention.

FIG. 39 shows a schematic diagram of a conduit, such as a micro channel, expansion slot, or other conduit, configured to use volumetric plasma discharges in accordance with yet another embodiment of the subject invention. In the embodiment shown, four electrodes 2705, 2707, 2709, 2711 are formed on surfaces of the conduit. In an embodiment, the electrodes can be powered in pairs to produce volumetric plasma discharges within the conduit. In an embodiment, the electrode 2705 is first powered with the electrode 2707 to produce a first volumetric plasma discharge within the conduit. The electrode 2709 is later powered with the electrode 2711 to produce a second volumetric plasma discharge further down the conduit. In another embodiment, the pairs of electrodes (2705, 2707) and (2709, 2711) are powered simultaneously to produce simultaneous plasma discharges at multiple positions within the conduit. In a further embodiment, the electrode 2707 is also powered with the electrode 2709 to produce a third volumetric plasma discharge. In an embodiment, the electrodes are powered in a sequence of pairs (2705, 2707), (2707, 2709), (2709, 2711) to produce a series of three plasma discharges progressing down the conduit from the electrode 2705 toward the electrode 2711. In another embodiment, the electrode pairs (2705, 2707) and (2709, 2711) are powered simultaneously to produce simultaneous plasma discharges, and the electrode pair (2707, 2709) is later powered to produce a later plasma discharge. In an embodiment, the pattern of powering pairs of electrodes is repeated to produce repeated plasma discharges. In an embodiment, the repeated plasma discharges generate EHD body forces that induce flow of propellant molecules from the electrode 2705 toward the electrode 2711. In an embodiment, at least one of the powered pairs is separated by an interelectrode distance of less than 20 microns. In an embodiment, the interelectrode distance is about 1 microns. In an embodiment, the interelectrode distance is about 3 microns. In an embodiment, the interelectrode distance is about 5 microns. In an embodiment, the interelectrode distance is between 1 and 15 microns. In an embodiment, the interelectrode distance is between 1 and 10 microns. In an embodiment, the interelectrode distance is less than 5 microns. In an embodiment, the interelectrode distance is between 1 and 5 microns. In an embodiment, the interelectrode distance is between 3 and 5 microns.

Figure 40:
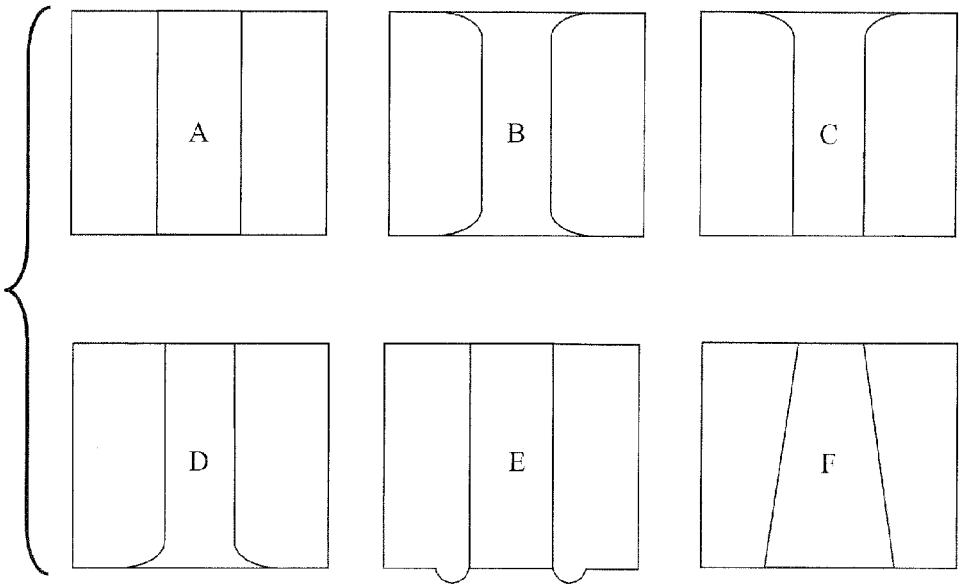
FIG. 40 shows various conduit configurations in accordance with embodiments of the subject invention.

FIG. 40 shows various conduit configurations in accordance with embodiments of the subject invention. The configurations shown can be applied to various conduits, such as the micro channels, expansion slots, or other conduits discussed above. As shown, such conduits can widen or narrow linearly or geometrically at one or both ends. The conduits can also narrow or widen along the entire length of the conduit. Such change can also be linear or geometric. As shown in FIG. 40E, such conduits can also have convex protrusions on one or both ends. In other embodiments, concave structures can also be formed at one or both ends of such conduits. Such structures can have various concave and/or convex shapes including square, rectangular, rounded, circular, elliptical, polygonal, among other shapes. In an embodiment, such structures facilitate flow of a propellant fluid through the conduit.

Figure 41:
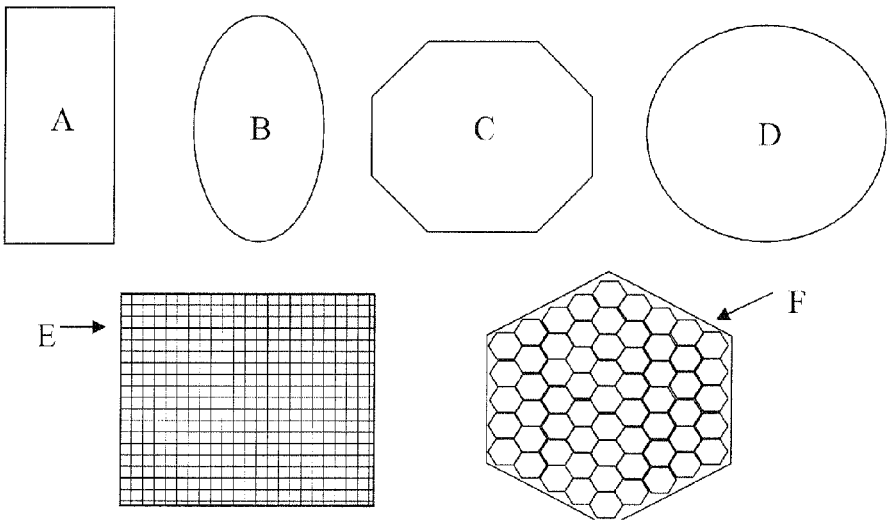
FIG. 41 shows various conduit cross-sections in accordance with embodiments of the subject invention.

FIG. 41 shows various conduit cross-sections in accordance with embodiments of the subject invention. The cross-sections shown can be used with various conduits, such as the micro channels, expansion slots, or other conduits discussed above. A variety of micro channel and/or slot cross-sections can be implemented. Examples of cross-sections include, but are not limited to, circular, square, rectangular, polygonal, hexagonal, or parallel plates or curves. Such conduits can have various cross-sections. In an embodiment, a channel or slot is formed having internal structures formed therein to further control flow through the channel or slot. For example, a honey comb structure can be used as shown in FIG. 41F.

In embodiments of the subject invention, EHD body forces can be used to pump fluid in a micro channel or other small conduit without any mechanical components. The actuators of the micropump according to some embodiments of the present invention can operate using (pulsed) dc and ac power supply and can apply large electrohydrodynamic (EHD) forces in a relatively precise and self-limiting manner. Further embodiments can have rapid switch-on/off capabilities. Specific embodiments can operate without any moving parts.

Figure 44A:
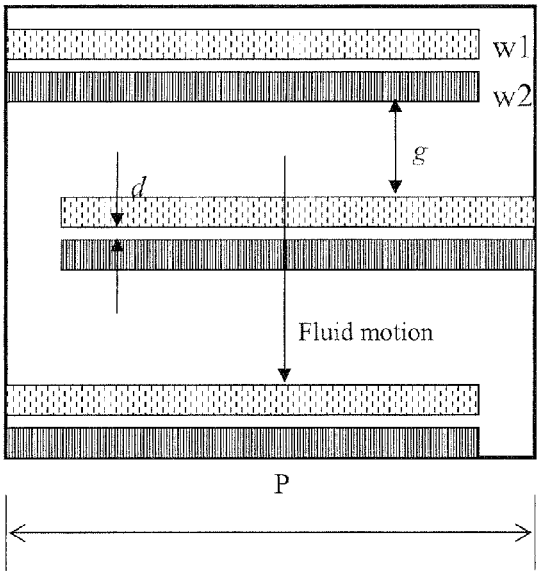
FIGS. 44A and 44B illustrate different positioning of electrodes along the inner perimeter P of a conduit for creating straight and swirl pumping effects, according to embodiments of the subject invention, where the inner surface of the conduit has been laid out flat for illustration purposes.
Figure 44B:
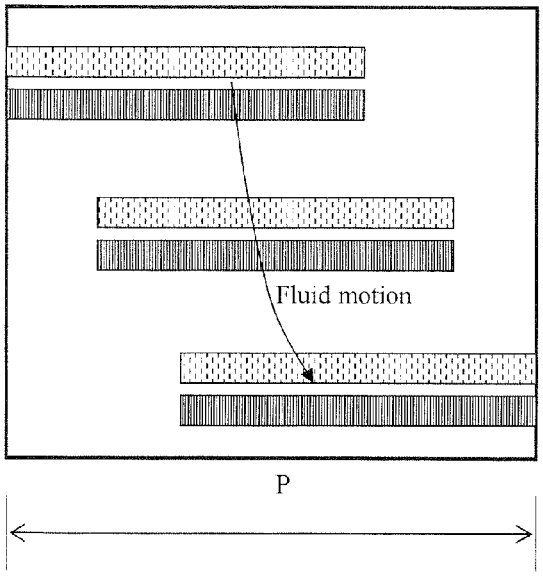
Figure 45A:
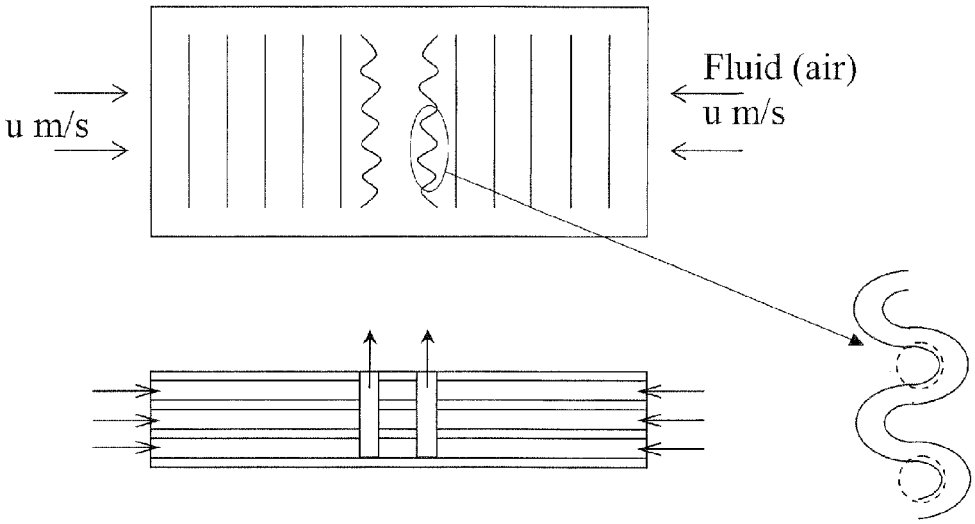
FIGS. 45A and 45B show embodiments incorporating parallel plate flow conduits.
Figure 45B:
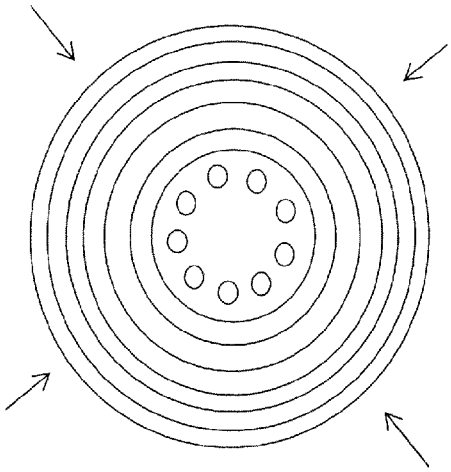

As discussed above in relation to FIG. 41, a variety of conduit cross-sections can be implemented. FIG. 42 can represent a cross-section through a conduit, such as micro channel, expansion slot, or other conduit, having a circular, rectangular, or other shape cross-section, or a parallel plate configuration. FIGS. 44A and 44B can represent a laid open conduit having a circular, rectangular, or other shaped cross-section, or a plate of a parallel plate configuration. FIGS. 45A and 45B show embodiments incorporating parallel plate flow conduits. The top portion of FIG. 45A shows a top of one of the plates of a parallel plate conduit device. Each line shown represents an electrode pair, such as the electrode pairs shown in FIG. 43, with the blown-up drawing section showing a curved electrode pair that can act to direct the flow of the fluid away from the surface. The fluid located in the dotted region of the blown-up drawing section experiences forces from the electrode pair converging from the curved structure of the electrode pairs such that when the fluid is pushed away from the curved electrode pair, the fluid is pushed away from the surface of the plate. The dotted region of the blown-up drawing section can also have an aperture through the plate such that when fluid is pushed up from the plate below, the fluid travels through the plate and is continued to be pushed up. The bottom portion of FIG. 45A shows a side view of a stack of parallel plates having apertures through the top three plates such that fluid flows from the right and left, due to the force from multiple electrode pairs and is directed up as shown by the arrows exiting the apertures in the top plate.

The plates in the stack of plates in FIG. 45A can have a variety of shapes, such as square, rectangular, oval, circular, hexagonal, or polygonal. FIG. 45B shows a specific embodiment having oval shaped plates. FIG. 45B shows multiple apertures through one of the plates, which can optionally coincide with apertures in other plates. Various configurations of apertures in the plates can be implemented. FIG. 45B also shows concentric electrode pairs that create forces on the fluid, for example, to push the fluid toward the center of the device. In an embodiment, fluid is pulled in along the outer edges of the oval plates, pushed toward the center, and then directed up through the apertures. In a specific embodiment, the spacing between the plates shown in FIGS. 45A and 45B can be such that electrode pairs located on the surface of one or both plates creating the parallel plate flow orifices can create a bulk flow effect to move the fluid through the parallel plate flow orifice.

FIG. 42 shows a longitudinal cross-section of a conduit, such as a micro channel, expansion slot, or other conduit, according to an embodiment of the present invention. In one embodiment, the conduit material can be an insulator and can have a channel height b. The pumping of fluids through the conduit may be accomplished utilizing electromagnetic effects such as an electrohydrodynamic body force and/or a magnetohydrodynamic effect through a Lorentz force. The forces can be induced using dynamic barrier discharge (DBD) electrodes. As illustrated in FIG. 42, the conduit can be asymmetrically coated with electrode pairs. An electrode pair including a powered electrode having a width w1 and a grounded electrode having a width w2 can be formed adjacent each other and separated by a distance d. In an embodiment, the distance d is less than 20 microns. In an embodiment, the distance d is about 1 microns. In an embodiment, the distance d is about 3 microns. In an embodiment, the distance d is about 5 microns. In an embodiment, the distance d is between 1 and 15 microns. In an embodiment, the distance d is between 1 and 10 microns. In an embodiment, the distance d is less than 5 microns. In an embodiment, the distance d is between 1 and 5 microns. In an embodiment, the distance d is between 3 and 5 microns. The electrode pair can be a DBD electrode pair, where the grounded electrode and the powered electrode can be separated a distance h by an insulator. In an embodiment, the distance h is less than 20 microns. In an embodiment, the distance h is about 1 microns. In an embodiment, the distance h is about 3 microns. In an embodiment, the distance h is about 5 microns. In an embodiment, the distance h is between 1 and 15 microns. In an embodiment, the distance h is between 1 and 10 microns. In an embodiment, the distance h is less than 5 microns. In an embodiment, the distance h is between 1 and 5 microns. In an embodiment, the distance h is between 3 and 5 microns. In an embodiment, the electrode pair is separated by a wall of the conduit, or portion thereof. These electrode pairs can be formed at intervals along the conduit. For example, the electrode pairs can be asymmetrically formed along the conduit at intervals with an actuator gap g. In an embodiment, the total distance separating the electrode pair is less than 20 microns. In an embodiment, the total distance is about 1 microns. In an embodiment, the total distance is about 3 microns. In an embodiment, the total distance is about 5 microns. In an embodiment, the total distance is between 1 and 15 microns. In an embodiment, the total distance is between 1 and 10 microns. In an embodiment, the total distance is less than 5 microns. In an embodiment, the total distance is between 1 and 5 microns. In an embodiment, the total distance is between 3 and 5 microns.

In an embodiment, the powered electrodes can be exposed along the inner perimeter of the conduit. In another embodiment, the powered electrodes can have a coating separating the powered electrode from the fluid. Various embodiments can be applied to any fluids that can be ionized, such as air, gases, and liquids. For electrically non-conductive fluids, the electrode of the electrode pair near the surface can be exposed to the fluid, but a cover can be positioned over the electrode if desired. For electrically conductive fluids, a cover, such as dielectric coating, can be placed over the electrode near the surface. This cover can improve safety.

In operation, a small plasma discharge can be generated in the vicinity of the exposed (powered) electrode to induce an amount of electrohydrodynamic (EHD) body force to push gas/liquid in a certain direction. In an embodiment, a sheath region is generated in the conduit, wherein the sheath region has a high electric field relative to the remainder of the conduit. In an embodiment, the number density of ions in the sheath region is significantly greater than the number density of electrons in the sheath region. A magnetic field can also be used to induce additional magnetohydrodynamic (MHD) effect through Lorentz force. In a specific embodiment, the magnetic field can be oriented such that the current flow of the gas and/or liquid crossed with the direction of the magnetic field creates a force away from the surface of the conduit, so as to pinch the fluid along. The net result can be very efficient movement of fluid through the conduit.

The electrode pairs can be powered and formed in various configurations. FIG. 43 shows examples of electrode arrangements that can be incorporated in embodiments of the present invention. FIGS. 43A and 43B show an electrode pair with both electrodes on the same surface, where h=0. FIG. 43A illustrates the electrode pair as being maintained at a potential bias using steady direct current, and FIG. 43B illustrates the electrode pair as being maintained at a potential bias using pulsed direct current. In another embodiment, alternating current can be used. FIG. 43C shows an electrode pair separated by an insulator layer. The electrode pair of FIG. 43C can also be referred to as barrier discharge electrodes where one electrode can be powered with dc or ac operating at a radio frequency. The powered electrode can be exposed to the gas, but embodiments can be provided where the powered electrode is not exposed to the gas.

In operation, electric forces can be generated between the electrodes. As the applied voltage becomes sufficiently large for a given interelectrode distance d and pressure p, the dielectric surface adjacent to the electrode can produce a surface discharge weakly ionizing the surrounding gas. The plasma can cause an energy exchange between charged and neutral species. In this discharge, microfilaments of nanosecond duration with many current pulses in a half cycle can maintain the optical glow. Due to a combination of electrodynamic and collisional processes, charge separated particles induce the gas particles to move.

FIGS. 44A-44B show details along the inner perimeter of a flow conduit. FIG. 44A shows an example of a periodic pattern for implementing straight pumping. FIG. 44B shows an example of a step pattern for swirl pumping. In a specific embodiment, each electrode pair along the length of the flow conduit can rotate with respect to the electrode pair before it, around the longitudinal axis of the flow conduit, as shown in FIG. 44B, so as to create a swirl flow pattern.

Various conduit configurations can be used with the subject invention as discussed above including various dimensions, geometry, electrode arrangements, and powering schemes.

Figure 46:
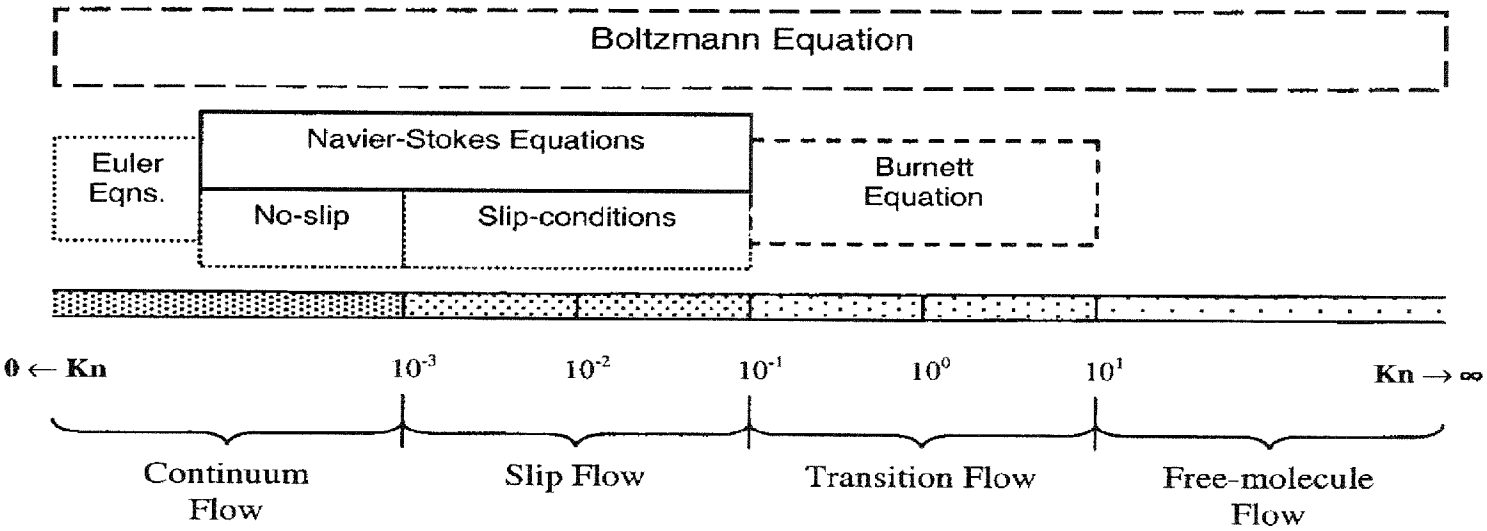
FIG. 46 shows Knudsen number regimes for modeling fluid flow through a conduit in accordance with embodiments of the subject invention.

FIG. 46 shows Knudsen number regimes for modeling fluid flow through a micro channel or expansion slot in accordance with embodiments of the subject invention. Subrata Roy and Reni Raju discussed modeling fluid flow through such structures in Roy & Raju, *Modeling Gas Flow through Microchannels and Nanopores*, 93 Journal of Applied Physics 4870 (2003) and Raju & Roy, *Modeling Single Component Fluid Transport through Micro Channels and Free Molecule Micro-Resistojet*, AIAA-2004-1342 (2004), which are hereby incorporated by reference for that purpose.

The paper Raju & Roy, *Modeling Single Component Fluid Transport through Micro Channels and Free Molecule Micro-Resistojet*, AIAA-2004-1342 (2004) also discusses fabrication of MEMS devices. Riki H. Lee and others discussed fabrication of MEMS devices suitable for inclusion in propulsion systems in Lee, et al, *Free Molecule Micro-Resistojet: Nanosatellite Propulsion*, AIAA 2005-4073 (2005). Both of these papers are hereby incorporated by reference for that purpose. As will be understood by one skilled in the art, in accordance with standard MEMS fabrication techniques, micro channels or expansion slots can be fabricated by building up and/or etching materials deposited on a substrate. Electrodes can be incorporated into such layers to achieve the configurations shown and discussed above. Other methods of achieving such configurations may be possible and can be used with the subject invention.

Aspects of the invention may be described in the general context of computer-executable instructions, such as program modules, being executed by a computer. Generally, program modules include routines, programs, objects, components, data structures, etc., that perform particular tasks or implement particular abstract data types. Such program modules can be implemented with hardware components, software components, or a combination thereof. Moreover, those skilled in the art will appreciate that the invention can be practiced with a variety of computer-system configurations, including multiprocessor systems, microprocessor-based or programmable-consumer electronics, minicomputers, mainframe computers, and the like. Any number of computer-systems and computer networks are acceptable for use with the present invention.

Specific hardware devices, programming languages, components, processes, protocols, and numerous details including operating environments and the like are set forth to provide a thorough understanding of the present invention. In other instances, structures, devices, and processes are shown in block-diagram form, rather than in detail, to avoid obscuring the present invention. But an ordinary-skilled artisan would understand that the present invention can be practiced without these specific details. Computer systems, servers, work stations, and other machines can be connected to one another across a communication medium including, for example, a network or networks.

As one skilled in the art will appreciate, embodiments of the present invention can be embodied as, among other things: a method, system, or computer-program product. Accordingly, the embodiments can take the form of a hardware embodiment, a software embodiment, or an embodiment combining software and hardware. In an embodiment, the present invention takes the form of a computer-program product that includes computer-useable instructions embodied on one or more computer-readable media. Methods, data structures, interfaces, and other aspects of the invention described above can be embodied in such a computer-program product.

Computer-readable media include both volatile and nonvolatile media, removable and nonremovable media, and contemplate media readable by a database, a switch, and various other network devices. By way of example, and not limitation, computer-readable media comprise media implemented in any method or technology for storing information. Examples of stored information include computer-useable instructions, data structures, program modules, and other data representations. Media examples include, but are not limited to, information-delivery media, RAM, ROM, EEPROM, flash memory or other memory technology, CD-ROM, digital versatile discs (DVD), holographic media or other optical disc storage, magnetic cassettes, magnetic tape, magnetic disk storage, and other magnetic storage devices. These technologies can store data momentarily, temporarily, or permanently. In an embodiment, non-transitory media are used.

The invention can be practiced in distributed-computing environments where tasks are performed by remote-processing devices that are linked through a communications network or other communication medium. In a distributed-computing environment, program modules can be located in both local and remote computer-storage media including memory storage devices. The computer-useable instructions form an interface to allow a computer to react according to a source of input. The instructions cooperate with other code segments to initiate a variety of tasks in response to data received in conjunction with the source of the received data.

The present invention can be practiced in a network environment such as a communications network. Such networks are widely used to connect various types of network elements, such as routers, servers, gateways, and so forth. Further, the invention can be practiced in a multi-network environment having various, connected public and/or private networks.

Communication between network elements can be wireless or wireline (wired). As will be appreciated by those skilled in the art, communication networks can take several different forms and can use several different communication protocols. And the present invention is not limited by the forms and communication protocols described herein.

All patents, patent applications, provisional applications, and publications referred to or cited herein are incorporated by reference in their entirety, including all figures and tables, to the extent they are not inconsistent with the explicit teachings of this specification.

It should be understood that the examples and embodiments described herein are for illustrative purposes only and that various modifications or changes in light thereof will be suggested to persons skilled in the art and are to be included within the spirit and purview of this application.

The invention claimed is:

1. A device, comprising:

a conduit having at least one surface;

at least one electrode pair positioned on the at least one surface of the conduit for pumping a fluid through the conduit, wherein one electrode of each electrode pair of the at least one electrode pair is separated from the other electrode of the each electrode pair by an interelectrode distance d, wherein the interelectrode distance d is a total distance between the one electrode of the each electrode pair and the other electrode of the each electrode pair, and wherein the interelectrode distance d is less than 100 microns; and a voltage source, wherein the voltage source applies a corresponding voltage across the at least one electrode pair, wherein application of the corresponding voltage across the at least one electrode pair generates a corresponding at least one plasma in the conduit such that a sheath region is generated in the conduit, and causes a corresponding at least one electrohydrodynamic body force to the fluid in the conduit, and wherein either the sheath region extends from a cathode of the at least one electrode pair such that the number density of ions in the sheath region is greater than the number density of electrons in the sheath region, or the sheath region extends from an anode of the at least one electrode pair such that the number density of ions in the sheath region is less than the number density of electrons in the sheath region.

2. The device according to claim 1, wherein the corresponding voltage has a voltage magnitude less than 750 V.

3. The device according to claim 2, wherein the interelectrode distance d is less than 5 microns.

4. The device according to claim 2, wherein the interelectrode distance d is less than 50 microns.

5. The device according to claim 4, wherein the interelectrode distance d is less than 20 microns.

6. The device according to claim 5, wherein the interelectrode distance d is less than 1 micron.

7. The device according to claim 5, wherein the interelectrode distance d is about 1 micron.

8. The device according to claim 7, wherein the corresponding voltage has a voltage magnitude between 300 and 750 V.

9. The device according to claim 8, wherein the corresponding voltage has a voltage magnitude of about 500 V.

10. The device according to claim 9, wherein the interelectrode distance d is the horizontal distance between the one electrode of the each electrode pair and the other electrode of the each electrode pair.

11. The device according to claim 9, wherein the interelectrode distance d is the vertical distance between the one electrode of the each electrode pair and the other electrode of the each electrode pair.

12. The device according to claim 9, wherein the at least one surface of the conduit comprises an insulator material, and wherein electrodes of one or more of the at least one electrode pair are separated by the insulator material.

13. The device according to claim 1, wherein the voltage source applies a direct current voltage to one or more electrode pairs of the least one electrode pair.

14. The device according to claim 1, wherein the voltage source a lies an alternating current voltage to one or more electrode pairs of the least one electrode pair.

15. The device according to claim 14, wherein the alternating current operates at a radio frequency.

16. The device according to claim 13, wherein the direct current is pulsed.

17. The device according to claim 12, wherein a powered electrode of each electrode pair of the one or more electrode pairs of the at least one electrode pair is exposed at an inside of the conduit and a grounded electrode of each electrode pair of the one or more electrode pairs of the at least one electrode pair is separated from the powered electrode by the insulating material.

18. The device according to claim 1, wherein the device comprises at least two plates, and wherein the at least one surface comprises at least one surface on each plate, wherein the conduit is between two of the at least two plates.

19. The device according to claim 1, wherein the conduit has a cross-sectional shape selected from the following: circular, elliptical, square, rectangular, and hexagonal.

20. The device according to claim 1, wherein the device is a pump for a conducting fluid.

21. The device according to claim 1, wherein the device is a pump for a non-conducting fluid.

22. The device according to claim 1, wherein the conduit has a thickness less than or equal to a Debye length when the certain potential is applied to the at least one electrode pair.

23. The device according to claim 1, wherein the sheath region extends into at least 25% of the entire flow region.

24. The device according to claim 1, wherein the sheath region extends into at least 50% of the entire flow region.

25. The device according to claim 1, wherein the sheath region extends into at least 75% of the entire flow region.

26. The device according to claim 1, wherein the sheath region extends into at least 95% of the entire flow region.

27. The device according to claim 1, wherein the sheath region extends into at least 1% of the entire flow region.

28. The device according to claim 1, wherein the sheath region extends into at least 5% of the entire flow region.

29. The device according to claim 1, wherein the sheath region extends into at least 10% of the entire flow region.

30. A method of flowing a fluid, comprising:

providing a conduit having at least one surface;

providing at least one electrode pair positioned on the at least one surface of the conduit for pumping fluid through the conduit, wherein one electrode of each electrode pair of the at least one electrode pair is separated from the other electrode of the each electrode pair by an interelectrode distance d, wherein the interelectrode distance is a total distance between the one electrode of the each electrode pair and the other electrode of the each electrode pair, wherein the interelectrode distance d is less than 100 microns; and powering one or more electrode pairs of the at least one electrode pair with a certain voltage so as to create a plasma discharge in the conduit, such that a sheath region is generated in the conduit, and causes a corresponding at least one electrohydrodynamic body force to the fluid in the conduit wherein either the sheath region extends from a cathode of the at least one electrode pair such that the number density of ions in the sheath region is greater than the number density of electrons in the sheath region, or the sheath region extends from an anode of the at least one electrode pair such that the number density of ions in the sheath region is less than the number density of electrons in the sheath region.

* * * * *

UNITED STATES PATENT AND TRADEMARK OFFICE

CERTIFICATE OF CORRECTION

PATENT NO. : 9,282,623 B2
APPLICATION NO. : 13/642796
DATED : March 8, 2016
INVENTOR(S) : Subrata Roy and Chin-Cheng Wang It is certified that error appears in the above-identified patent and that said Letters Patent is hereby corrected as shown below:

Specification

Column 8,
Line 17, "horizontal vertical $d_2$" should read --horizontal $d_1$, vertical $d_2$--

Column 10,
Line 11, "elcctrohydrodynamic (EHD)"' should read --electrohydrodynamic (EHD)--

Column 11,
Line 40, "Radmilović-Radjenovi ić" should read --Radmilović-Radjenović--

Column 11,
Line 51, "Farouk at al." should read --Farouk *et al.*--

Column 11,
Line 51, "de argon" should read --dc argon--

Column 13,
Line 4, "$\nabla \cdot (\in E)=q$" should read --$\nabla \bullet (\varepsilon E) = q$--

Column 13,
Line 6, "where $\in$" should read --where $\varepsilon$--

Column 13,
Line 10, "$u_{ej}/V_{ej}/V_B$" should read --$u_{ej}=V_{ej}/V_B$--

Column 15,
Line 14, "$\in_d=4.5 \in_0$," should read --$\varepsilon_d = 4.5\varepsilon_0$, where $\varepsilon_0$--

Signed and Sealed this
Twenty-sixth Day of July, 2016

Michelle K. Lee

Michelle K. Lee
*Director of the United States Patent and Trademark Office*

Column 16,
Line 29, “strong vertical” should read --strong vortical--

Column 22,
Line 57, “a harrier” should read --a barrier--

Column 25,
Line 65, “FIGS. 29A and 299” should read --Figures 29A and 29B--

Claims

Column 33,
Line 65, claim 14, “voltage source a lies” should read --voltage source applies--